US005498513A

United States Patent [19]

Mihayashi et al.

[11] Patent Number: 5,498,513

[45] Date of Patent: Mar. 12, 1996

[54] SILVER HALIDE COLOR PHOTOGRAPHIC PHOTOSENSITIVE MATERIALS

[75] Inventors: Keiji Mihayashi; Atsuhiro Ohkawa, both of Kanagawa, Japan

[73] Assignee: Fuji Photo Film Co., Ltd., Kanagawa, Japan

[21] Appl. No.: 267,926

[22] Filed: Jul. 6, 1994

Related U.S. Application Data

[63] Continuation of Ser. No. 55,755, May 3, 1993, abandoned, which is a continuation of Ser. No. 668,913, Mar. 13, 1991, abandoned.

[30] Foreign Application Priority Data

Mar. 13, 1990 [JP] Japan ..... 2-62180

[51] Int. Cl.[6] ..... G03C 1/46

[52] U.S. Cl. ..... 430/505; 430/544; 430/549; 430/957

[58] Field of Search ..... 430/505, 544, 430/957, 558, 552, 553, 554, 555, 556, 557

[56] References Cited

U.S. PATENT DOCUMENTS

| | | | |
|---|---|---|---|
| 4,477,563 | 10/1984 | Ichijima et al. | 430/544 |
| 4,749,644 | 6/1988 | Tasaka et al. | 430/957 |
| 4,798,784 | 1/1989 | Kishimoto et al. | 430/957 |
| 4,937,179 | 6/1990 | Hirano et al. | 430/957 |
| 5,004,677 | 4/1991 | Ueda | 430/382 |
| 5,026,628 | 6/1991 | Begley et al. | 430/957 |
| 5,077,182 | 12/1991 | Sasaki et al. | 430/957 |

FOREIGN PATENT DOCUMENTS

| | | |
|---|---|---|
| 0204175 | 12/1986 | European Pat. Off. . |
| 0318992 | 6/1989 | European Pat. Off. . |
| 3209846 | 9/1982 | Germany . |
| 63-226651 | 9/1988 | Japan . |

OTHER PUBLICATIONS

Science and Technology of Photography, p. 113, edited by Karlheinz Keller, 1993.

*Primary Examiner*—Hoa Van Le

*Attorney, Agent, or Firm*—Birch, Stewart, Kolasch & Birch

[57] ABSTRACT

A silver halide color photographic material comprising a support having thereon at least one photosensitive emulsion layer comprising a DIR coupler which is represented by general formula (I) below and a compound which is represented by general formula (R-1) below;

Formula (I)

wherein A represents a coupler residual group, n represents an integer of 0 or 1 with the proviso that when A represents a phenol type or naphthol type coupler residual group then n is 1, and when A represents some other coupler residual group then n is 0, and R represents an alkyl group which has from 1 to 4 carbon atoms or a pyridyl group;

$$A\text{-}(L_1)_v\text{-}B\text{-}(L_2)_w\text{-}INH\text{-}HYD \qquad \text{Formula (R-I)}$$

wherein A represents a group which reacts with the oxidized form of the developing agent and cleaves $(L_1)_v$-B-$(L_2)_w$-INH-HYD, $L_1$ represents a group which cleaves the bond with B after cleavage of the bond with A, B represents a group which reacts with the oxidized form of a developing agent and cleaves $(L_2)_w$-INH-HYD, $L_2$ represents a group which cleaves INH-HYD after cleavage of the bond with B, INH represents a group which has a development inhibiting capacity, HYD represents an alkoxycarbonyl group or a group which contains an alkoxycarbonyl group, v and w each represent an integer of value from 0 to 2, and when they represent 2, the two $L_1$ and the two $L_2$ groups may be the same or different.

21 Claims, No Drawings

SILVER HALIDE COLOR PHOTOGRAPHIC PHOTOSENSITIVE MATERIALS

This application is a continuation of application Ser. No. 08/055,755 filed on May 3, 1993, which was a continuation of application Ser. No. 07/668,913, filed Mar. 13, 1991, both now abandoned.

FIELD OF THE INVENTION

This invention concerns silver halide color photographic materials, and in particular it concerns silver halide color photographic materials which contain novel DIR couplers and novel development inhibitor releasing compounds. The materials have excellent sharpness and color reproduction. Properties and possess an excellent suitability for continuous processing, since there is a change in their properties during development processing such that development inhibitors in a developer have essentially no effect on their photographic performance.

BACKGROUND OF THE INVENTION

In recent years there has been a demand for silver halide photosensitive materials, especially camera color sensitive materials, which have excellent sharpness and color reproduction properties at high photographic speed as typified by the materials which have a ISO speed of 100 or an ISO speed of 400 (Super HG-400) and which provide a high image quality.

DIR couplers are known as a means of improving sharpness and color reproduction properties; but more recently, other compounds, including those represented by general formula (R-I) of the present invention, have been proposed to improve these properties in JP-A-60-185950. (The term "JP-A" as used herein signifies an "unexamined published Japanese patent application".) More precisely, while sharpness and color reproduction have been improved by these compounds, their use resulted in changes in photographic properties as the developer became fatigued, and thus the conjoint use of these compounds and so-called DIR compounds was proposed in JP-A-61-255342. Furthermore, the use of the above mentioned compounds at the same time with DIR compounds has also been disclosed in more recent patents, for example in JP-A-1-107256, JP-A-1-259359, JP-A-1-269935 and JP-A-2-28637, but not only are the levels of color reproduction and sharpness achieved inadequate with the sensitive materials in which these are used, but when these materials are processed using the processing methods generally used in commercial laboratories at the present time, which is to say continuous processing with replenishment of the developer, the developer sometimes becomes more active and, conversely, it sometimes becomes less active and it has become clear that stable performance cannot be obtained.

On the other hand, hydrolysis type DIR compounds and couplers which improve sharpness and color reproduction without changing the activity of the developer as indicated above have also been proposed, for example, in JP-A-57-151944, JP-A-58-205150, JP-A-1-280755 and U.S. Pat. No. 4,782,012. More precisely, the fluctuation in developer activity has been improved by means of DIR couplers and DIR compounds which release leaving groups of the type such that the development inhibitors are hydrolyzed in the developer and the development inhibiting activity is essentially lost, but their effect in this respect has still been inadequate. In particular, in those instances where a development inhibitor is deactivated and an aryl oxide ion is released in the developer which is taken up into coupler oil droplets in the photosensitive material, there is clearly changed the coupling activity of the couplers and as a result a change in photographic performance also occurs.

Furthermore, timing type DIR couplers also give rise to problems with respect to the stability of the compounds and preparative costs, and those which are eliminated from the coupler via sulfur, such as those disclosed in U.S. Pat. No. 4,782,012 for example, have a low coupling activity, which is to say that the development inhibitor release rate is slow and so there is a problem in that an adequate improving effect on color reproduction and sharpness is not obtained.

SUMMARY OF THE INVENTION

The aims of the present invention are firstly to provide photosensitive materials which are simultaneously satisfactory in respect of photographic speed, sharpness, color reproduction and the storage properties of the sensitive material, secondly to provide photosensitive materials with which the fluctuation in photographic performance using the method of continuous processing with replenishment of the developer is small, thirdly to provide photosensitive materials with which the uneven development which arises such as tailing off in the opposite direction to the running direction of the sensitive material when development processing with directionality as in the case of a roller transport system or a grip system is very slight, and fourthly to provide sensitive materials which contain DIR couplers which have a short synthesis route, which are cheap and have excellent compound stability, and which have a high coupling rate.

These aims of the invention have been realized by means of a photosensitive material as described below.

A silver halide color photographic material comprising a support having thereon at least one photosensitive emulsion layer having included therein a DIR coupler which is represented by general formula (I) below and a compound which is represented by the general formula (R-1) below.

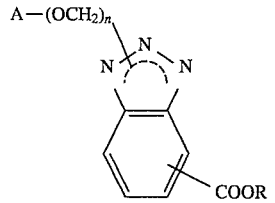

General Formula (I)

In formula (I), A represents a coupler residual group; n represents an integer of 0 to 1 with the proviso that when A represents a phenol type or naphthol type coupler residual group then n is 1, and when A represents some other coupler residual group then n is 0; and R represents an alkyl group which has from 1 to 4 carbon atoms or a pyridyl group.

$$A\text{-}(L_1)_v\text{-}B\text{-}(L_2)_w\text{-}INH\text{-}HYD$$ General Formula (R-I)

In formula (R-I), A represents a group which reacts with the oxidized form of the developing agent and cleaves $(L_1)v$-B-$(L_2)_w$-INH-HYD, $L_1$ represents a group which cleaves the bond with B after cleavage of the bond with A, B represents a group which reacts with the oxidized form of a developing agent and cleaves $(L_2)_w$-INH-HYD, $L_2$ represents a group which cleaves INH-HYD after cleavage of the bond with B, INH represents a group which has a development inhibiting capacity, HYD represents an alkoxycarbonyl group or a group which contains an alkoxycarbonyl group, v and w each represent an integer of value from 0 to 2 and may be the same or different, and when they represent 2, the two $L_1$ and/or the two $L_2$ groups may be the same or different.

DETAILED DESCRIPTION OF THE INVENTION

A in general formula (I) is described in detail below.

A represents a yellow coupler residual group (e.g., an open chain ketomethylene type), a magenta coupler residual group (e.g., a 5-pyrazolone type, a pyrazoloimidazole type or pyrazolotriazole type), a cyan coupler residual group (e.g., a phenol type or a naphthol type) or a non-color forming coupler residual group (e.g., an indanone type or an acetophenone type). Furthermore, it may be a coupler residual group of the heterocyclic type disclosed in U.S. Pat. Nos. 4,315,070, 4,183,752, 3,961,959 or 4,171,223.

Preferred as coupler residual groups A are those represented by the general formulae (Cp-1), (Cp-2), ( Cp-3), (Cp-4), (Cp-5), (Cp-6), (Cp-7), (Cp-8), (Cp-9) or (Cp-10). These couplers have high coupling rates.

General Formula (Cp-1)

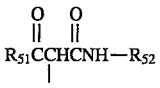

General Formula (Cp-2)

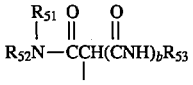

General Formula (Cp-3)

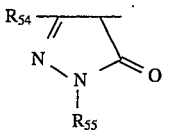

General Formula (Cp-4)

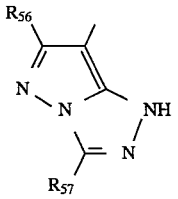

Gerneral Formula (Cp-5)

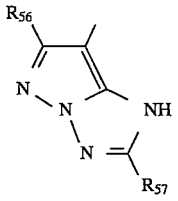

General Formula (Cp-6)

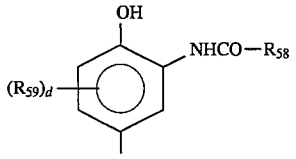

-continued

General Formula (Cp-7)

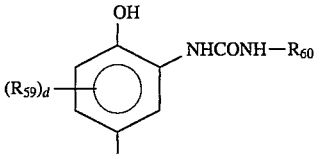

General Formula (Cp-8)

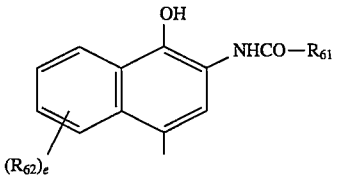

General Formula (Cp-9)

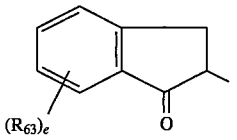

General Formula (Cp-10)

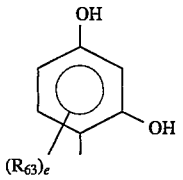

In the above formulae, the free bond originating from the coupling position represents the location of the bond with the coupling leaving group.

In those case where $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$ or $R_{63}$ in the above formulae is a nondiffusible group, the same is selected in such a way that the total number of carbon atoms is from 8 to 40, and preferably from 10 to 30, and in other cases the total number of carbon atoms is preferably not more than 15. In the case of bis, telomeric or polymeric type couplers, any of the above mentioned substituent groups may represent a divalent group which links the repeating units together. In this case, the range for the number of carbon atoms may be outside that specified above.

$R_{51}$–$R_{63}$, b, d and e are described in detail below.

$R_{41}$ is an aliphatic group, an aromatic group or a heterocyclic group, $R_{42}$ represents an aromatic group or a heterocyclic group; and $R_{43}$, $R_{44}$ and $R_{45}$, same or different, are hydrogen atoms, aliphatic groups, aromatic groups or heterocyclic groups.

$R_{51}$ represents a group of the same significance as $R_{41}$; b represents 0 or 1; $R_{52}$ and $R_{53}$ each represent groups of the same significance as $R_{42}$; $R_{54}$ represents a group which has the same significance as $R_{41}$, or represents an

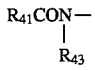

group, an

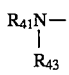

group, an $R_{41}SO_2N(R_{43})$— group, an $R_{41}S$— group, an $R_{43}O$— group, an $R_{45}NCON(R_{43})(R_{44})$— group or an N≡C— group. $R_{55}$ represents a group which has the same significance as $R_{41}$. $R_{56}$ and $R_{57}$ each represent a group which has the same significance as $R_{43}$, an $R_{41}S$— group, an $R_{43}O$— group, an $R_{41}CON(R_{43})$— group or an $R_{41}SO_2N(R_{43})$— group. $R_{58}$ represents a group which has the significance as $R_{41}$. $R_{59}$ represents a group which has the same significance as $R_{41}$, or represents an $R_{41}CON(R_{43})$— group, an $R_{41}OCON(R_{43})$— group, an $R_{41}SO_2N(R_{43})$— group, an $R_{43}NCON(R_{44})(R_{45})$— group, an $R_{41}O$— group, an $R_{41}S$— group, a halogen atom or an $R_{41}N(R_{43})$— group. Moreover, d represents from 0 to 3. When d is 2 or 3, the $R_{59}$ substituent groups may be the same or different. Furthermore, the $R_{59}$ groups may be divalent groups which are joined together to form ring structures. Typical examples of divalent groups which form ring structures include the group

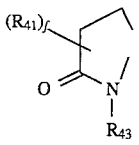

and the group

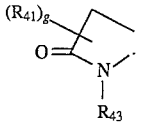

In the above formulae f represents an integer of value from 0 to 4 and g represents an integer of value from 0 to 2; $R_{60}$ represents a group which has the same significance as $R_{41}$; $R_{61}$ represents a group which has the same significance as $R_{41}$; and $R_{62}$ represents a group which has the same significance as $R_{41}$, or represents an $R_{41}OCONH$— group, an $R_{41}SO_2NH$— group, an $R_{43}NCON(R_{44})(R_{45})$— group, an $R_{43}NSO_2N(R_{44})(R_{45})$— group, an $R_{43}O$— group, an $R_{41}S$— group, a halogen atom or an $R_{41}N(R_{43})$— group. $R_{63}$ represents a group which has the same significance as $R_{41}$, an $R_{43}NCON(R_{44})(R_{45})$— group, an $R_{43}NCO(R_{44})$— group, an $R_{41}SO_2N(R_{44})$— group, an $R_{43}NSO_2(R_{44})$— group, an $R_{41}SO_2$— group, an $R_{43}OCO$— group, an $R_{43}O$—$SO_2$— group, a halogen atom, a nitro group, a cyano group or an $R_{43}CO$— group. Moreover, e represents an integer of value from 0 to 4. When there is a plurality of $R_{62}$ or $R_{63}$ groups, these may each be the same or different.

The aliphatic groups represented by $R_{41}$, $R_{43}$ and $R_{44}$ mentioned above are saturated or unsaturated, chain like or cyclic, linear chain or branched, substituted or unsubstituted aliphatic hydrocarbyl groups which have from 1 to 32, and preferably from 1 to 22, carbon atoms. Typical examples include methyl, ethyl, propyl, isopropyl, butyl, tert-butyl, iso-butyl, tert-amyl, hexyl, cyclohexyl, 2-ethylhexyl, octyl, 1,1,3,3-tetramethyl-butyl decyl, dodecyl, hexadecyl and octadecyl.

The aromatic groups represented by $R_{41}$, $R_{42}$, $R_{43}$, $R_{44}$ and $R_{45}$ are substituted or unsubstituted naphthyl groups or substituted or unsubstituted phenyl groups which preferably have from 6 to 20 carbon atoms.

The heterocyclic groups represented by $R_{41}$, $R_{42}$, $R_{43}$, $R_{44}$ and $R_{45}$ are preferably three to eight membered substituted or unsubstituted heterocyclic groups which have from 1 to 20, and preferably from 1 to 7, carbon atoms and in which the hetero atoms are selected from among nitrogen, oxygen and sulfur atoms. Typical examples of heterocyclic groups include 2-pyridyl, 2-thienyl, 2-furyl, 1,3,4-thiadiazol-2-yl, 2,4-dioxo-1,3-imidazolidin-5-yl, 1,2,4-triazol-2-yl and 1-pyrazolyl.

Typical substituent groups in those cases where the aforementioned aliphatic groups, aromatic groups and heterocyclic groups have substituent groups include halogen atoms, $R_{47}O$— groups, $R_{46}S$— groups,

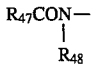

groups,

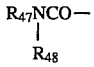

groups,

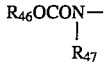

groups

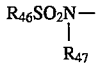

groups,

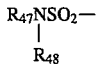

groups, $R_{46}SO_2$— groups, $R_{47}OCO$— groups,

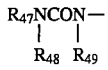

groups, groups which have the same significance as $R_{46}$,

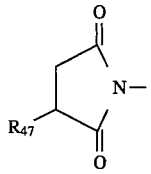

groups, $R_{46}COO$— groups, $R_{47}OSO_2$— groups, cyano groups and nitro groups. In the above formulae, $R_{46}$ represents an aliphatic group, an aromatic group or a heterocyclic group; and $R_{47}$, $R_{48}$ and $R_{49}$, same or different, each represent an aliphatic group, an aromatic group, a heterocyclic group or a hydrogen atom. The meaning of the aliphatic groups, aromatic groups and heterocyclic groups is the same as that defined earlier.

The preferred ranges for $R_{51}$–$R_{63}$, d and e are described below.

$R_{51}$ is preferably an aliphatic group or an aromatic group in general formula (Cp-1), and in general formula (Cp-2) it is preferably a hydrogen atom or an aliphatic group.

$R_{52}$, $R_{53}$ and $R_{55}$ are preferably heterocyclic groups or aromatic groups.

$R_{54}$ is preferably an $R_{41}CONH$— group or an

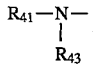

group. $R_{56}$ and $R_{57}$ are preferably aliphatic groups, aromatic groups, $R_{41}O$— groups or $R_{41}S$— groups. $R_{58}$ is preferably an aliphatic group or an aromatic group. In general formula (Cp-6), $R_{59}$ is preferably a chlorine atom, an aliphatic group or an $R_{41}CONH$— group; and moreover, d is preferably 1 or 2. $R_{60}$ is preferably an aromatic group. In general formula (Cp-7), $R_{59}$ is preferably an $R_{41}CONH$— group. In general formula (Cp-7), d is preferably 1. $R_{61}$ is preferably an aliphatic group or an aromatic group. In general formula (Cp-8), e is preferably 0 or 1. $R_{62}$ is preferably an $R_{41}OCONH$— group, an $R_{41}CONH$— group or an $R_{41}SO_2NH$— group, and these are preferably substituted at the 5-position of the naphthol ring. In general formula (Cp-9), $R_{63}$ is preferably an

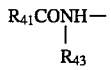

group, an $R_{41}SO_2NH$— group, an $R_{41}NSO_2$— group, an $R_{41}SO_2$— group, an

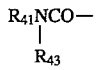

group, a nitro group or a cyano group.

In general formula (Cp-10), $R_{63}$ is preferably an

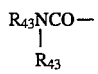

group, an $R_{43}OCO$— group or an $R_{43}CO$— group.

The groups represents by R in general formula (I) are described in detail below.

When R represents an alkyl group it is a linear chain or branched chain, substituted or unsubstituted, alkyl group which has from 1 to 4, and preferably from 1 to 3, carbon atoms.

When R represents a pyridyl group it is a substituted or unsubstituted 2-, 3- or 4-pyridyl group.

When R represents an alkyl group it is preferably a substituted alkyl group. Examples of substituent groups include alkoxycarbonyl groups (which have from 2 to 6 carbon atoms, for example methoxycarbonyl, propoxycarbonyl, butoxycarbonyl, iso-butoxycarbonyl, iso-propoxycarbonyl, pentyloxycarbonyl, iso-pentyloxycarbonyl, 2-methoxyethoxycarbonyl), carbamoyl groups (which have from 0 to 6 carbon atoms, for example N,N-diethylcarbamoyl, N-methyl-N-ethylcarbamoyl, pyrrolidinocarbonyl, piperidinocarbonyl), halogen atoms (for example, chlorine, fluorine), nitro group, cyan group, alkoxy groups (which have from 1 to 4 carbon atoms, for example methoxy, ethoxy, methoxyethoxy), sulfamoyl groups (which have from 0 to 6 carbon atoms, for example N,N-diethylsulfamoyl, N-methyl-N-ethylsulfamoyl), aryloxy groups (which have from 6 to 10 carbon atoms, for example 4-chlorophenoxy), acyl groups (which have from 2 to 6 carbon atoms, for example acetyl, benzoyl), sulfonyl groups (which have from 1 to 6 carbon atoms, for example methanesulfonyl, butanesulfonyl), heterocyclic groups (3–6 membered heterocyclic groups which have from 1 to 5 carbon atoms with the hetero atoms thereof selected from among nitrogen, oxygen and sulfur atoms, for example 2-pyridyl, 3-pyridyl), or phosphoryl groups (which have from 2 to 5 carbon atoms, for example O,O-diethylphosphoryl). The preferred substituent groups from among these groups are the alkoxycarbonyl groups and the carbamoyl groups.

When R represents a pyridyl group, the pyridyl group may have substituent groups, and examples of substituent groups include those described as substituent groups for the alkyl groups, and aliphatic groups (which have from 1 to 6 carbon atoms, for example methyl, ethyl).

Actual examples of R are indicated below:

$-CH_2COOC_3H_7$, $-CH_2COOC_4H_9$, $-CH_2COOC_3H_7(i)$, $-CH_2COOC_4H_9(i)$, $-CH_2COOC_5H_{11}$, $-CH_2COOC_5H_{11}(i)$, $-CH_2COOC_5H_{11}(i)$, $-CH_2CH_2COOC_3H_7$, $-CH_2CH_2COOC_3H_7(i)$, $-CH_2CH_2CH_2COOCH_3$, $-CH_2COOCH(CH_3)CH_2CH_3$,

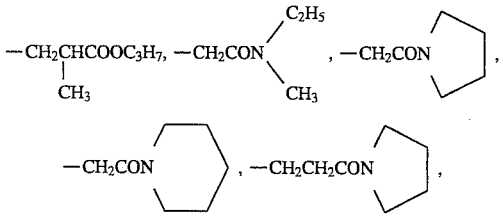

-continued $-CH_2CONHC_4H_9$, $-CH_2CONHC_5H_{11}$, $-CH_2CONHC_4H_9(i)$,

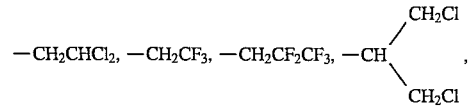

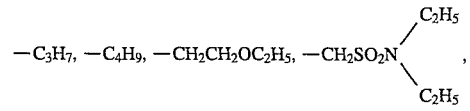

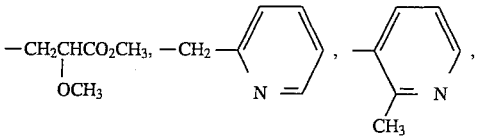

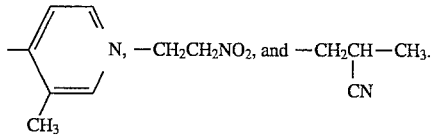

Compounds which can be represented by general formula (I) of the present invention can be prepared using known methods. For example, they can be prepared using the methods disclosed in JP-A-57-151944, EP 336,411A or EP 320,939A.

Actual examples of compounds represented by general formula (I) are described below.

Illustrative Compounds

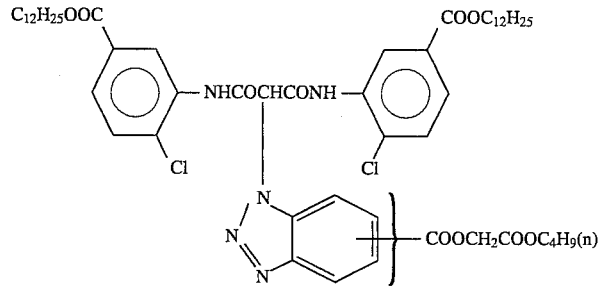

(D-1)

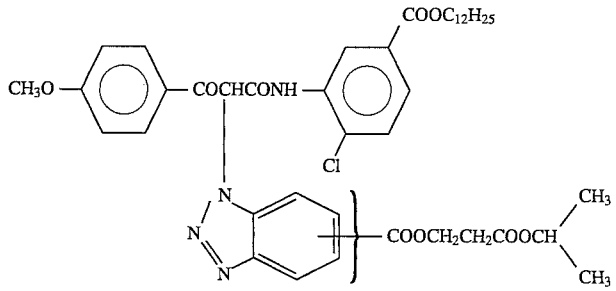

(D-2)

-continued
Illustrative Compounds
(D-3)
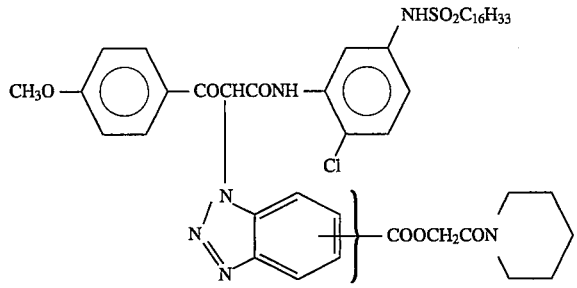
(D-4)
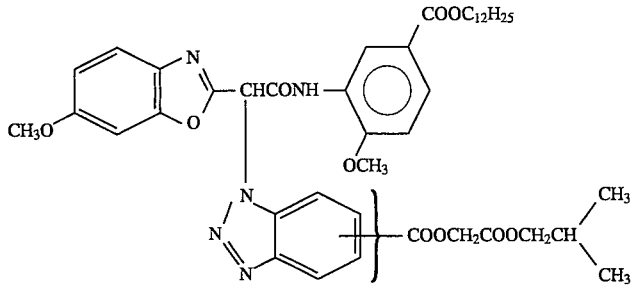
(D-5)
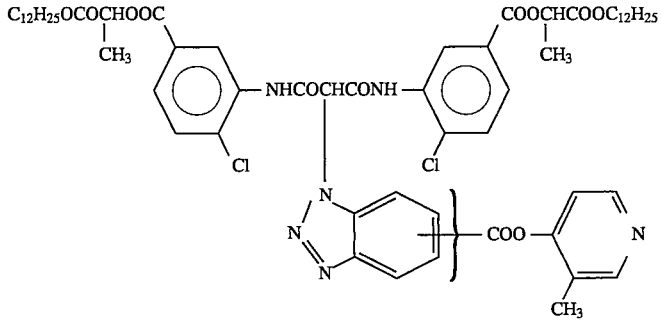
(D-6)
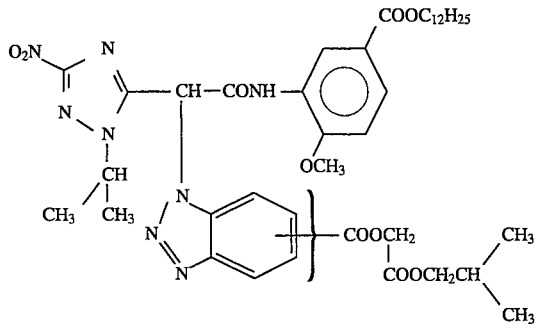
(D-7)
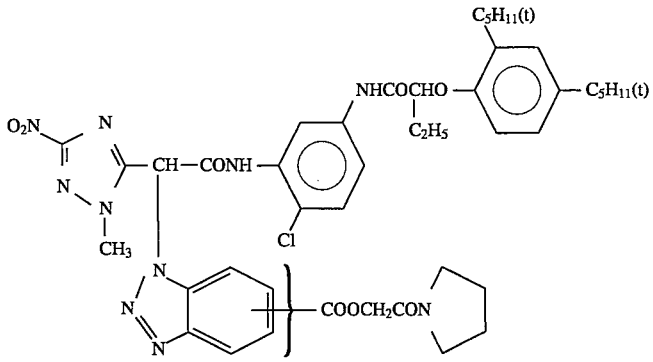

-continued
Illustrative Compounds
(D-8)
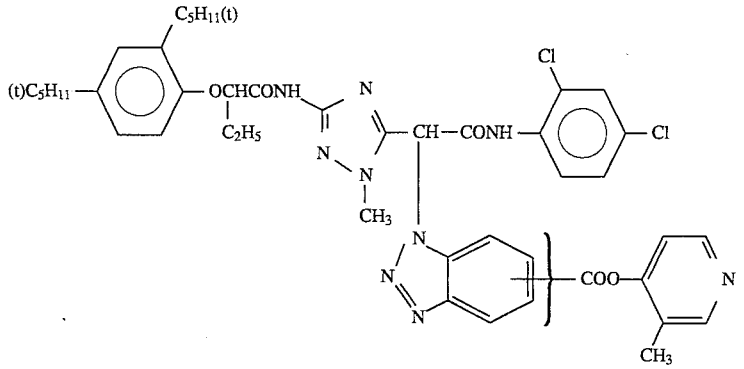
(D-9)
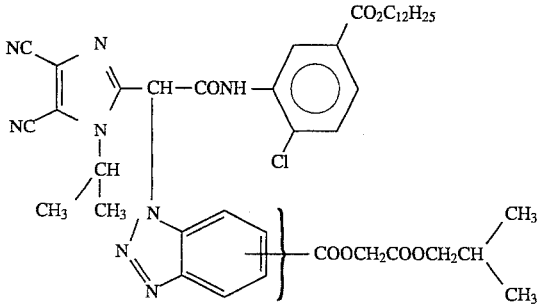
(D-10)
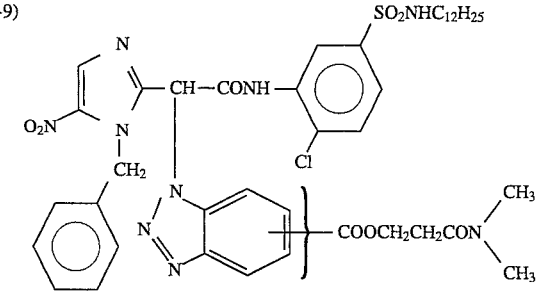
(D-11)
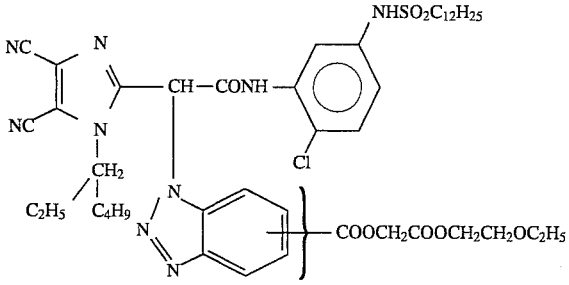
(D-12)
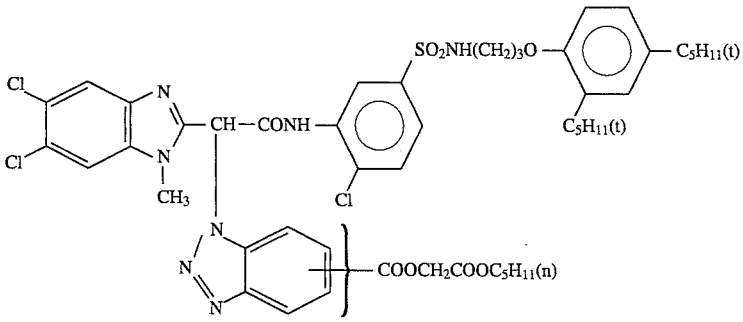
(D-13)
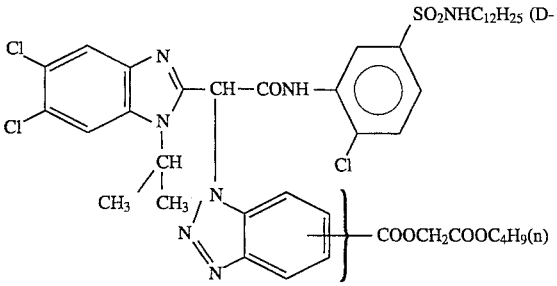
(D-14)
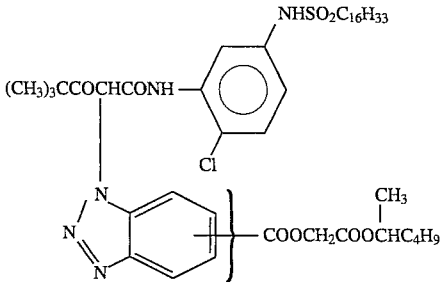

-continued
Illustrative Compounds
(D-15)
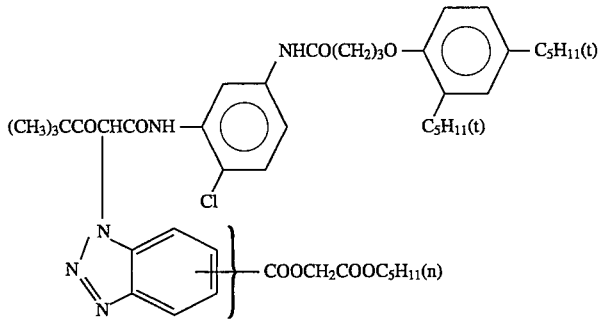
(D-16)
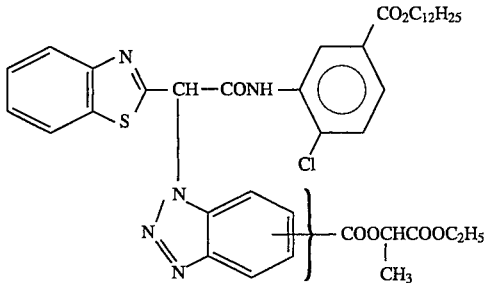
(D-17)
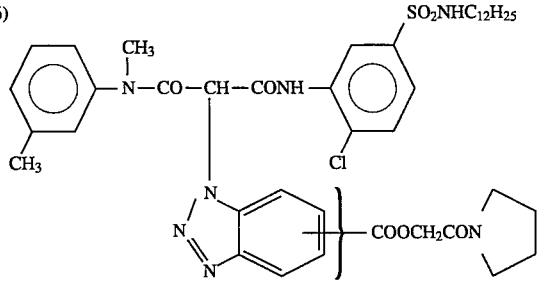
(D-18)
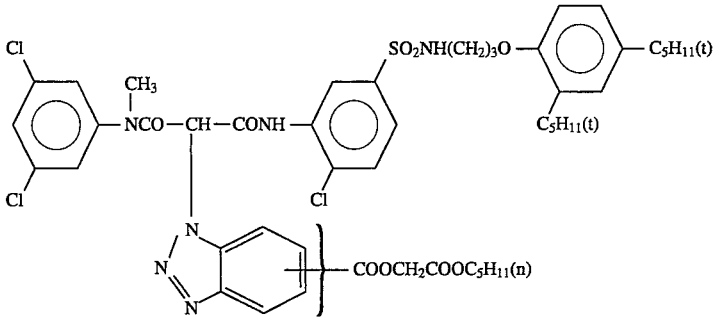
(D-19)
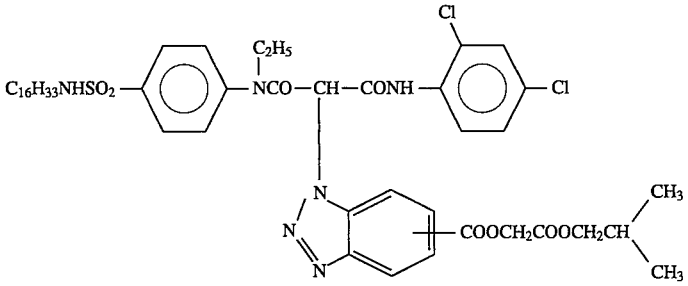
(D-20)
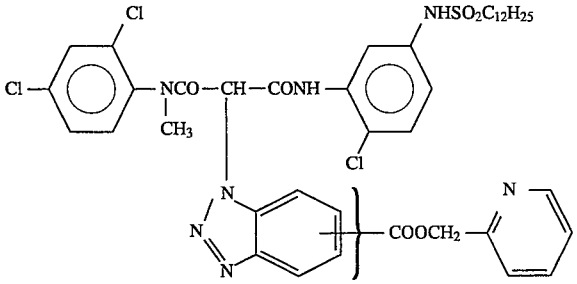

-continued
Illustrative Compounds
(D-21)
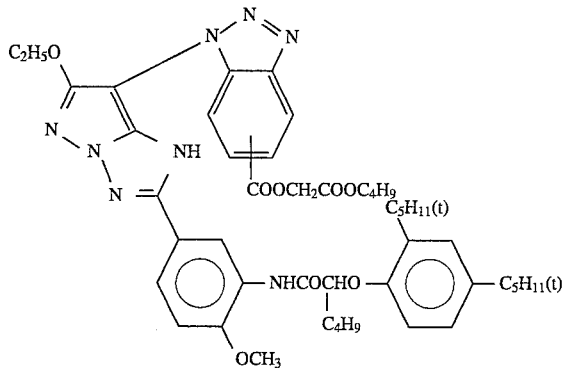
(D-22)
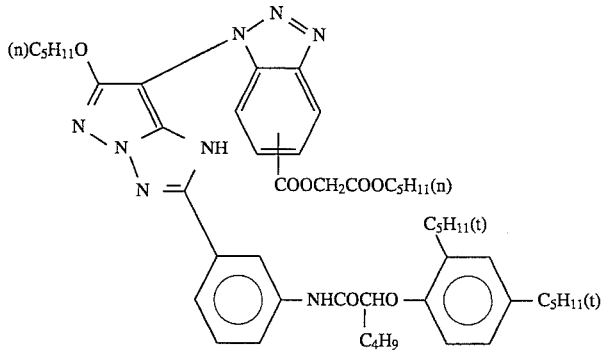
(D-23)
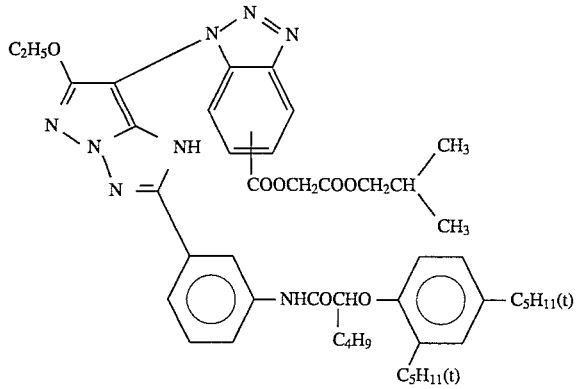
(D-24)
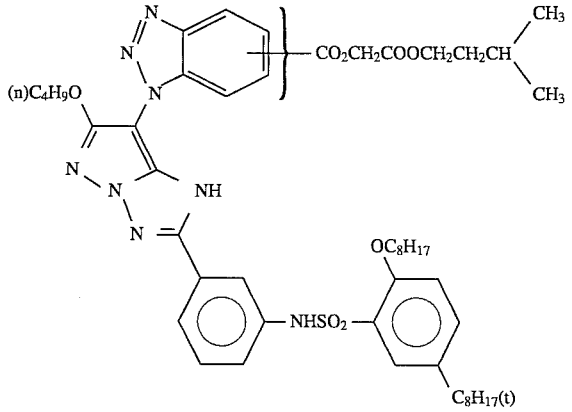

-continued
Illustrative Compounds
(D-25)
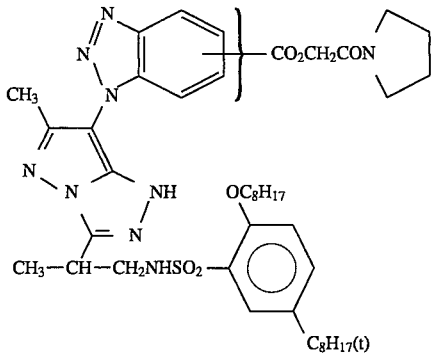
(D-26)
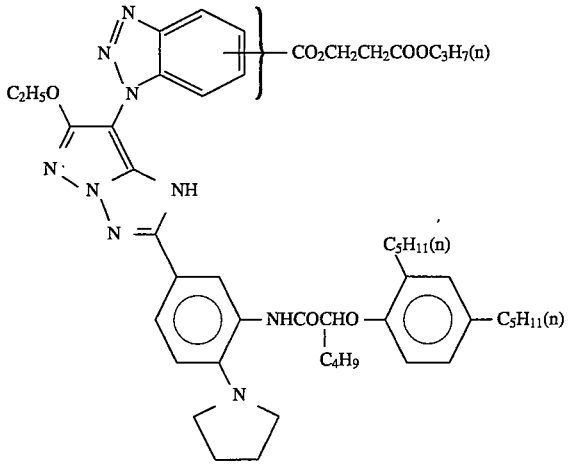
(D-27)
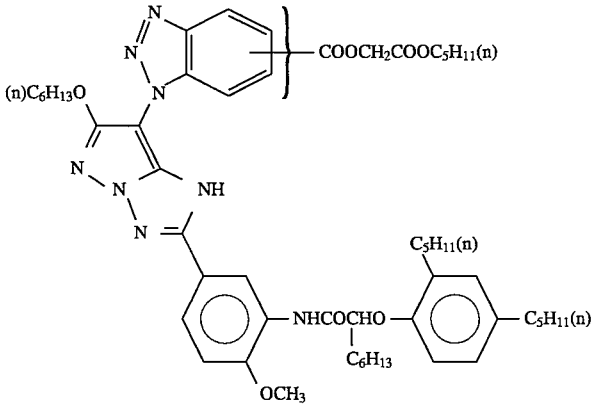
(D-28)
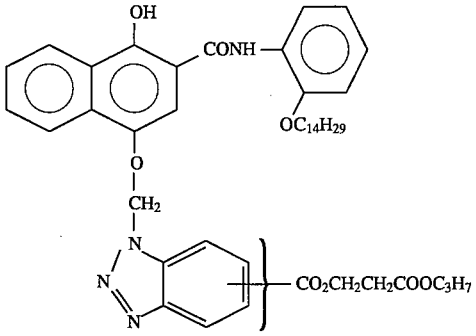
(D-29)
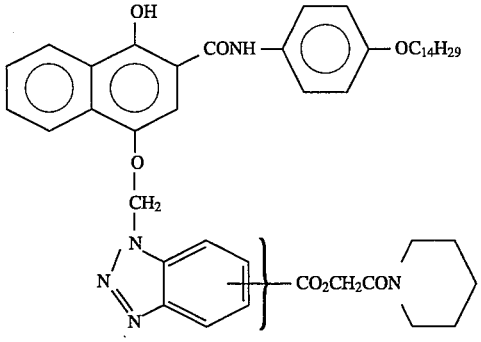

-continued
Illustrative Compounds
(D-30)
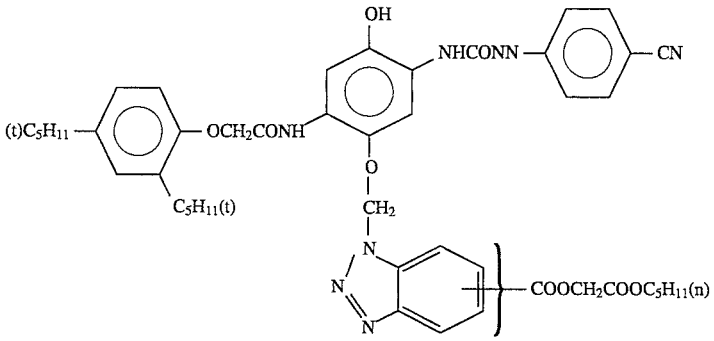
(D-31)
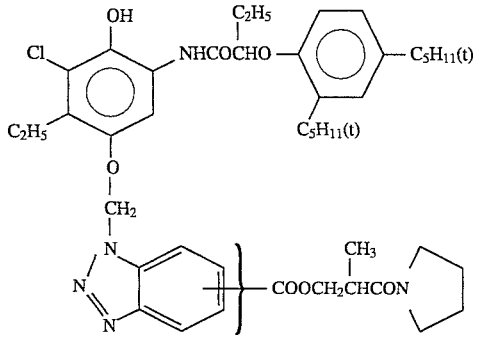
(D-32)
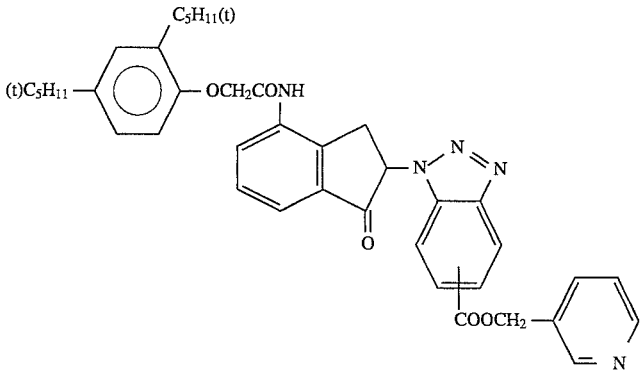
(D-33)
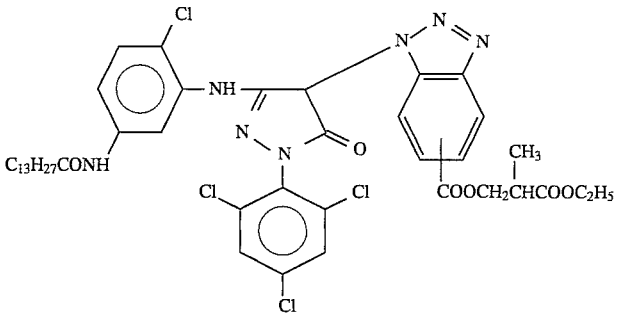

-continued
Illustrative Compounds
(D-34)
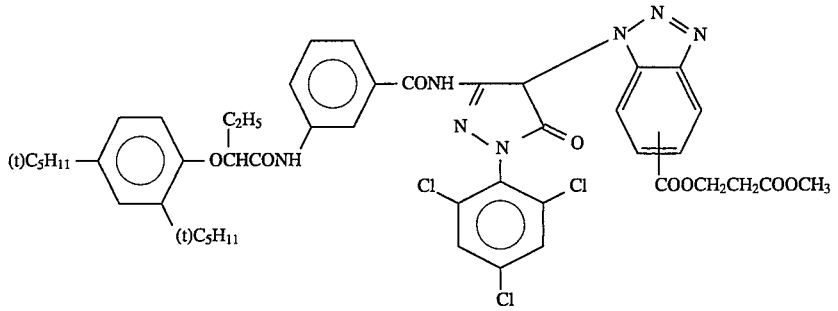
(D-35)
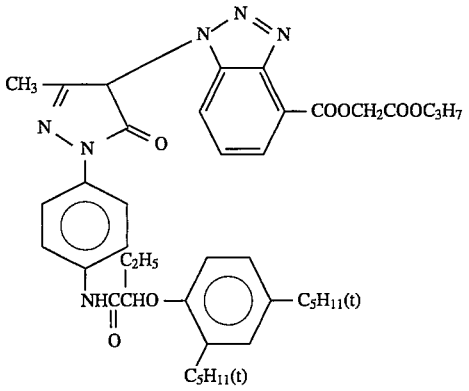
(D-36)
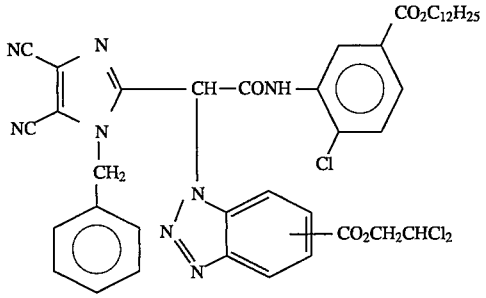
(D-37)
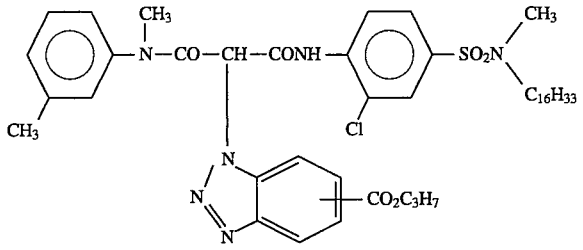
(D-38)
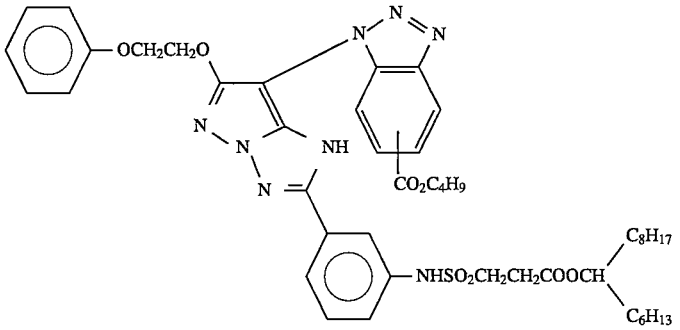
(D-39)
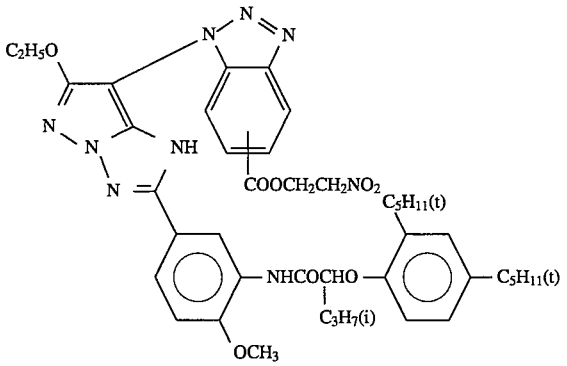

EXAMPLE OF SYNTHESIS 1

(THE PREPARATION OF ILLUSTRATIVE COMPOUND (D-1)

Illustrative compound (D-1) was prepared via the route indicated below.

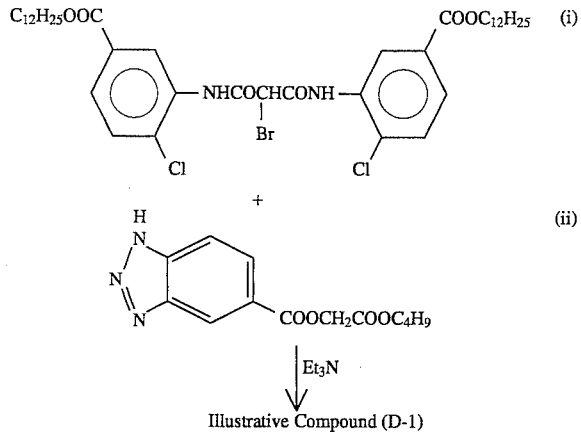

Compound (ii) (13.5 grams) and 4.9 grams of triethylamine were added to 200 ml of N,N-dimethylformamide and the mixture was stirred for 15 minutes at room temperature. Next, 20 grams of compound (i) was added to the solution and the mixture was stirred for 3 hours at room temperature. Next, 500 ml of ethyl acetate was added to the reaction mixture and the mixture was transferred to a separating funnel and washed with water. The oil layer was recovered and washed with dilute hydrochloric acid and with water. The oil layer was recovered and the solvent was distilled off under reduced pressure. The residue was added to 100 ml of a mixed ethyl acetate/hexane solution, the crystals which precipitated out were recovered by filtration and 15.3 grams of the illustrative compound (D-10) was obtained.

EXAMPLE OF SYNTHESIS 2

(THE PREPARATION OF ILLUSTRATIVE COMPOUND D-6)

The preparation was carried out in accordance with the reaction scheme indicated below.

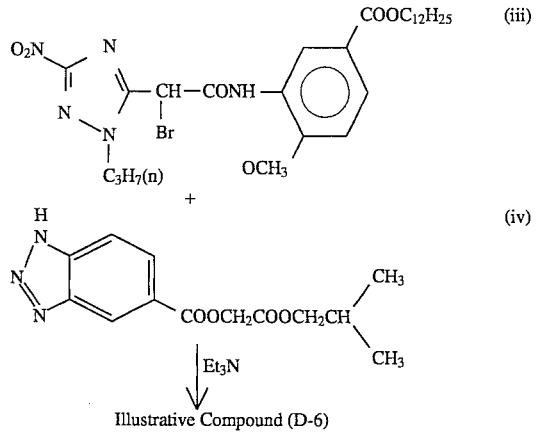

The reaction was carried out in the same way as described in the example of synthesis 1. However, an equal amount of compound (iv) was used instead of the compound (ii) used in the example of synthesis 1, and 14.8 grams of compound (iii) was used instead of compound (i). Furthermore, the target compound, illustrative compound (D-6), was recrystallized using a mixed isopropanol/ hexane solvent, and 8.5 grams was obtained.

EXAMPLE OF SYNTHESIS 3

(THE PREPARATION OF ILLUSTRATIVE COMPOUND (D-8).

The preparation was carried out in accordance with the reaction scheme indicated below.

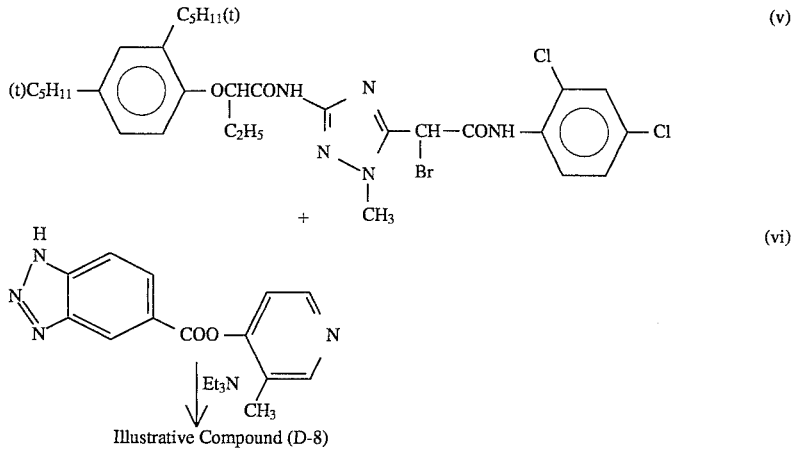

The reaction was carried out in the same way as described in the example of synthesis 1. However, 16.5 grams of compound (v) was used instead of the compound (i) used in the example of synthesis 1, and 12.3 grams of compound (vi)

was used instead of compound (ii). Furthermore, the target compound, illustrative compound (D-8), was recrystallized using a mixed ethyl acetate/ hexane solvent, and 9.8 grams was obtained.

EXAMPLE OF SYNTHESIS 4

(THE PREPARATION OF ILLUSTRATIVE COMPOUND ( D-9 )

The preparation was carried out in accordance with the reaction scheme indicated below.

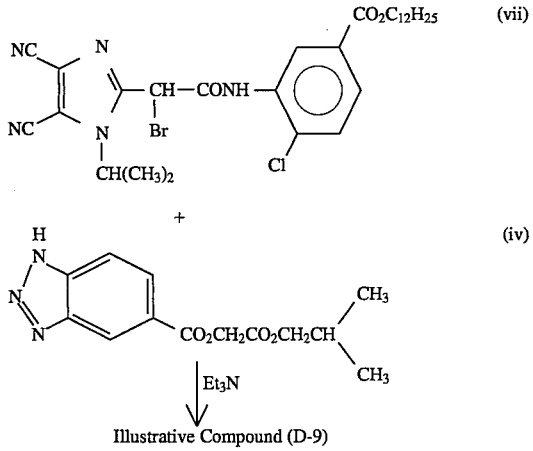

The reaction was carried out in the same way as described in the example of synthesis 1. However, 15.0 grams of compound (vii) was used instead of the compound (i) used in example of synthesis 1. The target compound, illustrative compound (D-9), was obtained in an amount of 12.1 grams in the same way as before.

EXAMPLE OF SYNTHESIS 5

(THE PREPARATION OF ILLUSTRATIVE COMPOUND ( D-17 ).

The preparation was carried out in accordance with the reaction scheme indicated below.

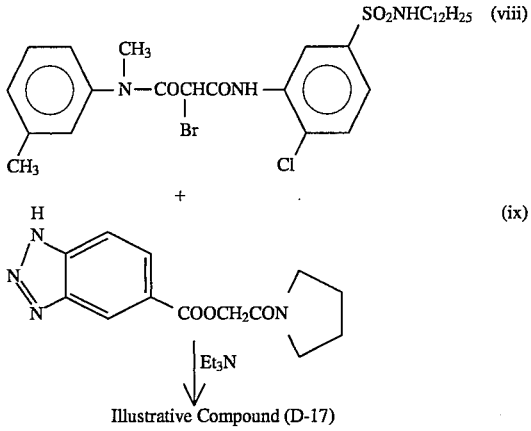

Compound (ix) (17.1 grams) and 6.3 grams of triethylamine were added to 200 ml of N,N-dimethylacetamide and stirred for 15 minutes. A solution obtained by dissolving 20 grams of compound (viii) in 100 ml of chloroform was added dropwise to this solution at room temperature over a period of 20 minutes. The mixture was reacted at room temperature for 3 hours and then at 40° C. for 30 minutes. The target compound, illustrative compound (D-17), was recrystallized using a mixed ethyl acetate/hexane solvent, and 15.3 grams was obtained.

EXAMPLE OF SYNTHESIS 6

(THE PREPARATION OF ILLUSTRATIVE COMPOUND (D723)

The preparation was carried out in accordance with the reaction scheme indicated below.

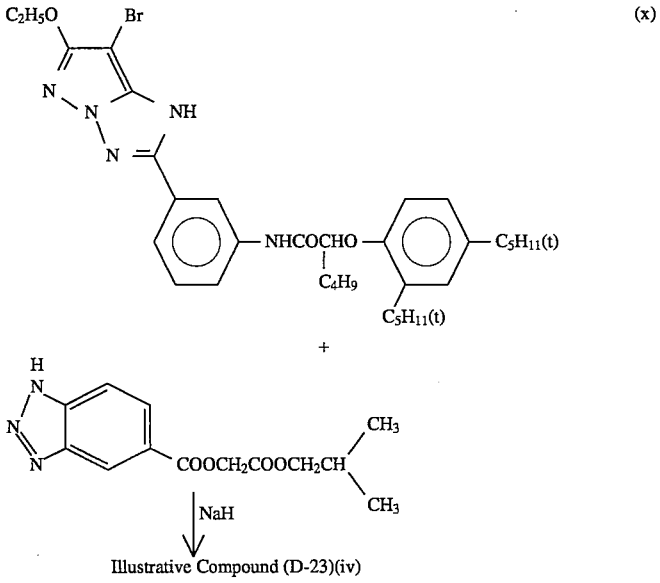

Compound (iv) (25.5 grams) was dissolved in 100 ml of N,N'-dimethyl-2-imidazolidinone and cooled in ice. Sodium hydrazide (a 60% dispersion in oil, 3.7 grams) was added to this solution and the mixture was stirred for 20 minutes. Compound (x) (20 grams) was then added to the solution and the mixture was stirred for 5 hours at room temperature.

The mixture was then heated to 50° C. and stirred for 1 hour and 30 minutes. Next, the mixture's temperature was allowed to returned to room temperature and 200 ml of ethyl acetate and 200 ml of water were added to the mixture, and the mixture was then transferred to a separating funnel. The oil layer was recovered and washed with water, with dilute hydrochloric acid and again with water. The oil layer was again recovered and the solvent was removed by distillation under reduced pressure. Ethyl acetate and hexane were added to the residue and on recovering by filtration, crystals precipitated out to give 15.5 grams of illustrative compound (D-23).

The couplers represented by general formula (I) of the present invention may be used in any layer in a photosensitive material, but they are preferably added to photosensitive silver halide emulsion layers and/or layers adjacent thereto. Most desirably they are added to photosensitive silver halide emulsion layers, and in cases where there are two or more layers of the same color sensitivity which contain emulsion grains of the present invention which have different photographic speeds, they are most desirably added to the layer which does not have the highest photographic speed.

The total amount of these couplers which is added to the photosensitive material is generally from $3\times10^{-7}$ to $1\times10^{-3}$ mol/m$^2$, preferably from $3\times10^{-6}$ to $5\times10^{-4}$ mol/m$^2$, and most desirably from $1\times10^{-5}$ to $2\times10^{-4}$ mol/m$^2$.

The couplers represented by general formula (I) of the present invention can be added to the photosensitive material in the same way as the normal couplers as described hereinafter.

The compounds represented by general formula (R-I) are described below.

$$A\text{-}(L_1)_v\text{-}B\text{-})L_2)_w\text{-}INH\text{-}HYD \qquad \text{General Formula (R-I)}$$

In this formula, A represents a group which cleaves $(L_1)_v$-B-$(L_2)_w$-INH-HYD, $L_1$ represents a linking group which cleaves the bond with B after the bond with A has been cleaved, B represents a group which reacts with the oxidized form of a developing agent and cleaves $(L_2)_w$-INH-HYD, $L_2$ represents a group which cleaves INH-HYD after the bond with B has been cleaved, INH represents a group which has a development inhibiting function, HYD represents an alkoxycarbonyl group or a group which contains a hydroxycarbonyl group, v and w each represent an integer of value from 0 to 2 and may be the same or different, and when they each have a value of 2 the $L_1$ groups and $L_2$ groups may each be the same or different.

The compounds represented by general formula (R-I) cleave the INH-HYD moiety via the reaction scheme indicated below during development.

$$(A)-(L_1)_v-B-(L_2)_w-INH-HYD \xrightarrow{QDI}$$

$$(L_1)_v-B-(L_2)_w-INH-HYD \xrightarrow{QDI}$$

$$B-(L_2)_w-INH-HYD \xrightarrow{QDI}$$

$$(L_2)_w-INH-HYD \longrightarrow INH-HYD$$

In the above equations. A, $L_1$, v, B, $L_2$, w, INH and HYD have the same meanings as those described in connection with general formula (R-I), and QDI represents the oxidized form of a developing agent.

In more detail, A in general formula (R-I) is a coupler residual group for use in color development, or a residual group which can undergo oxidation/reduction and which can reduce the oxidation products of the developing agents which are present during development by cleavage during development.

Known coupler residual groups can be used as A when A represents a coupler residual group. For example, A may represent a yellow coupler residual group (e.g., of the open chain ketomethylene type), a magenta coupler residual group (e.g., of the 5-pyrazolone type, pyrazoloimidazole type or pyrazolotriazole type), a cyan coupler residual group (e.g., of the phenol type or naphthol type) or a non-color forming coupler residual group (e.g., of the indanone type or acetophenone type). Furthermore, it may be a coupler residual group of the heterocyclic type disclosed in U.S. Pa. Nos. 4,315,070, 4,183,752, 3,961,959 or 4,171,223.

Preferred examples when A in general formula (R-I) represents a coupler residual group are those which can be represented by the general formulae (Cp-1), (Cp-2), (Cp-3), (Cp-4), (Cp-5), (Cp-6), (Cp-7), (Cp-8), (Cp-9) or (Cp-10). These couplers have a high coupling rate.

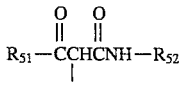

General Formula (Cp-1)

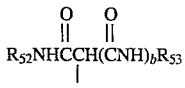

General Formula (Cp-2)

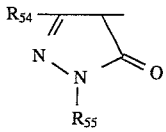

General Formula (Cp-3)

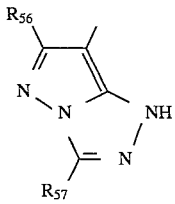

General Formula (Cp-4)

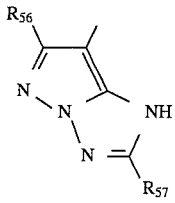

General Formula (Cp-5)

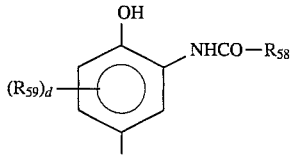

General Formula (Cp-6)

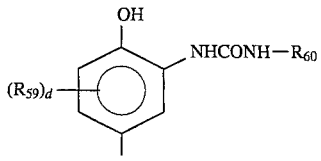

General Formula (Cp-7)

-continued

General Formula (Cp-8)

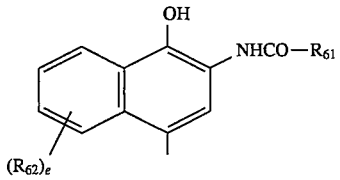

General Formula (Cp-9)

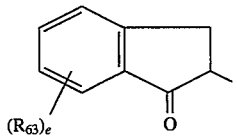

General Formula (Cp-10)

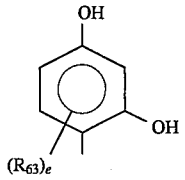

In these formulae, the free bond originating from the coupling position represents the location of the bond with the coupling leaving group.

In those case where $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$ or $R_{63}$ in these formulae contain a nondiffusible group, the same is selected in such a way that the total number of carbon atoms is from 8 to 40, and preferably from 10 to 30, and in other cases the total number of carbon atoms is preferably not more than 15. In the case of bis, telomeric or polymeric type couplers, any of the above mentioned substituent groups represents a divalent group and links together the repeating units. In this case, the range for the number of carbon atoms may be outside that specified above.

$R_{51}$–$R_{63}$, b, d and e are described in detail below.

$R_{41}$ is an aliphatic group, an aromatic group or a heterocyclic group, $R_{42}$ represents an aromatic group or a heterocyclic group; and $R_{43}$, $R_{44}$ and $R_{45}$, same or different, represent hydrogen atoms, aliphatic groups, aromatic groups or heterocyclic groups.

$R_{51}$ represents a group of the same significance as $R_{41}$; b represents 0 or 1; $R_{52}$ and $R_{53}$ each represent groups of the same significance as $R_{42}$; $R_{54}$ represents a group which has the same significance as $R_{41}$, or represents an

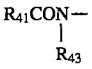

group, an

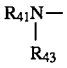

group, an

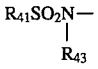

group, an $R_{41}S$— group, an $R_{43}O$— group, an

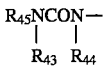

group or an N≡C— group. $R_{55}$ represents a group which has the same significance as $R_{41}$. $R_{56}$ and $R_{57}$ each represent a group which has the same significance as $R_{43}$, or represents an $R_{41}S$— group, an $R_{43}O$— group, an

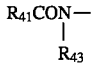

group or an

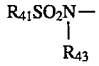

group. $R_{58}$ represents a group which has the significance as $R_{41}$. $R_{59}$ represents a group which has the same significance as $R_{41}$, or represents an

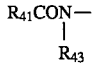

group, an

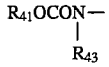

group, an

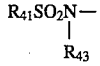

group, an

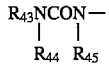

group, an $R_{41}O$— group, an $R_{41}S$— group, a halogen atom or an

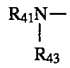

group. Moreover, d represents from 0 to 3. When d is 2 or 3, the $R_{59}$ substituent groups may be the same or different. Furthermore, the $R_{59}$ groups may be divalent groups which are joined together to form ring structures. Typical examples of divalent groups which form ring structures include the group

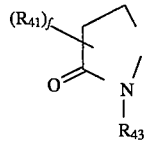

and the group

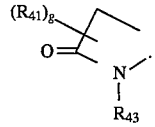

In the above formulae, f represents an integer of value from 0 to 4 and g represents an integer of value from 0 to 2; $R_{60}$ represents a group which has the same significance as $R_{41}$; $R_{61}$ represents a group which has the same significance as $R_{41}$, and $R_{62}$ represents a group which has the same significance as $R_{41}$, or represents an $R_{41}OCONH$— group, an $R_{41}SO_2NH$— group, an $R_{43}NCON-$ ($R_{44}$, $R_{45}$)

group, an $R_{43}NSO_2N-$ ($R_{44}$, $R_{45}$)

group, an $R_{43}O$— group, an $R_{41}S$— group, a halogen atom or an $R_{41}N-$ ($R_{43}$)

group. $R_{63}$ represents a a group which has the same significance as $R_{41}$, or represents an $R_{43}NCON-$ ($R_{44}$, $R_{45}$)

group, an $R_{43}NCO-$ ($R_{44}$)

group, an $R_{41}SO_2N-$ ($R_{44}$)

group, an $R_{43}NSO_2-$ ($R_{44}$)

group, an $R_{41}SO_2$— group, an $R_{43}OCO$— group, an $R_{43}$—$SO_2$— group, a halogen atom, a nitro group, a cyano group or an $R_{43}CO$— group. Moreover, e represents an integer of value from 0 to 4. When there is a plurality of $R_{62}$ or $R_{63}$ groups, these may each be the same or different groups.

The aliphatic groups represented by $R_{41}$, $R_{43}$ and $R_{44}$ mentioned above are saturated or unsaturated, chain like or cyclic, linear chain or branched, substituted or unsubstituted, aliphatic hydrocarbyl groups which have from 1 to 32, and preferably from 1 to 22, carbon atoms. Typical examples include methyl, ethyl, propyl, isopropyl, butyl, tert-butyl, iso-butyl, tert-amyl, hexyl, cyclohexyl, 2-ethylhexyl, octyl, 1,1,3,3-tetramethylbutyl, decyl, dodecyl, hexadecyl and octadecyl.

The aromatic groups represented by $R_{41}$–$R_{45}$ are substituted or unsubstituted phenyl groups which preferably have from 6 to 20 carbon atoms, or substituted or unsubstituted naphthyl groups.

The heterocyclic groups represented by $R_{41}$–$R_{45}$ are preferably three to eight membered substituted or unsubstituted heterocyclic groups which have from 1 to 20, and preferably from 1 to 7, carbon atoms and in which the hetero atoms are selected from among nitrogen, oxygen and sulfur atoms. Typical examples of heterocyclic groups include 2-pyridyl, 2-thienyl, 2-furyl, 1,3,4-thiadiazol-2-yl, 2,4-dioxo-l,3-imidazolidin-5-yl, 1,2,4-triazol-2-yl and 1-pyrazolyl.

Typical substituent groups in those cases where the aforementioned aliphatic groups, aromatic groups and heterocyclic groups have substituent groups include halogen atoms, $R_{47}O$— groups, $R_{46}S$— groups, $R_{47}CON-$ ($R_{48}$)

groups, $R_{47}NCO-$ ($R_{48}$)

groups, $R_{46}OCON-$ ($R_{47}$)

groups, $R_{46}SO_2N-$ ($R_{47}$)

groups, $R_{47}NSO_2-$ ($R_{48}$)

groups, $R_{46}SO_2$— groups, $R_{47}OCO$— groups, $R_{47}NCON-$ ($R_{48}$, $R_{49}$)

groups, groups which have the same significance as $R_{46}$,

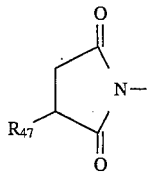

groups, $R_{46}COO$— groups, $R_{47}OSO_2$— groups, cyano groups and nitro groups. Here, $R_{46}$ represents an aliphatic group, an aromatic group or a heterocyclic group; and $R_{47}$, $R_{48}$ and $R_{49}$, same or different, each represent an aliphatic group, an aromatic group, a heterocyclic group or a hydrogen atom. The meaning of the aliphatic groups, aromatic groups and heterocyclic groups is the same as that defined earlier.

The preferred ranges for $R_{51}$–$R_{63}$, d and e are described below.

$R_{51}$ is preferably an aliphatic group or an aromatic group. $R_{52}$, $R_{53}$ and $R_{55}$ are preferably aromatic groups. $R_{54}$ is preferably an $R_{41}CONH$— group or an $R_{41}-N-$ ($R_{43}$)

group. $R_{56}$ and $R_{57}$ are preferably aliphatic groups, aromatic groups, $R_{41}O$— groups or $R_{41}S$— groups. $R_{58}$is preferably an aliphatic group or an aromatic group. In general formula (Cp-6), $R_{59}$ is preferably a chlorine atom, an aliphatic group or an $R_{41}CONH$— group; and moreover, d is preferably 1 or 2. $R_{60}$ is preferably an aromatic group. In general formula (Cp-7), $R_{59}$ is preferably an $R_{41}CONH$— group. In general formula (Cp-7), d is preferably 1. $R_{61}$ is preferably an aliphatic group or an aromatic group. In general formula (Cp-8), e is preferably 0 or 1. $R_{62}$ is preferably an $R_{41}OCONH$— group, an $R_{41}CONH$— group or an $R_{41}SO_2NH$— group, and these are preferably substituted at the 5-position of the naphthol ring. In general formula (Cp-9), $R_{63}$ is preferably an $R_{41}CONH$— group, an $R_{41}SO_2NH$— group, an $$R_{41}\underset{\underset{R_{43}}{|}}{N}SO_2-$$

group, an $R_{41}SO_2$— group, an $$R_{41}\underset{\underset{R_{43}}{|}}{N}CO-$$

group, a nitro group or a cyano group.

In general formula (Cp-10), $R_{63}$ is preferably an $$R_{43}\underset{\underset{R_{43}}{|}}{N}CO-$$

group, an $R_{43}OCO$— group or an $R_{43}CO$— group.

When A in general formula (R-I) represents a group which can undergo oxidation/reduction, the general formula (R-I) can be represented precisely by the following Kendall-Pelz formula (R-II).

$$A_1\text{-}P\text{—}(X{=}Y)_n\text{—}Q\text{-}A_2 \qquad \text{(R-II)}$$

In formula (R-II), P and Q each independently represent an oxygen atom or a substituted or unsubstituted imino group, and any one of the n individual X and Y groups represents a methine group which has $\text{-}(L_1)v\text{-}B\text{-}(L_2)_w\text{-}INH\text{-}HYD$ as a substituent group and the other X and Y groups present represent substituted or unsubstituted methine groups or nitrogen atoms, n represents an integer having a value of from 1 to 3 (the n individual X groups and the n individual Y groups may each be the same or different), and $A_1$ and $A_2$ each represent a hydrogen atom or a group which can be removed by means of an alkali. Cases in which any two of the substituent groups P, X, Y, Q, $A_1$ and $A_2$ are divalent and joined together to form a ring are also included. For example, $(X{=}Y)_n$ may form a benzene ring or a pyridine ring. In those cases in which P and Q represent substituted or unsubstituted imino groups, they are preferably imino groups which are substituted with sulfonyl groups or acyl groups.

In such cases, P and Q can be represented in the following way:

$$*\text{—}\underset{\underset{SO_2-G}{|}}{N}\text{—}** \qquad \text{General Formula (N-1)}$$

$$*\text{—}\underset{\underset{CO-G}{|}}{N}\text{—}** \qquad \text{General Formula (N-2)}$$

Here, * indicates the position which is bonded to $A_1$ or $A_2$, and ** indicates the position which is bonded to one of the free bonds of $\text{—}(X{=}Y)_n\text{—}$.

The group represented by G in these formulae is preferably a chain like or cyclic, linear chain or branched, saturated or unsaturated, substituted or unsubstituted, aliphatic group which has from 1 to 32, and preferably from 1 to 22, carbon atoms (for example, methyl, ethyl, benzyl, phenoxybutyl, iso-propyl), a substituted or unsubstituted aromatic group which has from 6 to 10 carbon atoms (for example, phenyl, 4-methylphenyl, 1-naphthyl, 4-dodecyloxyphenyl), a four to seven membered heterocyclic group in which the hetero atoms are selected from among nitrogen, sulfur and oxygen atoms (for example, 1-phenyl-4-imidazolyl, 2-furyl, benzothienyl) or —O—G' (where G' has the same meaning as G).

P and Q in general formula (R-II) preferably each independently represent an oxygen atom or a group which can be represented by general formula (N-1).

In those cases where $A_1$ and $A_2$ represent groups which can be removed with alkali (referred to hereinafter as precursors), they are preferably groups of the type which can be hydrolyzed, for example acyl, alkoxycarbonyl, aryloxycarbonyl, carbamoyl, imidoyl, oxazolyl or sulfonyl groups, precursor groups of the type with which a reverse Michael reaction is used as disclosed in U.S. Pat. No. 4,009,029, precursor groups of the type with which an anion which has been formed after a ring opening reaction is used as an intramolecular nucleophilic group as disclosed in U.S. Pat. No. 4,310,612, precursor groups with which electron transfer takes place with an anion along a conjugated system and a cleavage reaction occurs as a result of this as disclosed in U.S. Pat. Nos. 3,674,478, 3,932,480 or 3,993,661, precursor groups with which a cleavage reaction occurs by means of the electron transfer of an anion which has reacted after ring opening as disclosed in U.S. Pat. No. 4,335,200, or precursor groups with which an imidomethyl group is used as disclosed in U.S. Pat. Nos. 4,363,865 and 4,410,618.

P preferably represents an oxygen atom and $A_2$ preferably represents a hydrogen atom in general formula (R-II).

It is more preferred that any one of the n individual X and Y groups represents a methine group which has $\text{-}(L_1)_v\text{-}B\text{-}(L_2)_w\text{-}INH\text{-}HYD$ as a substituent group and the other X and Y groups represent substituted or unsubstituted methine groups.

Among the compounds represented by the general formula (R-II), those which are represented by general formula (R-III) or general formula (R-IV) indicated below are especially desirable.

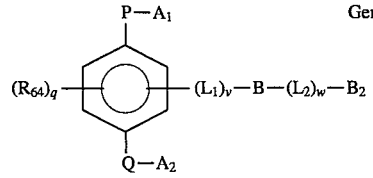

General Formula (R-III)

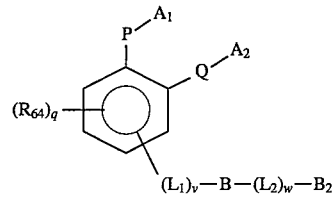

General Formula (IV)

In these formulae, P, Q, $A_1$ and $A_2$ have the same significance as described in connection with general formula (R-II), $R_{64}$ represents a substituent group, and q represents an integer of value from 0 to 3. When q has a value of 2 or more, the two or more $R_{64}$ groups may be the same or different, and in cases in which where there are two $R_{64}$ groups substituted on adjacent carbon atoms, there are also included as $R_{64}$ groups divalent groups which join together and form a ring structure. Such a ring structure may be a benzene condensed ring structure such as a naphthalene, a benzonorbornane, a chroman, a benzothiophene, a benzofuran, a 2,3-dihydrobenzofuran or an indene ring structure, and these may have one or more substituent groups thereon. The preferred substituent groups in those cases where such condensed rings have substituent groups, and preferred examples of $R_{64}$ when the $R_{64}$ groups do not form condensed rings, are indicated below.

The preferred substituent groups are $R_{41}$, halogen atom, $R_{43}O$—, $R_{43}S$—, $R_{43}(R_{44})NCO$—, $R_{43}OOC$—, $R_{43}SO_2$—, $R_{43}(R_{44})NSO_2$—, $R_{43}CON(R_{43})$—, $R_{41}SO_2N(R_{43})$—, $R_{43}CO$—, $R_{41}COO$—, $R_{41}SO$—, nitro, $R_{43}(R_{44})NCON(R_{45})$—, cyano, $R_{41}OCON(R_{43})$—, $R_{43}OSO_2$—, $R_{43}(R_{44})N$—, $R_{43}(R_{44})NSO_2N(R_{45})$—,

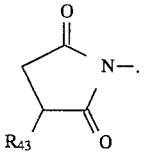

Here, $R_{41}$, $R_{43}$ ad $R_{45}$ have the same significance as before.

$A_1$ and $A_2$ preferably represent hydrogen atoms in general formulae (R-III) and (R-IV).

Those cases in which A represents a coupler residual group for color development purposes are preferred for general formula (R-I).

The groups represented by $L_1$ and $L_2$ in general formula (R-I) may or may not be used in the present invention, since they are selected appropriately according to the intended purpose. In those cases where groups represented by $L_1$ and $L_2$ are used, they may take the form of the known linking groups indicated below. In the formulae below, * indicates boding with A and ** indicates bonding with B, or * indicates bonding with B and ** indicates bonding with INH-HYD respectively.

(1) Groups with which a Hemi-acetal Cleavage Reaction is Used.

The groups disclosed, for example, in U.S. Pat. No. 4,146,396, JP-A-60-249148 and JP-A-60-249149, and the groups represented by the general formula indicated below.

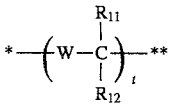

General Formula (T-1)

In this formula, W represents an oxygen atom, a sulfur atom or an

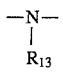

group, $R_{11}$ and $R_{12}$ represent hydrogen atoms or substituent groups, $R_{13}$ represents a substituent group and t represents 1 or 2. When t is 2 the two

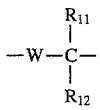

groups may be the same or different. Typical examples of $R_{11}$ and $R_{12}$, when they represent substituent groups, and $R_{13}$, include $R_{15}$, $R_{15}CO$—, $R_{15}SO_2$—,

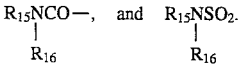

Here, $R_{15}$ represents an aliphatic group, an aromatic group or a heterocyclic group, and $R_{16}$ represents a hydrogen atom, an aliphatic group, an aromatic group or a heterocyclic group. Those cases wherein $R_{11}$, $R_{12}$ and $R_{13}$ respectively represent divalent groups which are joined together to form a ring structure are also included. Actual examples of groups represented by the general formula (T-1) are indicated below.

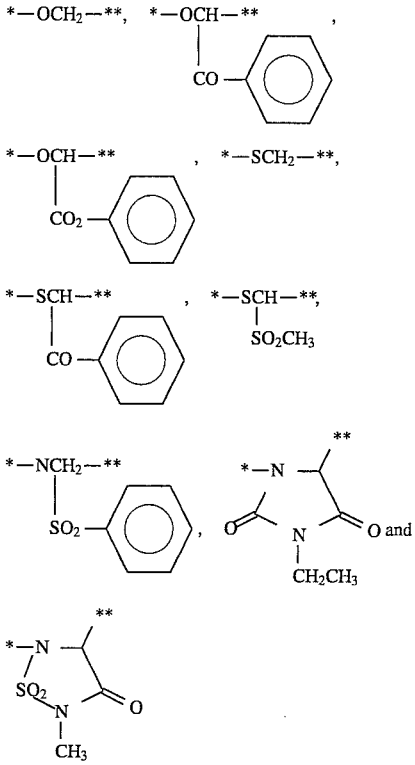

(2) Groups with which a Cleavage Reaction Occurs via an Intramolecular Nucleophilic Substitution Reaction.

For example, the timing groups disclosed in U.S. Pat. No. 4,248,292. These can be represented by the following general formula:

*-Nu-Link-E-** General Formula (T-2)

In this formula, Nu represents a nucleophilic group, wherein oxygen and sulfur atoms are examples of nucleophilic species, E represents an electrophilic group, being a group which is subjected to nucleophilic attack by Nu and with which the bond marked ** can be cleaved, and Link is a linking group which enables Nu and E to have a steric arrangement such that an intramolecular nucleophilic substitution reaction can occur. Actual examples of groups represented by general formula (T-2) are indicated below.

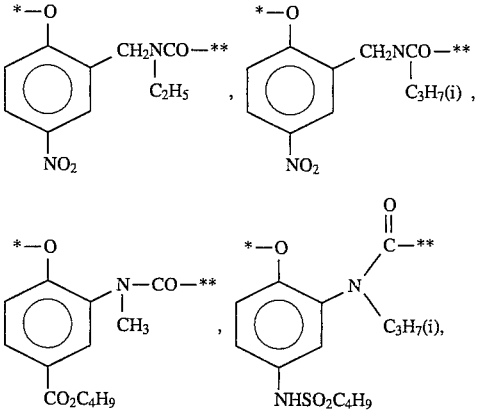

-continued

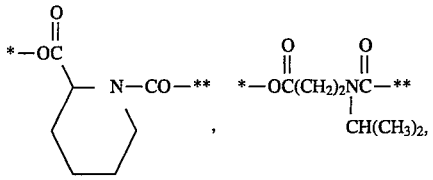

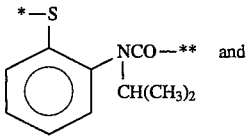

and

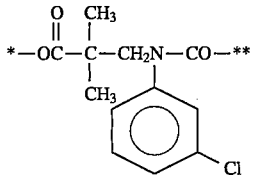

(3) Groups in which a Cleavage Reaction Occurs via an Electron Transfer Reaction along a Conjugated System.

For example, those disclosed in U.S. Pat. Nos. 4,409,323 and 4,421,845, JP-A-57-188035, JP-A-58-98728, JP-A-58-209736, JP-A-58-209737 and JP-A-58-209738, and the groups represented by the general formula (T-3).

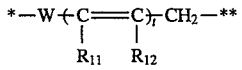

General Formula (T-3)

In this formula, *, **, W, $R_{11}$, $R_{12}$ and t all have the same meaning as described in connection with (T-1). However, $R_{11}$ and $R_{12}$ may be joined together to form a benzene ring or a structural element of a heterocyclic ring. Actual examples of these groups are indicated below.

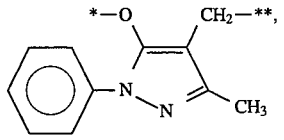

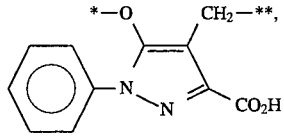

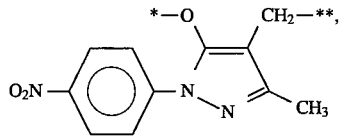

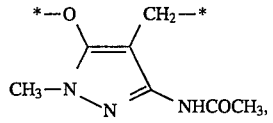

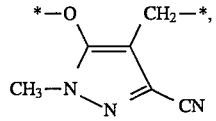

-continued

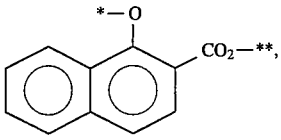

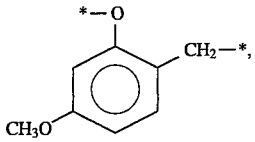

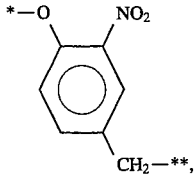

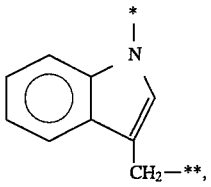

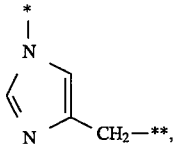

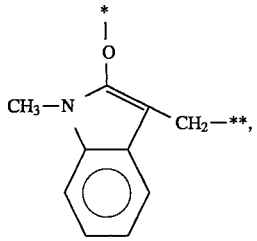

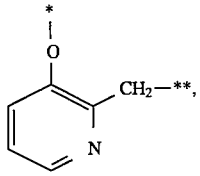

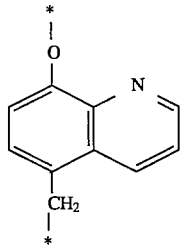

and

-continued

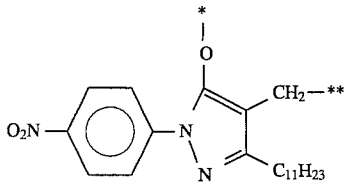

(4) Groups with which a Cleavage Reaction due to Ester Hydrolysis is Used.

For example, the linking groups disclosed in West German Patent laid open 2,626,315, and the groups indicated below. In these formulae, * and ** have the same meaning as described in connection with general formula (T-1).

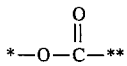

General Formula (T-4)

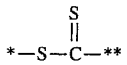

General Formula (T-5)

(5) Groups with which an Iminoketal Cleavage Reaction is Used.

For example, the linking groups disclosed in U.S. Pat. No. 4,546,073, and the groups represented by the general formula indicated below.

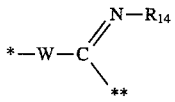

General Formula (T-6)

In this formula, *, ** and W have the same meaning as described in connection with general formula (T-1) and $R_{14}$ has the same meaning as $R_{13}$. Actual examples of groups represented by general formula (T-6) are indicated below.

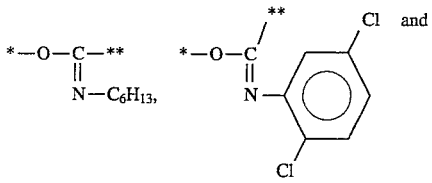

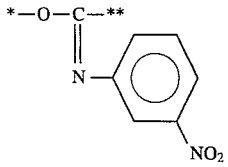

The groups represented by B in general formula (R-I) are preferably groups which can undergo oxidation and reduction and which can reduce the oxidized form of a developing agent, or are groups which undergo a coupling reaction with the oxidized form of a developing agent and produce essentially colorless compounds.

When the group represented by B is a group which can reduce the oxidized form of a developing agent it is preferably a group which can be represented by the general formula (R-V) indicated below.

$$*\text{-}P'\text{—}(X'\text{=}Y')_n\text{—}Q'\text{-}A_2' \qquad \text{General Formula (R-V)}$$

In this formula, * indicates the position which is bonded on the left hand side in general formula (R-1) and $A_2'$, P', Q' and n' have the same respective meanings as $A_2$, P, Q and n described in connection with general formula (R-II). However, any one of the n' X' groups and n' Y' groups is a methine group which has $(L_2)_w$-INH-HYD as a substituent group, and the other X' and Y' groups represent substituted or unsubstituted methine groups or nitrogen atoms. Here, there are also included those cases in which any two substituent groups of $A_2'$, P', Q', X' and Y' are divalent groups wherein ring structures are formed. Such cyclic structures include, for example, a benzene ring, an imidazole ring and a pyridine ring.

In general formula (R-V), P' preferably represents an oxygen atom, and Q' preferably represents an oxygen atom or a group as indicated below. Here * represents the bond with $(X'\text{=}Y')_n$ and ** indicates the bond with $A_2$.

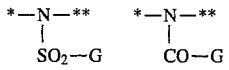

In these formulae, G has the same significance as described in connection with the aforementioned general formulae (N-1) and (N-2).

Q' is most desirably an oxygen atom or

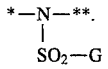

Typical examples of the group represented by B in general formula (R-I) are indicated below. Here, * indicates the position which is bonded to A-$(L_1)_v$ in general formula (R-I) and ** indicates the position to which $(L_2)_w$-INH-HYD is bonded.

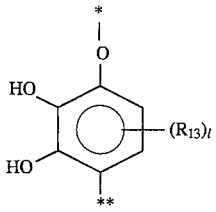

(B-1)

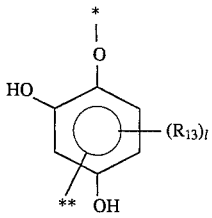

(B-2)

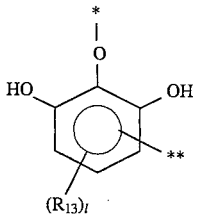

(B-3)

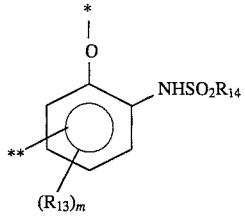

(B-4)

-continued (B-5)

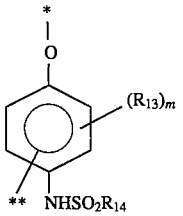

(B-6)

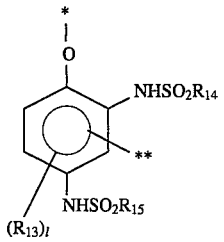

(B-7)

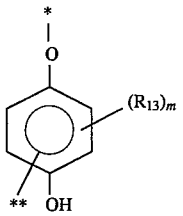

(B-8)

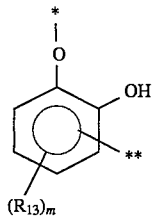

(B-9)

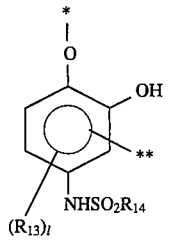

(B-10)

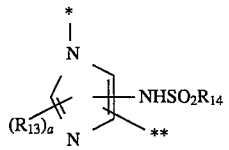

In these formulae, $R_{13}$ has the Same significance as $R_{64}$ described earlier, $R_{14}$ and $R_{15}$ each have the same significance as $R_{41}$ described earlier, l represents in integer of value from 0 to 2, m represents an integer of value from 0 to 3, and "a" represents an integer of value 0 or 1.

Actual examples of compounds in which B is eliminated and which exhibit a reducing action include the reducing agents disclosed, for example, in U.S. Pat. Nos. 4,741,994 and 4,477,560, JP-A-61-102646, JP-A-61-107245, JP-A-61-113060, JP-A-64-13547, JP-A-64-13548 or JP-A-64-73346.

When the group represented by B in general formula (R-I) is a group which undergoes a coupling reaction with the oxidized form of a developing agent and forms an essentially colorless compound it may be, for example, a phenol type or naphthol type coupler residual group, a pyrazolone type coupler residual group or an indanone type coupler residual group, and these are bonded with $A\text{-}(L_1)_v$ at an oxygen atom. The aforementioned coupler residual groups become couplers after elimination from $A\text{-}(L_1)_v$ and undergo a coupling reaction with the oxidized form of a developing agent. A colored dye is usually formed at this time, but if there are no nondiffusible groups and the diffusibility is suitably high, it is dissolved out into the processing baths during development processing, so that essentially none of the colored dye remains in the sensitive material. Alternatively, even if a colored dye is formed, if it is diffusible, then it reacts with an alkali component (for example, hydroxyl ion, sulfite ion) in the developer during development and is degraded and decolorized, so that essentially no dye remains in the sensitive material. Prefered as group B are those indicated below. In these formulae * indicates the position which is bonded to $A\text{-}(L_1)_v$ and ** indicates the position which is bonded to $(L_2)_w$-INH-HYD.

(B-23)

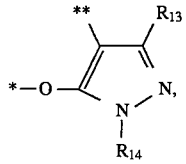

(B-21)

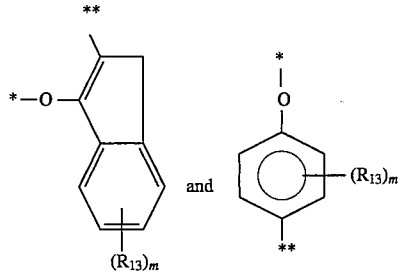

In these formulae, $R_{13}$, $R_{14}$ and m are defined in the same way as described earlier and $R_{16}$ has the same meaning as $R_{43}$ described earlier.

The group represented by B in general formula (R-I) is preferably a group which reduces the oxidized form of a developing agent after elimination from $A\text{-}(L_1)_v$.

Those cases where the compound represented by general formula (R-I) of the present invention is a polymer are also included. That is to say, polymers derived from monomeric compounds which can be represented by general formula (P-I) indicated below and which have a repeating unit which can be represented by general formula (P-II), and copolymers with one or more non-color forming monomer(s) which have at least one ethylenic group and which do not have the capacity to couple with the oxidized form of a primary aromatic amine developing agent are included. Here, two or more monomers may be polymerized simultaneously.

General Formula (P-I)

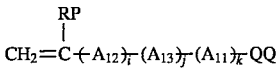

General Formula (P-II)

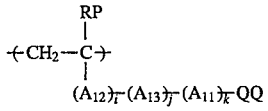

In these formulae, RR represents a hydrogen atom, a lower alkyl group which has from 1 to 4 carbon atoms or a chlorine atom, All represents —CONH—, —NHCONH—, —NHCOO—, —COO—, —$SO_2$—, —CO—, —NHCO—, —$SO_2$NH—, —NH$SO_2$—, —OCO—, —OCONH—, —NH— or —O—, $A_{12}$ represents —CONH— or —COO—, $A_{13}$ represents an unsubstituted or substituted alkylene group which has from 1 to 10 carbon atoms, an aralkylene group, or an unsubstituted or substituted arylene group, and the aralkylene group may have a linear chain or a branched chain.

QQ represents a compound residual group represented by general formula (R-I), and this may be bonded at any of the A, $L_1$, B and $L_2$ positions.

Moreover, i, j and k represent 0 or 1, but i, j and k are not all 0 at the same time.

Here, the substituent groups of the alkylene, aralkylene and arylene groups represented by $A_{13}$ may be aryl groups (for example, phenyl), nitro groups, hydroxyl groups, cyano groups, sulfo groups, alkoxy groups (for example, methoxy), aryloxy groups (for example, phenoxy), acyloxy groups (for example, acetoxy), acylamino groups (for example, acetylamino), sulfonamido groups (for example, methane-sulfonamido), sulfamoyl groups (for example methylsulfamoyl, halogen atoms (for example, fluorine, chlorine, bromine), carboxyl groups, carbamoyl groups (for example methylcarbamoyl), alkoxycarbonyl groups (for example, methoxycarbonyl) or sulfonyl groups (for example, methylsulfonyl) In those cases where there are two or more of these substituent groups, the groups may be the same or different.

The non-color forming ethylenic monomer which does not couple with the oxidation products of primary aromatic amine developing agents may be, for example, acrylic acid, α-chloroacrylic acid, α-alkylacrylic acid or an ester or amide derived from these acrylic acids, a methylene-bis-acrylamide, a vinyl ester, acrylonitrile, an aromatic vinyl compound, a maleic acid derivative or a vinylpyridine. Two or more of these non-color forming ethylenic unsaturated monomers can be used at the same time.

The group represented by INH in general formula (R-I) is a group which exhibits a development inhibiting action, and the groups which can be represented by the general formulae (INH-1) to (INH-12) indicated below are preferred.

(INH-1)

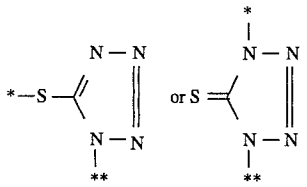

(INH-2)

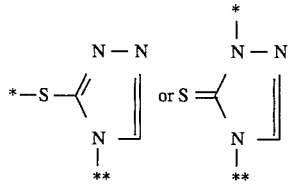

(INH-3)

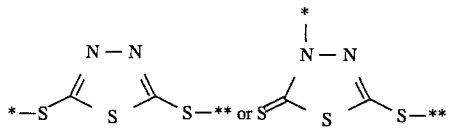

(INH-4)

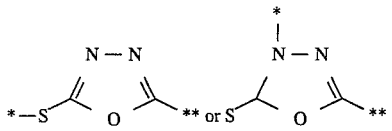

-continued (INH-5)

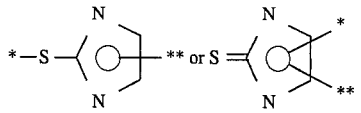

(INH-6)

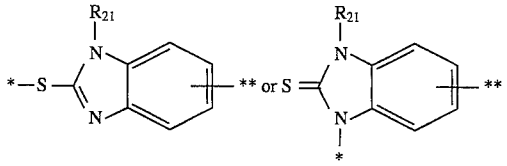

$R_{21}$ in these formulae represents a hydrogen atom or a substituted or unsubstituted hydrocarbyl group (for example, methyl, ethyl, propyl, phenyl).

(INH-7)

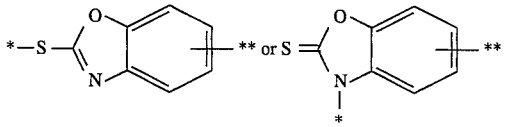

(INH-8)

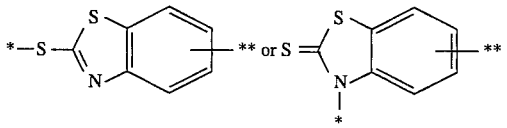

(INH-9)

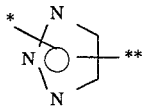

(INH-10)

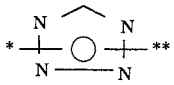

(INH-11)

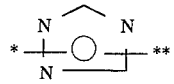

(INH-12)

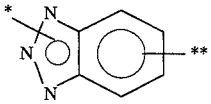

In these formulae, * indicates the position at which the group represented by A-$(L_1)_v$-B-$(L_2)_w$- is bonded and ** indicates the position at which the group represented by HYD is bonded in general formula (R-I).

From among these groups, those represented by (INH-1) to (INH-4) and (INH-12) are preferred, and those represented by general formulae (INH-1) and (INH-3) are especially desirable.

The group represented by HYD in general formula (R-I) is, more precisely, a group which can be represented by the formula (HYD-I) indicated below.

$$-(L_3)_{ry}-CO_2R_{22} \quad \text{(HYD-I)}$$

Here, $L_3$ represents a substituted or unsubstituted alkyl group or aryl group, and ry represents 0 or 1.

$R_{22}$ is an alkyl group which has from 1 to 20 carbon atoms, which preferably has from 2 to 10 carbon atoms, and which most desirably has from 3 to 7 carbon atoms. Furthermore, the compounds represented by general formula (R-I) release compounds which can be represented by INH-HYD during photographic processing, but the half life of the hydrolysis rate of the alkoxycarbonyl groups of these compounds in a processing bath is within 4 hours, preferably within 2 hours, and most desirably within 40 minutes.

Actual examples of $L_3$ and $R_{22}$ are indicated below, but the invention is not limited by these examples.

Examples of $L_3$ $-CH_2-$, $-CH_2CH_2-$, $-CH_2CH_2CH_2-$, $-CH_2CH_2CH_2CH_2CH_2-$, $-\underset{\underset{CH_3}{|}}{CH}-$, $-C(CH_3)_2-$, $-CH_2\underset{\underset{CH_3}{|}}{CH}-$, $-\underset{\underset{CH_3}{|}}{CH}CH-$,

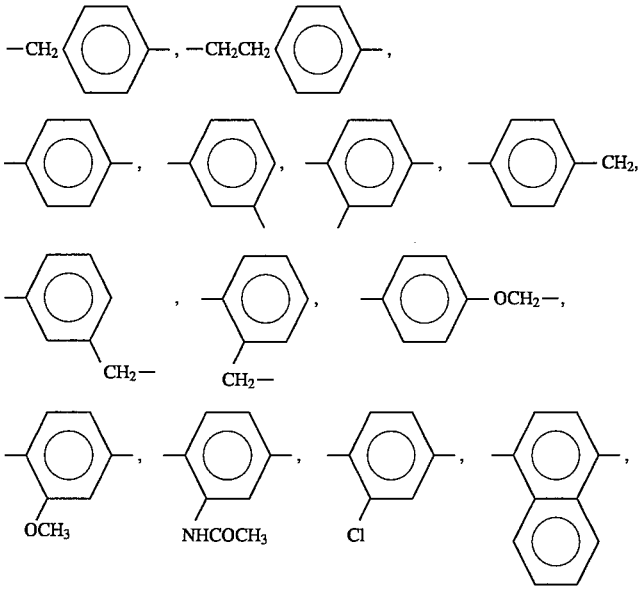

$-CH_2-CH_2-CH_2-$, $-CH_2-CH_2-OCH_2-$, $-CH_2SCH_2-$, $-CH_2\underset{\underset{O}{\|}}{\overset{H}{N}C}-CH_2$, and $-CH_2CH_2SCH_2-$ Examples of $R_{22}$ $-CH_3$, $-C_2H_5$, $-C_3H_7$, $-C_4H_9$, $-C_4H_9^{(i)}$, $-C_4H_9^{(sec)}$, $-C_4H_9^{(t)}$, $-C_5H_{11}$, $-C_{10}H_{21}$, $-C_{16}H_{33}^{(i)}$,

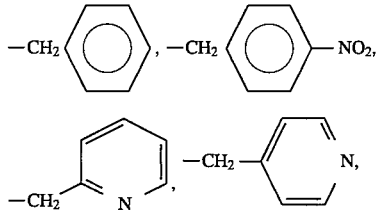

$-CH_2CH_2CN$, $-CH_2CH_2Cl$,
$-CH_2CH_2OCH_3$, $-CH_2CH_2SCH_3$,
$-CH_2CO_2CH_3$, $-CH_2CH_2CO_2C_3H_7$,
$-CH_2CH_2SOCH_3$, $-CH_2CH_2SO_2CH_3$,
$-CH_2CH_2SO_2NHCH_3$,
$-CH_2CONHCH_3$, $-CH_2CH_2CONH_2$,
$-CH_2CH_2CON(CH_3)_2$, and $-CH_2CH_2CONHCH_3$ Compounds represented by general formula (R-I) which constitute the present invention can be prepared using the methods disclosed in U.S. Pat. Nos. 4,618,571 and 4,770,982, JP-A-63-284159, JP-A-60-203943 or JP-A-63-23152.

Actual examples of compounds represented by general formula (R-1) of the present invention are indicated below, but the invention is not limited by these examples.

(Illustrative Compounds)
(1)
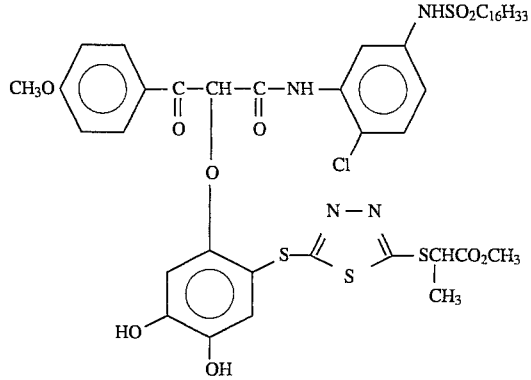
(2)
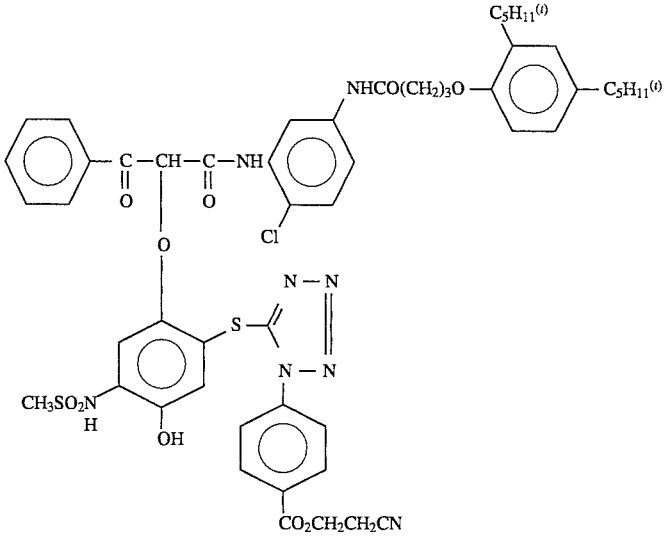
(3)
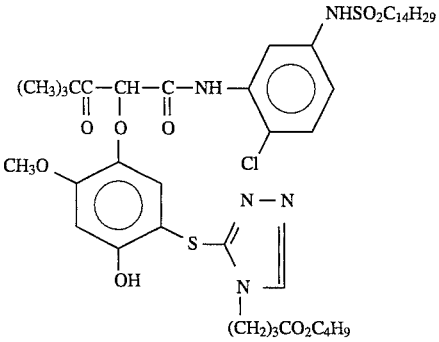
(4)
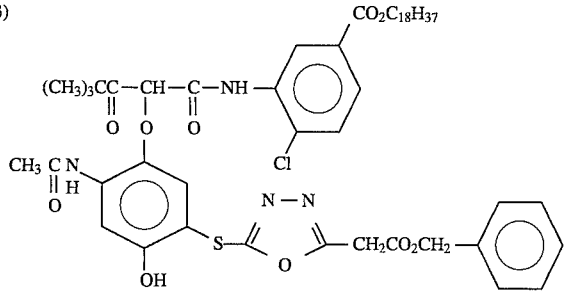
(5)
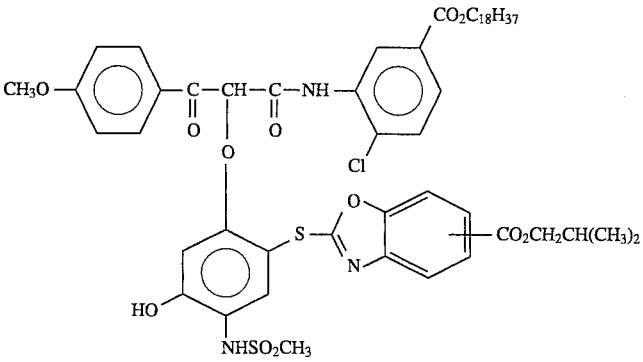

-continued
(Illustrative Compounds)
(6)
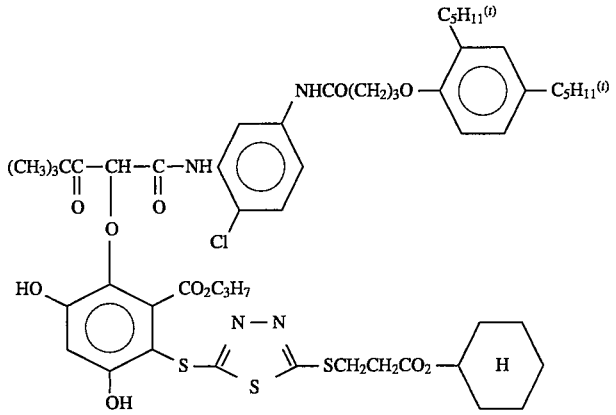
(7)
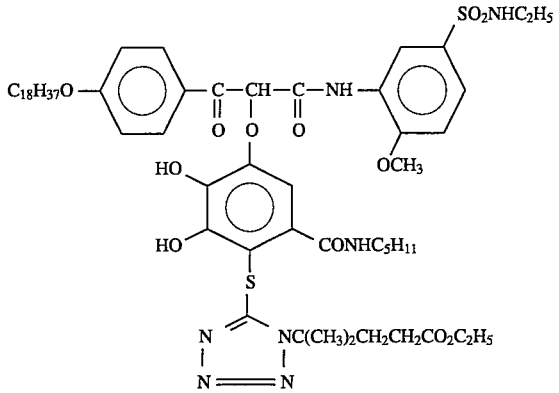
(8)
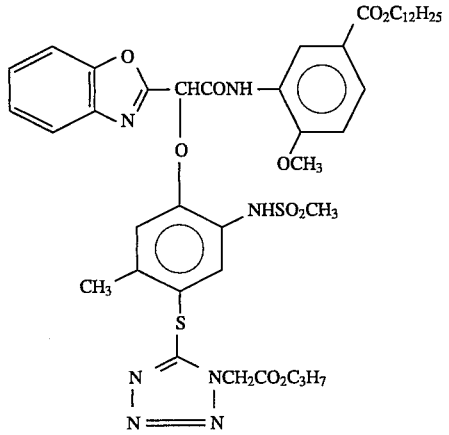
(9)
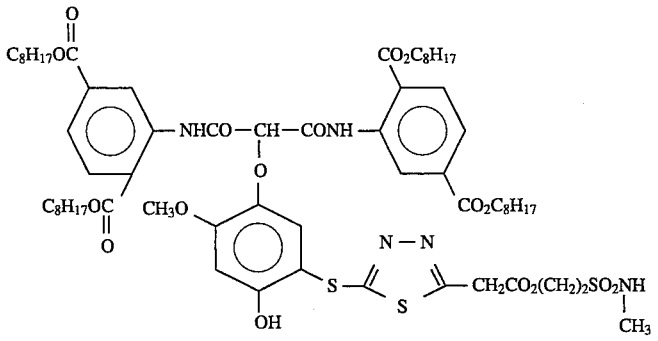

-continued
(Illustrative Compounds)
(10)
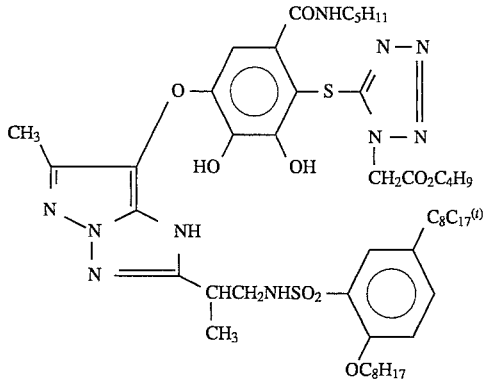
(11)
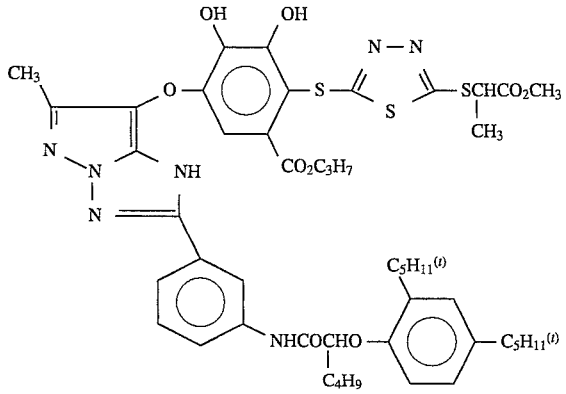
(12)
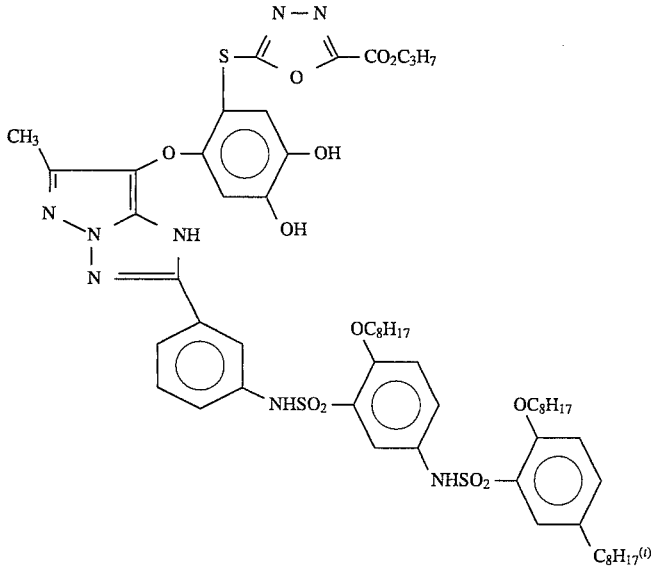

-continued
(Illustrative Compounds)
(13)
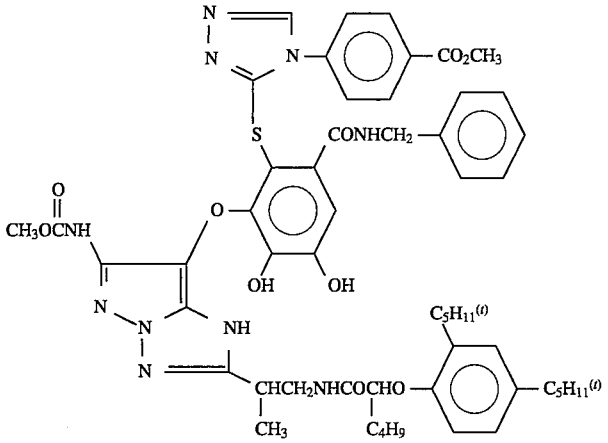
(14)
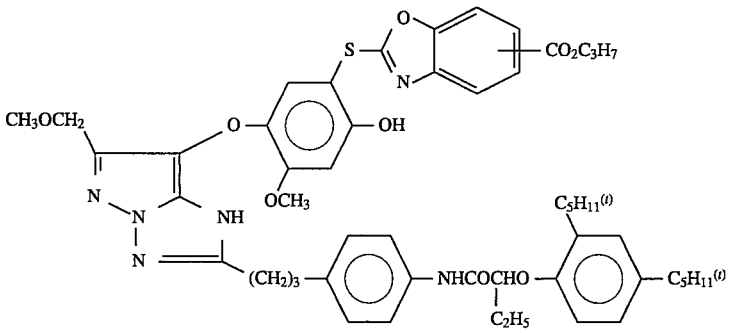
(15)
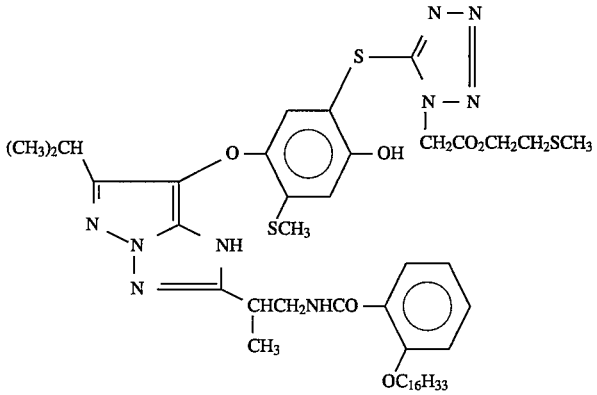
(16)
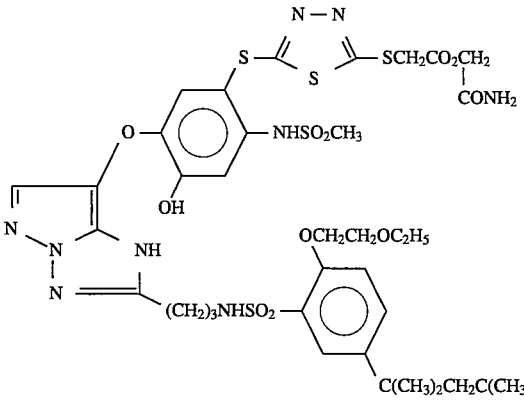
(17)
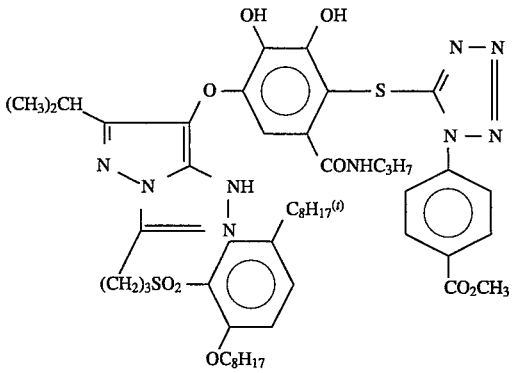

-continued
(Illustrative Compounds)
(18)
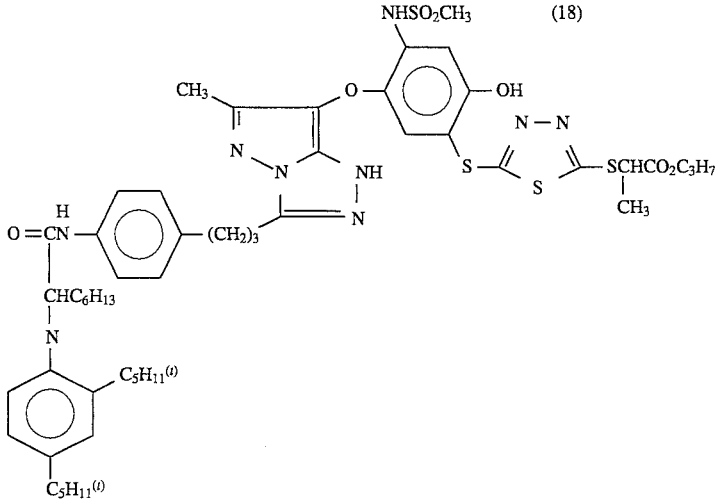
(19)
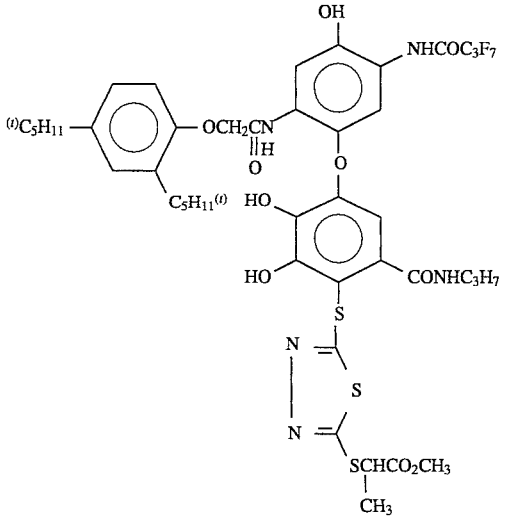
(20)
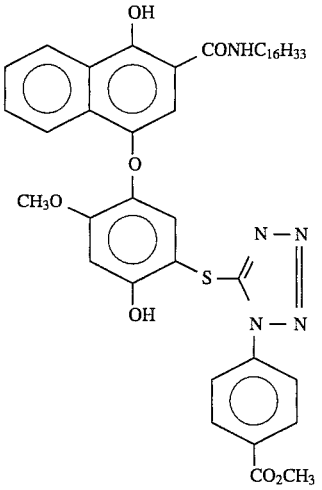
(21)
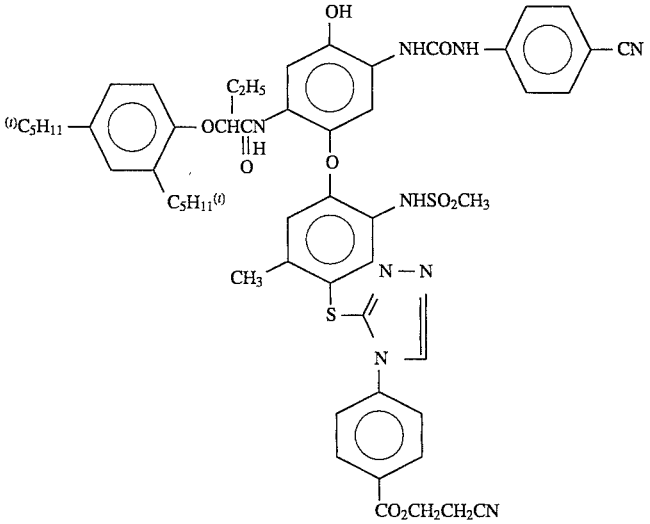

-continued
(Illustrative Compounds)
(22)
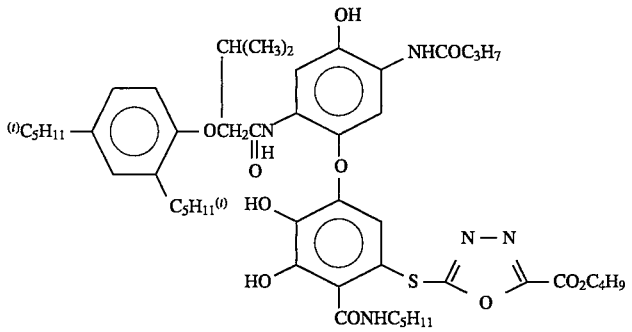
(23)
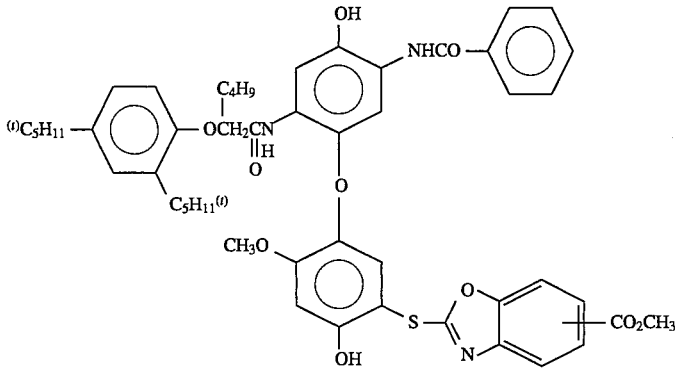
(24)
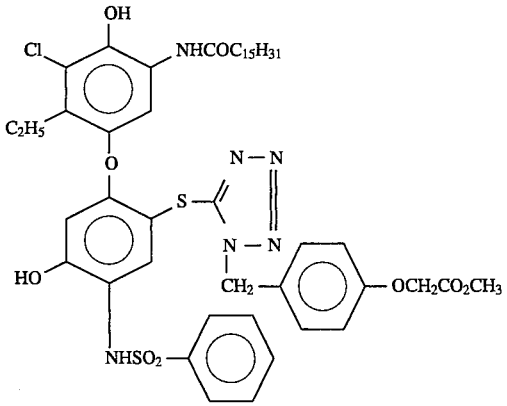
(25)
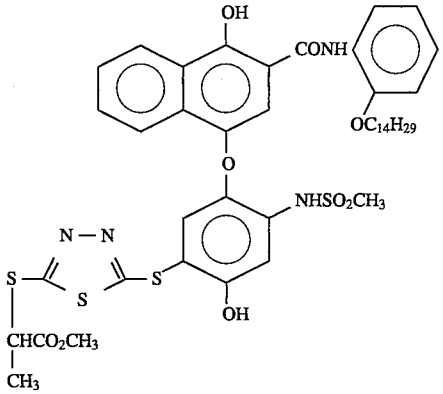
(26)
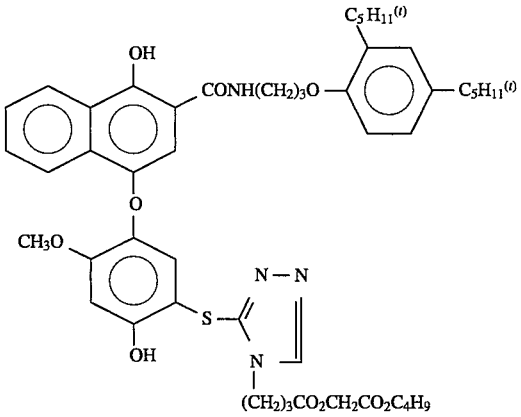

-continued
(Illustrative Compounds)
(27)
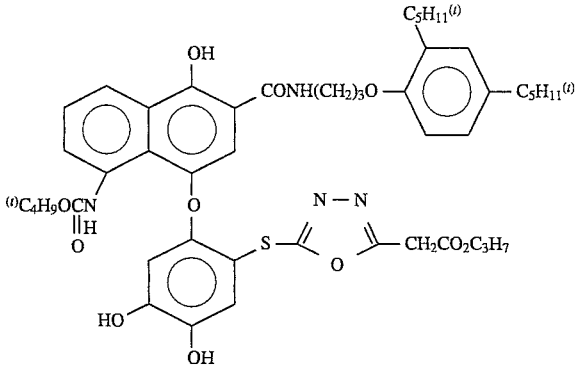
(28)
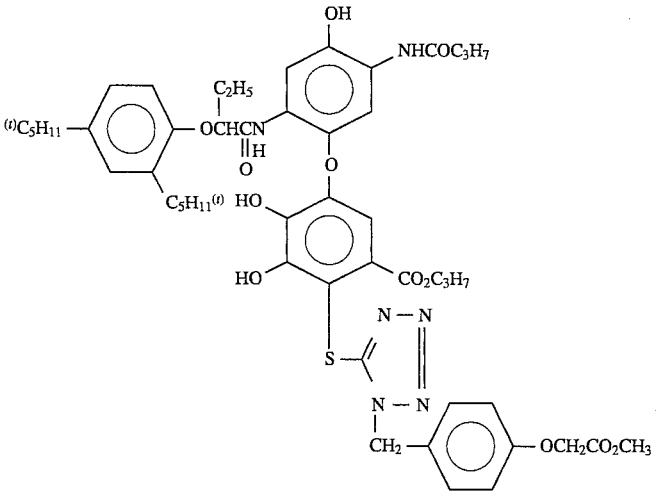
(29)
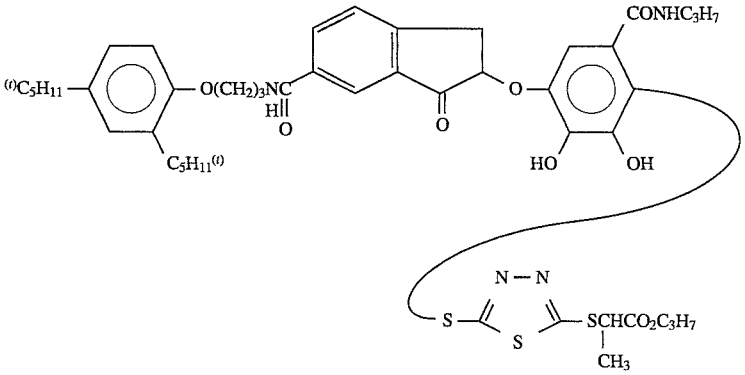
(30)
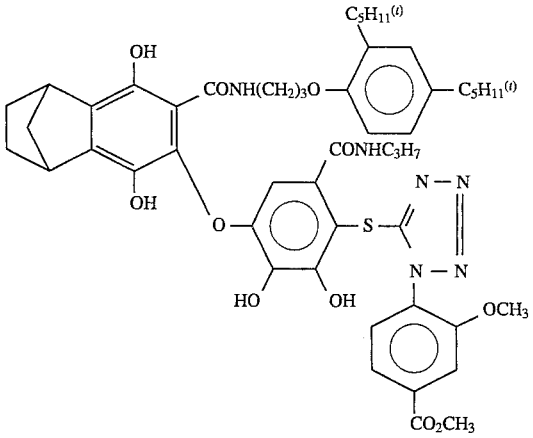

The compounds represented by general formula (R-I) of the present invention are preferably added to a photosensitive silver halide emulsion layer or to a layer adjacent thereto in the photosensitive material, and they are added in amounts of from $1\times10^{-6}$ to $1\times10^{-3}$ mol/m$^2$, preferably of from $3\times10^{-6}$ to $5\times10^{-4}$ mol/m$^2$, and most desirably of from $1\times10^{-5}$ to $2\times10^{-4}$mol/m$^2$.

The compounds represented by general formula (R-I) of the present invention can be added using the same methods of addition generally used for couplers as described hereinafter.

In the present invention, the use of benzoylacetanilide based yellow couplers which can be represented by the general formula [A] indicated below is especially desirable. These couplers have a high ε and so the film thickness of the photographic layer can be reduced, and consequently it is possible to improve sharpness and photographic stability with methods of continuous processing with replenishment of the developer.

General Formula [A]

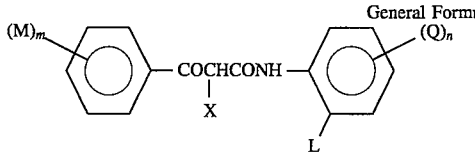

In general formula [A], M and Q represent groups (including atoms) which can be substituted on a benzene ring, L represents a hydrogen atom, a halogen atom or an aliphatic oxy group, m represents an integer of value from 0 to 5, n represents an integer of value from 0 to 4, and X represents a group which can be eliminated by a coupling reaction with the oxidized form of a primary aromatic amine developing agent. Moreover, when m is 2 or more the $(M)_m$ groups may be the same or different, and similarly when n is 2 or more the $(Q)_n$ groups may be the same or different. Furthermore, M, Q, L or X may be divalent, trivalent or tetravalent linking group and dimers—tetramers of the yellow couplers represented by general formula [A] may be formed.

Examples of M and Q include halogen atoms (fluorine, chlorine, bromine), aliphatic groups which have from 1 to 20 carbon atoms, aromatic groups which have from 6 to 20 carbon atoms, aliphatic oxy groups which have from 1 to 20 carbon atoms, aromatic oxy groups which have from 6 to 20 carbon atoms, carbonamido groups which have from 2 to 24 carbon atoms, sulfonamido groups which have from 0 to 20 carbon atoms, carbamoyl groups which have from 1 to 24 carbon atoms, sulfamoyl groups which have from 0 to 20 carbon atoms, acyloxy groups which have from 2 to 20 carbon atoms, aliphatic oxycarbonyl groups which have from 2 to 20 carbon atoms, substituted amino groups which have from 2 to 24 carbon atoms, aliphatic thio groups which have from 1 to 24 carbon atoms, ureido groups which have from 0 to 20 carbon atoms, sulfamoylamino groups which have from 0 to 20 carbon atoms, cyano groups, aliphatic oxycarbonylamino groups which have from 2 to 20 carbon atoms, imido groups which have from 4 to 20 carbon atoms, aliphatic sulfonyl groups which have from 1 to 20 carbon atoms, aromatic sulfonyl groups which have from 6 to 20 carbon atoms, and heterocyclic groups which have from 1 to 20 carbon atoms. L represents a hydrogen atom, a halogen atom (fluorine, chlorine, bromine) or an aliphatic oxy groups which has from 1 to 24 carbon atoms. X is a group which can be eliminated by a coupling reaction with the oxidized form of a primary aromatic amine developing agent, and more precisely it can be represented by the general formulae [B], [C], and [D] indicated below.

—O—R' General Formula [B]

—S—R" General Formula [C]

General Formula [D]

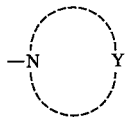

In general Formula [B], R' is an aromatic group which has from 2 to 30 carbon atoms, a heterocyclic group which has from 1 to 28 carbon atoms, an acyl group which has from 2 to 28 carbon atoms, an aliphatic sulfonyl group which has from 1 to 24 carbon atoms or an aromatic sulfonyl group which has from 6 to 24 carbon atoms.

In general formula [C ], R" represents an aliphatic group which has from 1 to 30 carbon atoms, an aromatic group which has from 6 to 30 carbon atoms or a heterocyclic group which has from 1 to 28 carbon atoms.

In general formula [D], Y represents a group of non-metal atoms which is required, along with Q, to form a five to seven membered single ring or a condensed ring heterocyclic ring. Examples of heterocyclic rings which can be formed by Q and Y include pyrrole, pyrazole, imidazole, 1,2,4-triazole, tetrazole, indole, indazole, benzimidazole, benzotriazole, tetraazaindene, succinimide, phthalimide, saccharine, oxazolidin-2,4-dione, imidazolidin-2,4-dione, thiazolidin-2,4-dione, urazole, parabanic acid, maleimide, 2-pyridone, 4-pyridone, 6-pyridazone, 6-pyrimidone, 2-pyrazone, 1,3,5-triazin-2-oxazolone, 1,2,4-triazin-6-one, 1,3,4-triazin-6-one, 2-oxazolone, 2-thiazolone, 2-imidazolone, 3-iso-oxazolone, 5-tetrazolone and 1,2,4-triazo-5-one, and these may be substituted with substituent groups such as, for example, halogen atoms, hydroxyl groups, nitro groups, cyano groups, hydroxyl groups, aliphatic groups, aromatic groups, heterocyclic groups, aliphatic oxy groups, aromatic oxy groups, aliphatic thio groups, aromatic thio groups, aliphatic oxycarbonyl groups, carboxamido groups, sulfonamido groups, carbamoyl groups, sulfamoyl groups, ureido groups, sulfamoylamino groups, aliphatic oxycarbonylamino groups and substituted amino groups.

In general formulae [A]–[D] mentioned above, an aliphatic group is a linear chain, branched chain or cyclic alkyl, alkenyl or alkynyl group, and these groups may be substituted groups. Examples of aliphatic groups include methyl, ethyl, iso-propyl, n-butyl, tert-butyl, tert-amyl, n-hexyl, cyclohexyl, n-octyl, 2-ethylhexyl, n-decyl, n-dodecyl, n-tetradecyl, n-hexadecyl, 2-hexyldecyl, n-octadecyl, allyl, benzyl, phenethyl, undecenyl, octadecenyl, trifluoromethyl, chloroethyl, cyanoethyl, 1-(ethoxycarbonyl)ethyl, methoxyethyl, butoxyethyl, 3-dodecyloxypropyl and phenoxyethyl group. In general formulae [A]–[D], a heterocyclic group is a substituted or unsubstituted single ring or condensed ring heterocyclic group and examples include, as well as the groups derived from compounds which can be represented by

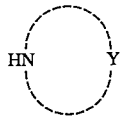

as mentioned earlier, 2-furyl, 2-thienyl, 2-pyridyl, 3-pyridyl, 4-pyridyl, 2-quinolyl, oxazol-2-yl, thiazol-2-yl, benzoxazol-2-yl, benzthiazol-2-yl, 1,3,4-thiadiazol-2-yl and 1,3,4-oxadiazol-2-yl group. In general formulae [A]–[D], an aromatic group is a substituted or unsubstituted, single ring or condensed ring aryl group, and examples include phenyl, tolyl, 4-chlorophenyl, 4-methoxyphenyl, 1-naphthyl, 2-naphthyl and 4-tert-butylphenoxy group.

Examples of the preferred substituent groups for the couplers represented by general formula [A] are described below. M is preferably an aliphatic group (for example, methyl, ethyl, n-propyl, tert-butyl), an aliphatic oxy group (for example, methoxy, ethoxy, n-butoxy, n-dodecyloxy), a halogen atom (fluorine, chlorine, bromine), a carbonamido group (for example, acetamido, n-butanamido, n-tetradecanamido, benzamido) or a sulfonamido group (for example, methylsulfonamido, n-butylsulfonamido, n-octylsulfonamido, n-dodecylsulfonamido, toluenesulfonamido).

L is preferably a chlorine atom or an aliphatic oxy group (for example, methoxy, ethoxy, methoxyethoxy, n-octyloxy, 2-ethylhexyloxy, n-tetradecyloxy).

Q is preferably a substituent group as described earlier for M or an aliphatic oxycarbonyl group (for example, methoxycarbonyl, ethoxycarbonyl, n-butoxycarbonyl, n-hexyloxycarbonyl, 2-ethylhexyloxycarbonyl, 1-(ethoxycarbonyl-)ethyloxycarbonyl, 3-dodecyloxypropyloxycarbonyl n-decyloxycarbonyl, n-dodecyloxycarbonyl, phenethyloxycarbonyl), or a carbamoyl group (for example, dimethylcarbamoyl, dibutylcarbamoyl, dihexylcarbamoyl, di-2-ethylhexylcarbamoyl, n-dodecylcarbamoyl). Moreover, m is preferably from 0 to 2, and n is preferably from 0 to 2. X is preferably a group in which R' in general formula [B] is an aromatic group (for example, 4-methoxycarbonylphenoxy, 4-methylsulfonylphenoxy, 4-cyanophenoxy, 4-dimethylsulfamoylphenoxy, 2-acetamido-4-methoxycarbonylphenoxy, 4-ethoxycarbonyl-2-methylsulfonamidophenoxy) or a group which can be represented by general formula [D ], and of the latter, the groups which can be represented by general formula [E] indicated below are especially desirable.

General Formula [E]

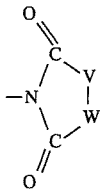

In general formula [E], V represents a substituted or unsubstituted methylene group or a substituted or unsubstituted imino group, and W represents an oxygen atom, a sulfur atom, a substituted or unsubstituted methylene group or a substituted or unsubstituted imino group. However, W may not be an oxygen atom or a sulfur atom when V is an imino group. Examples of the groups represented by general formula [E] include succinimido, phthalimido, 1-methylimidazolidin-2,4-dione-3-yl, 1-benzylimidazolidin-2,4dione-3-yl, 5-ethoxy-1-methylimidazolidin-2,4-dione-3-yl, 5-methoxy-1-methylimidazolidin-2,4-dione-3-yl, 5,5-dimethyloxazolidin-2,4-dione-3-yl, thiazolidin-2,4-dione-3-yl, 1-benzyl-2-phenyltriazolidin-3,5-dione-4-yl, 1-n-propyl-2-phenyltriazolidin-3,5-dione-4-yl and 5-ethoxy-l-benzylimidazolidin-2,4-dione-3-yl.

The yellow couplers represented by general formula [A] may be dimeric, trimeric or tetrameric yellow couplers with any of the substituent groups M. Q, L or X being a two, three or four valent linking group, but monomers or dimers are preferred. The numbers of carbon atoms indicated earlier for M, Q, L or X do not apply when the yellow coupler represented by general formula [A] is a dimer, a trimer or a tetramer.

Actual examples of yellow couplers which can be represented by general formula [A] are indicated below, but the couplers which can be used in the invention are not limited by these examples.

Y-1

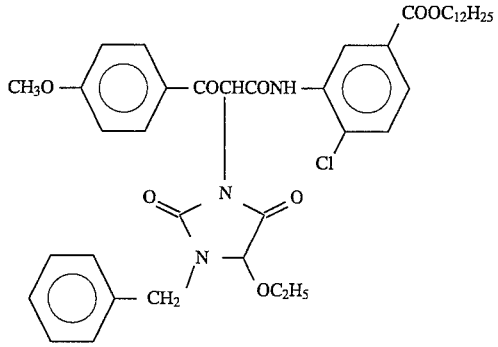

-continued
Y-2
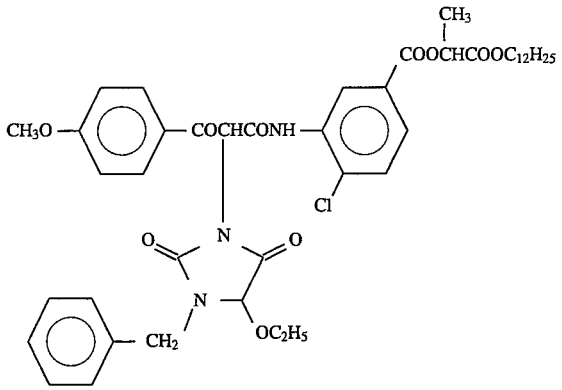
Y-3
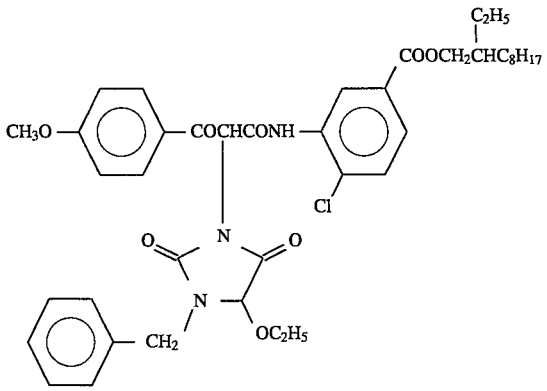
Y-4
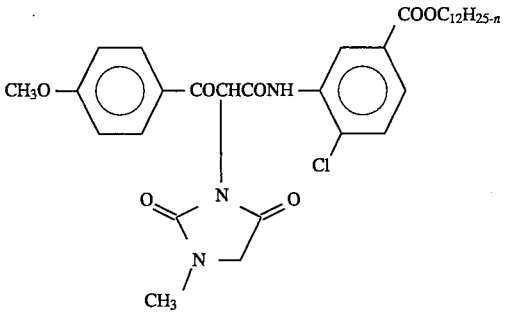
Y-5
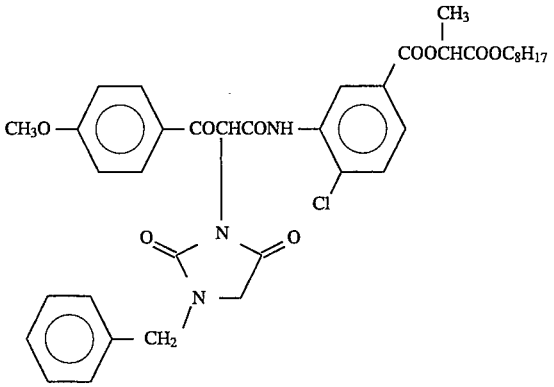

-continued
Y-6
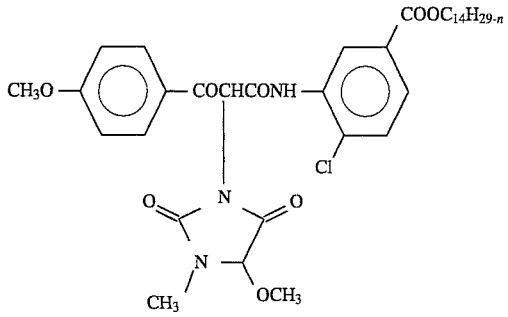
Y-7
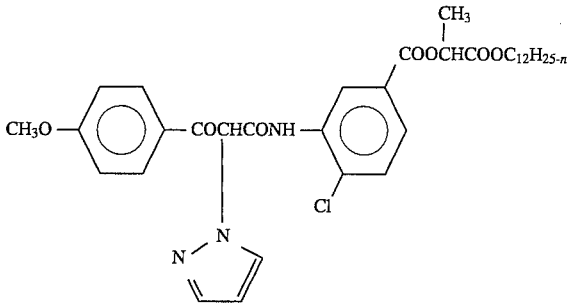
Y-8
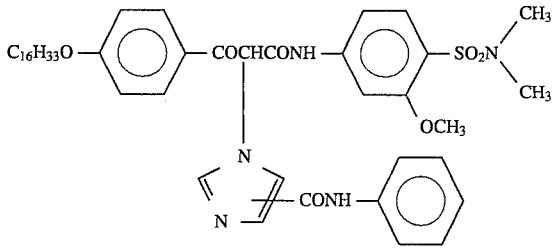
Y-9
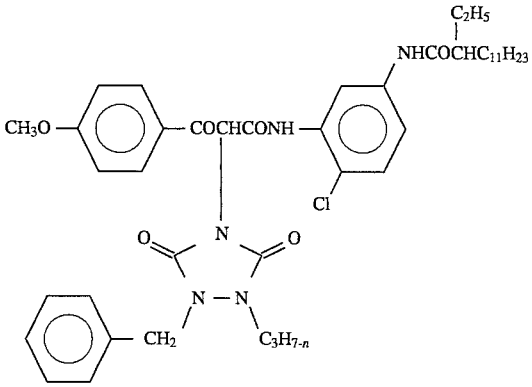
Y-10
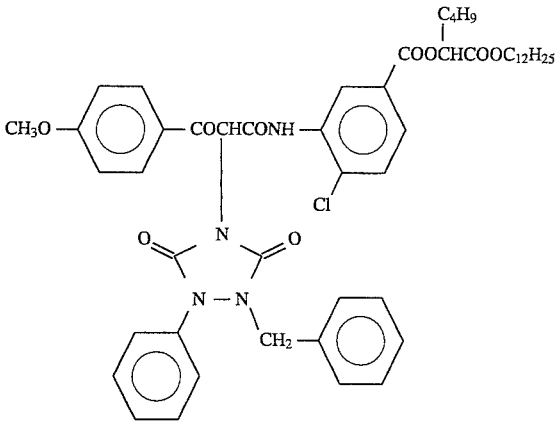

-continued
Y-11
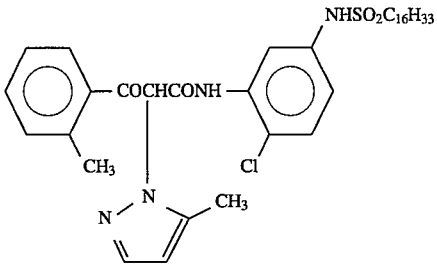
Y-12
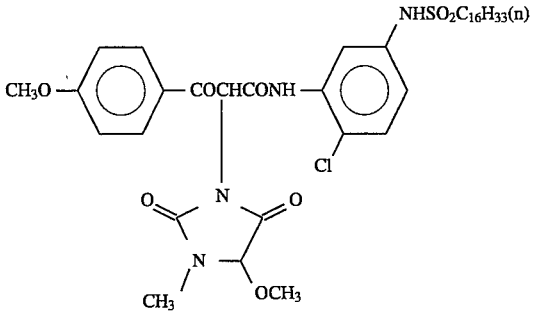
Y-13
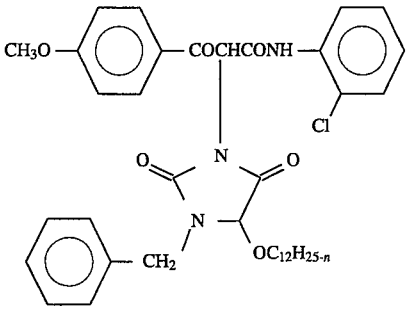
Y-14
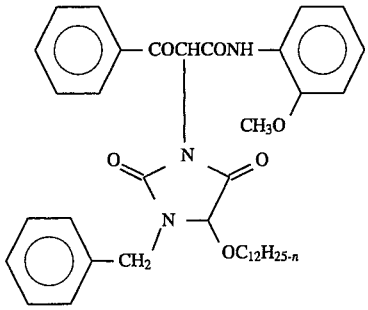
Y-15
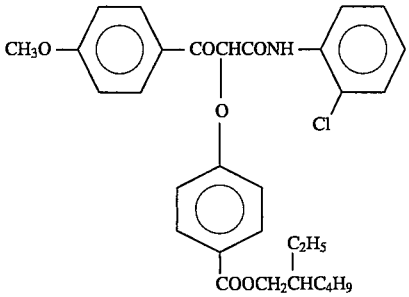
Y-16
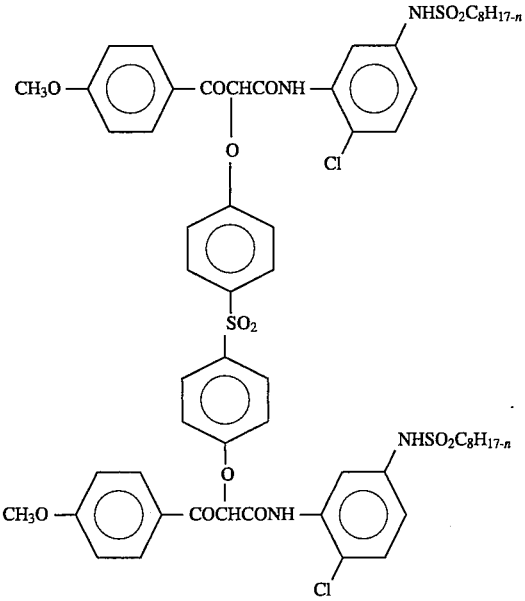

-continued

Y-17

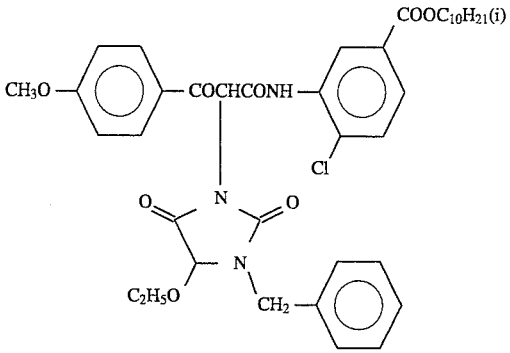

Y-18

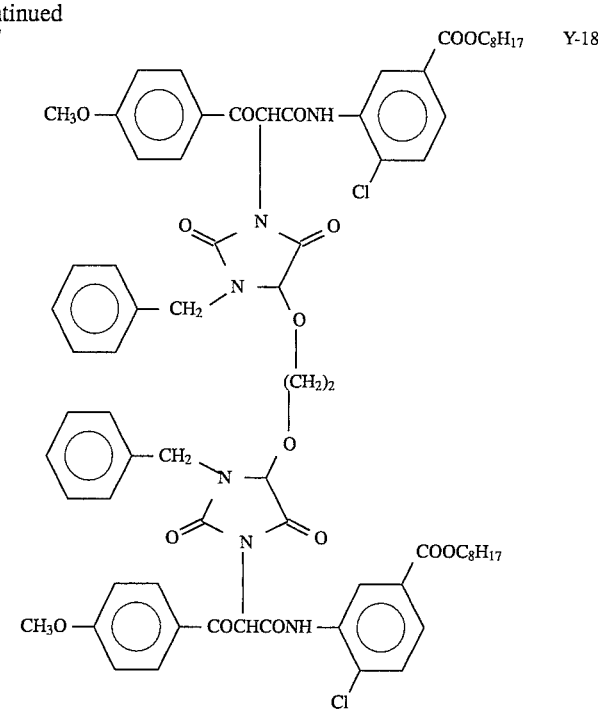

The above mentioned yellow couplers can be prepared using methods known in the past. For example, they can be prepared using the methods of synthesis disclosed in the specifications of U.S. Pat. Nos. 3,227,554, 3,408,194, 3,415,652, 3,447,928 and 4,401,752, British Patent 1,040,710, JP-A-47-26133, JP-Z-47-37736, JP-A-48-733147, JP-A-48-94432, JP-A-48-68834, JP-A-48-68835, JP-A-48-68836, JP-A-50-34232, JP-A-51-50734, JP-A-51-102636, JP-A-55-598, JP-A-55-161239, JP-A-56-95237, JP-A-56-161543, JP-A-56-153343, JP-A-59-174839 and JP-A-60-35730.

The use of cyan couplers which can be represented by general formula [C] indicated below are preferred in the silver halide color photographic materials of the present invention.

Formula [C]

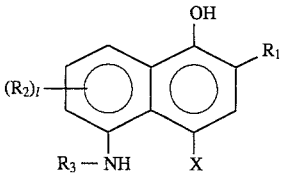

In formula [C], $R_1$ represents $—CONR_4R_5$, $—SO_2NR_4R_5$, $—NHCOR_4$, $—NHCOOR_6$, $—NHSO_2R_6$, $—NHCONR_4R_5$ or $—NHSO_2NR_4R_5$, $R_2$ represents a group which can be substituted on a naphthalene ring, l represents an integer of value from 0 to 3, $R_3$ represents a substituent group, and X represents a hydrogen atom or a group which can be eliminated by a coupling reaction with the oxidized form of a primary aromatic amine developing agent. Furthermore, $R_4$ and $R_5$ may be the same or different, each representing a hydrogen atom, an alkyl group, an aryl group or a heterocyclic group, and $R_6$ represents an alkyl group, an aryl group or a heterocyclic group. When l represents 2 or more, the $R_2$ groups may be the same or different, or they may be joined together to form rings. $R_2$ and $R_3$, or $R_3$ and X, may be joined together to form a ring. Furthermore, dimers or larger oligomers which are joined together via a group $R_1$, $R_2$, $R_3$ or X which is a divalent group or a group of valency greater than two are allowed.

Each of the substituent groups in formula [C] is further described in detail below.

$R_1$ represents $—CONR_4R_5$, $—SO_2NR_4R_5$, $—NHCOR_4$, $—NHCOOR_6$, $\lessgtr NHSO_2R_6$, $—NHCONR_4R_5$ or $—NHSO_2NR_4R_5$, and $R_4$, $R_5$ and $R_6$ each independently represent an alkyl group of which the total number of carbon atoms is from 1 to 30, an aryl group of which the total number of carbon atoms is from 6 to 30, or a heterocyclic group of which the total number of carbon atoms is from 2 to 30. $R_4$ and $R_5$ may also be hydrogen atoms.

$R_2$ represents a group (including atoms, same hereinbelow) which can be substituted on a naphthalene ring, and typical examples include halogen atoms (F, Cl, Br, I), hydroxyl group, carboxyl group, amino group, sulfo group, cyano group, alkyl groups, aryl groups, heterocyclic groups, carbonamido groups, sulfonamido groups, carbamoyl groups, sulfamoyl groups, ureido groups, acyl groups, acyloxy groups, alkoxy groups, aryloxy groups, alkylthio groups, arylthio groups, alkylsulfonyl groups, arylsulfonyl groups, sulfamoylamino groups, alkoxycarbonylamino groups, nitro group and amido group. The total number of carbon atoms in $(R_2)_l$ is from 0 to 30.

$R_3$ represents a substituent group, and it is preferably represented by formula [C-1] indicated below.

$R_7(Y)_m—$ Formula [C-1]

In formula [C-1], Y represents >NH, >CO or $>SO_2$, m represents an integer value of 0 or 1 $R_7$ represents a hydrogen atom, an alkyl group of which the total number of carbon atoms is from 1 to 30, an aryl group of which the total number of carbon atoms is from 6 to 30, a heterocyclic group of which the total number of carbon atoms is from 2 to 30, $—COR_8$,

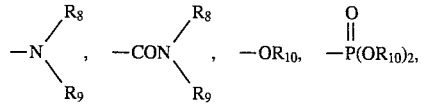

-continued

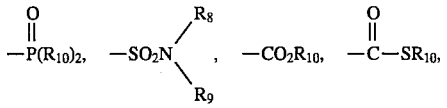

$—SO_2OR_{10}$ or $—SO_2R_{10}$. Here, $R_8$, $R_9$ and $R_{10}$ have the same respective meanings as $R_4$, $R_5$ and $R_6$ described earlier.

$R_4$ and $R_5$ in

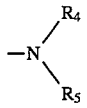

or $R_8$ and $R_9$ in

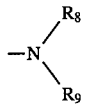

may be joined together to form a nitrogen containing heterocyclic ring (for example, a pyrrolidine ring, a piperidine ring or a morpholine ring).

X represents a hydrogen atom or a group which can be eliminated by a coupling reaction with the oxidized form of a primary aromatic amine developing agent (known as a leaving group, and including the leaving atoms hereinbelow), and typical leaving groups include halogen atoms, $—OR_{11}$, $—SR_{11}$,

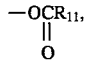

$—NHCOR_{11}$,

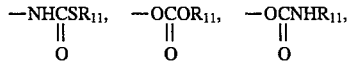

thiocyanato group, heterocyclic groups which have a total of from 1 to 30 carbon atoms which are bonded to the coupling active site with a nitrogen atom (for example, succinimido, phthalimido, pyrazolyl, hydantoinyl, 2-benzotriazolyl). Here, $R_{11}$ has the same meaning as the aforementioned $R_6$.

In the above formulae, an alkyl group is a linear chain, branched chain or cyclic alkyl group, and it may contain unsaturated bonds and substituent groups (for example, halogen atoms, hydroxyl group, aryl groups, heterocyclic groups, alkoxy groups, aryloxy groups, alkylsulfonyl groups, arylsulfonyl groups, alkoxycarbonyl groups, acyloxy groups and acyl groups), and typical examples include methyl, iso-propyl, isobutyl, tert-butyl, 2-ethylhexyl, cyclohexyl, n-dodecyl, n-hexadecyl, 2-methoxyethyl, benzyl, trifluoromethyl, 3-dodecyloxypropyl and 3-(2,4-di-tert-pentylphenoxy)propyl.

Furthermore, the aryl groups may have condensed rings (for example, naphthyl), and they may have substituent groups (for example, halogen atoms, alkyl, aryl, alkoxy, aryloxy, cyano, acyl, alkoxycarbonyl, carbonamido, sulfonamido, carbamoyl, sulfamoyl, alkylsulfonyl and arylsulfonyl groups), and typical examples include phenyl, tolyl, pentafluorophenyl, 2-chlorophenyl, 4-hydroxyphenyl, 4-cyanophenyl, 2-tetradecyloxyphenyl, 2-chloro-5-dodecyloxyphenyl and 4-tert-butylphenyl.

Furthermore, the heterocyclic groups are three to eight membered single ring or condensed ring heterocyclic groups which contain within the ring at least one O, N, S, P, Se or Te hetero atom, and they may have substituent groups (for example, halogen atoms, carboxyl groups, hydroxyl groups, nitro groups, alkyl groups, aryl groups, alkoxy groups, aryloxy groups, alkoxcarbonyl groups, aryloxycarbonyl groups, amino groups, carbamoyl groups, sulfamoyl groups, alkylsulfonyl groups, arylsulfonyl groups), and typical examples include 2-pyridyl, 4-pyridyl, 2-furyl, 4-thienyl, benzotriazol-1-yl, 5-phenyltetrazol-l-yl, 5-methylthio-1,3,4-thiadiazol-2-yl and 5-methyl-1,3,4-oxadiazol-2-yl.

The substituent groups preferred in the present invention are described below.

$R_1$ is preferably $—CONR_4R_5$ or $—SO_2NR_4R_5$, and actual examples include carbamoyl, N-n-butylcarbamoyl, N-n-dodecylcarbamoyl, N-(3-n-dodecyloxypropyl)carbamoyl, N-cyclohexylcarbamoyl, N-[3-(2,4-di-tert-pentylphenoxy)propyl]carbamoyl, N-hexadecylcarbamoyl, N-[4-(2,4-di-tert-pentylphenoxy)butyl]carbamoyl, N-(3-dodecyloxy-2-methylpropyl)carbamoyl, N-[3-(4-tert-octylphenoxy)propyl]carbamoyl, N-hexadecyl-N-methylcarbamoyl, N-(3-dodecyloxypropyl)sulfamoyl and N-[4-(2,4-di-tert-pentylphenoxy)butyl]sulfamoyl. $R_1$ is most desirably a $—CONR_4R_5$group.

With $R_2$ and l, the case in which l=0, which is to say where there is no substituent group, is most desirable, followed in preference by the case in which l =1. $R_2$ is preferably a halogen atom, an alkyl group (for example, methyl, isopropyl, tert-butyl, cyclopentyl), a carbonamido group (for example, acetamido, pivalinamido, trifluoroacetamido, benzamido), a sulfonamido group (for example, methanesulfonamido, toluenesulfonamido) or a cyano group.

$R_3$ is preferably a group in which m=0 in formula [C-1], and most desirably $R_7$ is a $—COR_8$ group [for example, formyl, acetyl, trifluoroacetyl, 2-ethylhexanoyl, pivaloyl, benzoyl, pentafluorobenzoyl, 4-(2,4-di-tert-pentylphenoxy)butanoyl], a $—COOR_{10}$ group [for example, methoxycarbonyl, ethoxycarbonyl, iso-butoxycarbonyl, 2-ethylhexyloxycarbonyl, n-dodecyloxycarbonyl, 2-methoxyethoxycarbonyl] or an $—SO_2R_{10}$ group [for example, methylsulfonyl, n-butylsulfonyl, n-hexadecylsulfonyl, phenylsulfonyl, p-tolylsulfonyl, p-chlorophenylsulfonyl, trifluoromethylsulfonyl], and most desirably $R_7$ is a $—COOR_{10}$ group.

X is preferably a hydrogen atom, a halogen atom, an $—OR_{11}$ group [for example, alkoxy groups such as ethoxy, 2-hydroxyethoxy, 2-methoxyethoxy, 2-(2-hydroxyethoxy-)ethoxy, 2-methylsulfonylethoxy, ethoxycarbonylmethoxy, carboxymethoxy, 3-carboxypropoxy, N-(2-methoxyethyl-)carbamoylmethoxy, 1-carboxytridecyloxy, 2-methanesulfonamidoethoxy, 2-carboxymethylthio)ethoxy and 2-(1-carboxytridecylthio)ethoxy and aryloxy groups such as 4-cyanophenoxy, 4-carboxyphenoxy, 4-methoxyphenoxy, 4-tert-octylphenoxy, 4-nitrophenoxy, 4-(3-carboxypropanamido)phenoxy and 4-acetylamidophenoxy], or an $—SR_{11}$ group [for example, an alkylthio group such as carboxymethylthio, 2-carboxymethylthio, 2-methoxyethylthio, ethoxycarbonylmethylthio, 2,3-dihydroxypropylthio and 2-(N,N-dimethylamino)ethylthio and arylthio groups such as 4-carboxyphenylthio, 4-methoxyphenylthio and 4-(3-carboxypropanamido)phenylthio], and it is most desirably a hydrogen atom, a chlorine atom, an alkoxy group or an alkylthio group.

The couplers represented by general formula [C] may take the form of dimers or higher oligomers which are bonded together via a group of valency two or more in the substituent groups $R_1$, $R_2$, $R_3$ and X. In this case, the number of carbon atoms may be outside the range shown for each of the aforementioned substituent groups.

In those cases where the couplers represented by general formula [C] form oligomers they are typically homopolymers or copolymers of addition polymerizable ethylenic unsaturated compounds which have cyan dye forming coupler residual groups (cyan color forming monomers), and those represented by the formula [C-2] are preferred.

$$-(G_i)_{gi}-(H_j)_{hj}- \qquad \text{Formula [C-2]}$$

In formula [C-2], $G_i$ is a repeating unit derived from a color forming monomer, being a group represented by formula [C-3], and $H_j$ is a group which provides a repeating unit derived from a non-color forming monomer, i represents a positive integer, j represents 0 or a positive integer, and gi and hi indicate the fractions by weight of $G_i$ and $H_j$ respectively. Here, when i or j is 2 or more then $G_i$ or $H_j$ may include a plurality of types of repeating units.

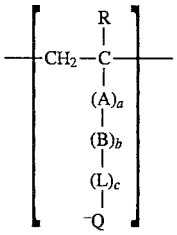

Formula [C-3]

In formula [C-3], R represents a hydrogen atom, an alkyl group which has from 1 to 4 carbon atoms or a chlorine atom, A represents —CONH—, —COO— or a substituted or unsubstituted phenylene group, B represents a divalent group which has a carbon atom at both ends, such as a substituted or unsubstituted alkylene group, phenylene group or oxydialkylene group, and L represents —CONH—, —NHCONH—, —NHCOO—, —NHCO—, —OCONH—, —NH≤, —COO—, —OCO—, —CO—, —O—, $—SO_2—$, $—NHSO_2—$ or $—SO_2NH—$. Moreover, a, b and c represent integer values of 0 or 1. Q represents a cyan coupler residual group for which one hydrogen atom has been removed from $R_1$, $R_2$, $R_3$ or X in a compound represented by general formula [C].

Non-color forming ethylenic monomers which do not couple with the oxidation products of primary aromatic amine developing agents which provide the repeating units $H_j$ include acrylic acid, α-chloroacrylic acid, α-alkylacrylic acids (for example methacrylic acid), amides and esters derived from these acrylic acids ( for example, acrylamide, methacrylamide, n-butylacrylamide, tert-butylacrylamide, diacetoneacrylamide, methyl acrylate, ethyl acrylate, n-propyl acrylate, n-butyl acrylate, tert-butyl acrylate, iso-butyl acrylate, 2-ethylhexyl acrylate, n-octyl acrylate, lauryl acrylate, methyl methacrylate, ethyl methacrylate, n-butyl methacrylate and β-hydroxyethyl methacrylate), vinyl esters (for example, vinyl acetate, vinyl propionate and vinyl laurate) , acrylonitrile, methacrylonitrile, aromatic vinyl compounds ( for example, styrene and derivatives thereof, such as vinyltoluene, divinylbenzene, vinylacetophenone and sulfostyrene), itaconic acid, citraconic acid, crotonic acid, vinylidene chloride, vinyl alkyl ethers (for example, vinyl ethyl ether ), maleic acid esters, N-vinyl-2-pyrrolidone, N-vinylpyridine and 2- and 4-vinylpyridine.

The acrylic acid esters, methacrylic acid esters and maleic acid esters are especially desirable. Two or more of the non-color forming ethylenic type monomers used here can be used conjointly. For example, use can be made of methyl acrylate and butyl acrylate, butyl acrylate and styrene, butyl methacrylate and methacrylic acid, and methyl acrylate and diacetoneacrylamide.

As is well known in the field of polymeric couplers, ethylenic unsaturated monomers for copolymerization with vinyl based monomers corresponding to the aforementioned formula [C-3] can be selected in such a way as to provide the preferred effects in respect of the form of the copolymer which is obtained, which is to say its physical properties such as whether it has a solid form, a liquid form or a micelle form, and/or its chemical properties, such as its solubility (in water or in organic solvents), its compatibility with binders such as gelatin for example for photographic colloid compositions, and flexibility, thermal stability, coupling reactivity with the oxidized form of a developing agent and fastness to diffusion in photographic colloids. These polymers may be random copolymers or copolymers which have a specified sequence (for example, block copolymers, alternating copolymers).

The number average molecular weight of the cyan polymeric couplers which can be used in the present invention is generally of the order of from a few thousand to a few million, but oligomeric polymer couplers of number average molecular weight not more than 5000 can also be used.

The cyan polymeric couplers used in the present invention may be oleophilic polymers which are soluble in organic solvents (for example, ethyl acetate, butyl acetate, ethanol, methylene chloride, cyclohexanone, dibutyl phthalate, tricresyl phosphate), hydrophilic polymers which are miscible with hydrophilic colloids such as aqueous gelatin solutions for example, or they may have a structure which can form micelles in a hydrophilic colloid.

The selection of oleophilic non-color forming ethylenic monomers (for example acrylic acid esters, methacrylic acid esters, maleic acid esters, vinylbenzenes) in the main for the copolymer component is desirable for obtaining oleophilic couplers which are soluble in organic solvents.

Oleophilic polymeric couplers obtained by the polymerization of vinyl based monomers which provide coupler units represented by the aforementioned general formula [C-3] may be formed by dissolution in an organic solvent and emulsification and dispersion in the form of a latex in an aqueous gelatin solution, or using a direct emulsion polymerization method.

The method for the emulsification and dispersion of oleophilic polymeric couplers in the form of a latex in an aqueous gelatin solution disclosed in U.S. Pat. No. 3,451,820, and the methods of emulsion polymerization disclosed in U.S. Pat. Nos. 4,080,211 and 3,370,952 can be used.

The use of a hydrophilic non-color forming monomer, such as N-(1,1-dimethyl-2-sulfonatoethyl)acrylamide, 3-sulfonatopropyl acrylate, sodium styrenesulfonate, potassium styrenesulfonate, acrylamide, methacrylamide, acrylic acid, methacrylic acid, N-vinylpyrrolidone and N-vinylpyridine for example, as a copolymer component is desirable for obtaining hydrophilic polymeric couplers which are soluble in neutral or alkaline water.

Hydrophilic polymeric couplers can be added to a coating liquid as an aqueous solution, and they can also be added after dissolution in a mixture of water and an organic solvent which is miscible with water, such as a lower alcohol, tetrahydrofuran, acetone, vinyl acetate, cyclohexanone, ethyl lactate, dimethylformamide or dimethylacetamide. Moreover, they may be added after dissolution in an aqueous alkaline solution or an organic solvent which contains an aqueous alkali. Furthermore, a small quantity of surfactant can also be added.

The various substituent groups in formula [C] and actual examples of cyan couplers which can be represented by formula [C] are indicated below.

Examples of $R_1$ $-CONH(CH_2)_3O-A$ $-CONH(CH_2)_4O-A$ $-CONH(CH_2)_3OC_{12}H_{25}$-n $-CONH(CH_2)_3OC_{10}H_{21}$-n $-CONH(CH_2)_3OCH_2CH(C_2H_5)C_4H_9$-n $-CONHC_{16}H_{33}$-n $-CONHCH_2CH(CH_3)CH_2C_{12}H_{25}$-n $-CONH(CH_2CH_2O)_2.\ C_{12}H_{25}$-n $-CONHCH_2CH_2OC_{12}H_{25}$-n

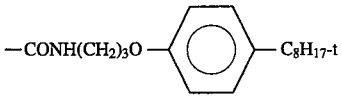

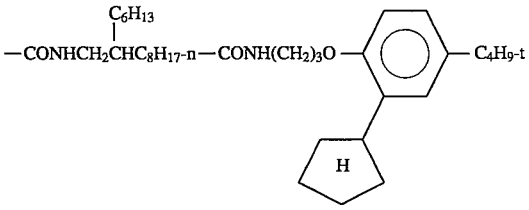

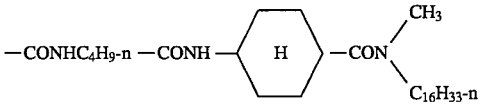

$-CONH(CH_2)_3OC_{14}H_{29}$-n $-CONH(CH_2)_3OC_{11}H_{23}$-n $-SO_2NH(CH_2)_3OC_{12}H_{25}$-n

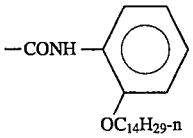

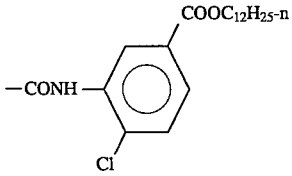

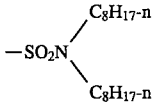

$-NHCO(CH_2)_3O-A$

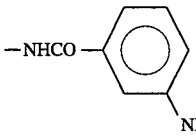

$-NHSO_2C_{16}H_{33}$-n

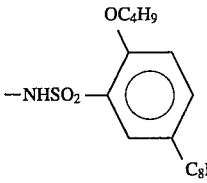

Examples of $R_2$ $-F$ $-Cl$ $-CN$ $-CH_3$ $-CF_3$ $-C_4H_9$-t $-C_8H_{17}$-t $-NHCOCH_3$ $-NHSO_2CH_3$ $-NHCOOC_2H_5$ -continued

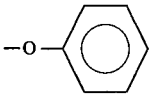

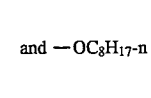

and $-OC_8H_{17}$-n

Examples of $R_3NH-$ $-NHCOCH_3$ $-NHCOCF_3$

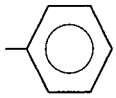

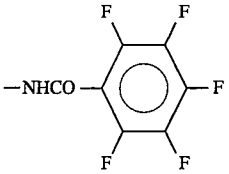

$-NHCOC_4H_9$-t $-NHCO(CH_2)_3O-A$

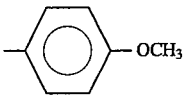

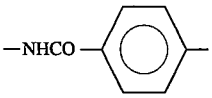

$-NHSO_2CH_3$ $-NHSO_2CF_3$ $-NHSO_2C_4H_9$-n

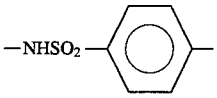

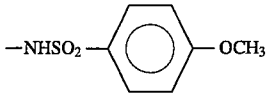

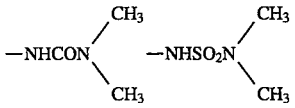

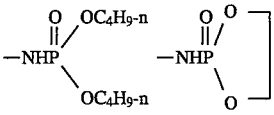

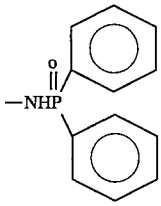

$-NHCOOCH_3$

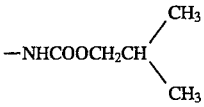

$-NHCOOC_4H_9$-n $-NHCOOCH_2CH_2OCH_3$ $-NHCOOCH_2CH(C_2H_5)C_4H_9$ $-NHCOOC_{12}H_{25}$-n $-NHCOOCH_2CH_2O-A$ $-NHCOCOCH_3$

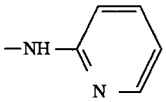

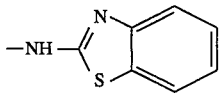

Examples of X $-OC_2H_5$ $-OCH_2CH_2OH$ $-OCH_2CH_2SO_2CH_3$ $-O(CH_2CH_2O)_2H$ $-OCH_2COOH$ $-O(CH_2)_3COOH$ $-OCH_2COOC_2H_5$ -continued $-OCH_2CONHCH_2CH_2OCH_3$ $-OCH_2CH_2SCH_2COOH$ $-OCH_2CH_2S(C_{12}H_{25}\text{-n})CHCOOH$ $-OCH_2CH_2OCH_3$ $-OCH_2CH_2NHSO_2CH_3$

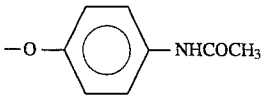

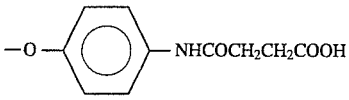

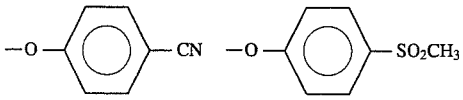

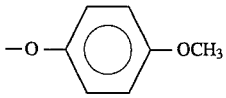

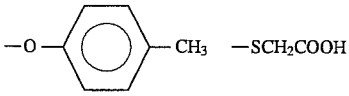

$-SCH_2CH_2COOH$ $-SCH(CH_3)COOH$ $-SCH_2COOC_2H_5$ $-SCH_2CH_2OH$

-continued

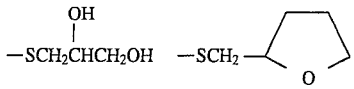

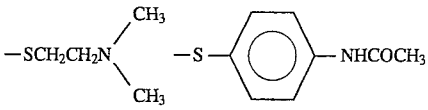

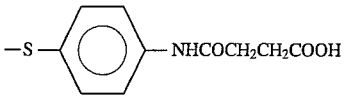

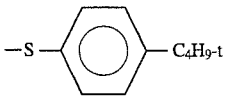

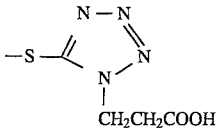

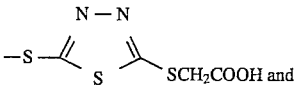

and

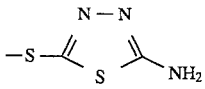

---

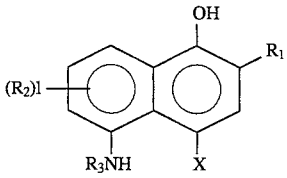

l = 0

| No. | $R_1$ | $R_3$ | X |
|---|---|---|---|
| C-1 | $-CONH(CH_2)_3O-A$ | $CH_3CO-$ | H |
| C-2 | $-CONH(CH_2)_3O-A$ | $CF_3CO-$ | H |
| C-3 | $-CONH(CH_2)_3O-A$ | $CH_3SO_2-$ | H |
| C-4 | $-CONH(CH_2)_3O-A$ | $C_2H_5OCO-$ | H |
| C-5 | $-CONH(CH_2)_4O-A$ | $t\text{-}C_4H_9CO-$ | H |
| C-6 | $-CONH(CH_2)_3O-C_{12}H_{25}\text{-n}$ | $C_2H_5OCO-$ | H |
| C-7 | $-CONH(CH_2)_3O-C_{12}H_{25}\text{-n}$ | $i\text{-}C_4H_9OCO-$ | H |
| C-8 | $-CONH(CH_2)_3OC_{10}H_{21}\text{-n}$ | $i\text{-}C_4H_9OCO-$ | H |
| C-9 | $-CONH(CH_2)_3OC_{10}H_{21}\text{-n}$ | $n\text{-}C_4H_9CH(C_2H_5)CH_2OCO-$ | H |
| C-10 | $-CONH(CH_2)_3O-A$ | $i\text{-}C_4H_9OCO-$ | H |
| C-11 | $-CONH(CH_2)_3O-C_6H_4-C_8H_{17}\text{-t}$ | $i\text{-}C_4H_9OCO-$ | H |
| C-12 | $-CONHCH_2CH(CH_3)CH_2OC_{12}H_{25}\text{-n}$ | $i\text{-}C_4H_9OCO-$ | H |

-continued

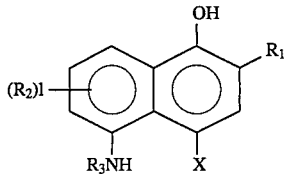

l = 0

| No. | $R_1$ | $R_3$ | X |
|---|---|---|---|
| C-13 | $-CONH(CH_2)_3OCH_2CH(C_2H_5)C_4H_9$ | n-$C_8H_{17}OCO-$ | H |
| C-14 | $-CONH(CH_2)_3O-C_6H_4-C_8H_{17}$-t | n-$C_4H_9SO_2-$ | H |
| C-15 | $-CONH(CH_2)_3OC_{12}H_{25}$-n | $(C_2H_5O)_2P(=O)-$ | H |
| C-16 | $-CONH(CH_2)_3O-A$ | 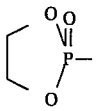 | H |
| C-17 | $-CONHCH_2CH_2OC_{12}H_{25}$-n | i-$C_4H_9OCO-$ | H |
| C-18 | $-CON(CH_3)(C_{16}H_{33}$-n) | $C_2H_5OCO-$ | H |
| C-19 | $-CONHCH_2CH_2OCOC_{11}H_{23}$-n | i-$C_4H_9OCO-$ | H |
| C-20 | $-CONHC_{12}H_{25}$-n | n-$C_4H_9CH(CH_3)CH_2OCO-$ | |
| C-21 | $-SO_2NH(CH_2)_3OC_{12}H_{25}$-n | i-$C_4H_9OCO-$ | H |
| C-22 | $-SO_2N(CH_3)(C_{18}H_{27}$-n) | $C_2H_5OCO-$ | H |
| C-23 | $-CONHCH_2CH(C_6H_{13}$-n$)C_8H_{17}$-n | i-$C_4H_9OCO-$ | H |
| C-24 | $-CONH(CH_3)_3OC_{12}H_{25}$-n | 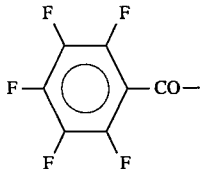 | H |
| C-25 | 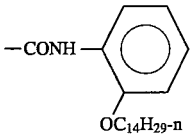 | $CH_3SO_2-$ | H |
| C-26 | 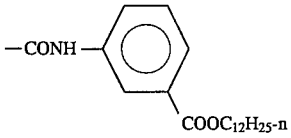 | 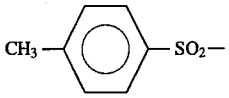 | H |
| C-27 | $-CONH(CH_2)_3OC_{12}H_{25}$-n | i-$C_4H_9OCO-$ | Cl |

-continued

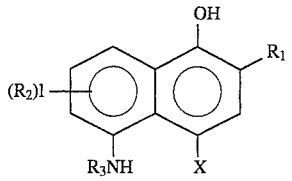

l = 0

| No. | $R_1$ | $R_3$ | X |
|---|---|---|---|
| C-28 | $-CONH(CH_2)_3OC_{12}H_{25}$-n | n-$C_4H_9OCO-$ | Cl |
| C-29 | $-CONH(CH_2)_3OC_{14}H_{29}$-n | t-$C_4H_9OCO-$ | Cl |
| C-30 | $-CONH(CH_2)_3OC_{12}H_{25}$-n | i-$C_4H_9OCO-$ | $-OCH_2CH_2OH$ |
| C-32 | $-CONH(CH_2)_3OC_{12}H_{25}$-n | i-$C_4H_9OCO-$ | $-O(CH_2CH_2O)_2H$ |
| C-33 | $-CONH(CH_2)_3OC_{12}H_{25}$-n | i-$C_4H_9OCO-$ | $-OCH_2CH_2OCH_3$ |
| C-34 | $-CONH(CH_2)_3OC_{12}H_{25}$-n | i-$C_4H_9OCO-$ | $-OCH_2CH_2SCH_2COOH$ |
| C-35 | $-CONHC_4H_9$-n | i-$C_4H_9OCO-$ | $-OCH_2CH_2SCH(COOH)C_{12}H_{25}$-n |
| C-36 | $-CONHCH_2CH(CH_3)CH_2OC_{12}H_{25}$-n | i-$C_4H_9OCO-$ | $-O(CH_2)_3COOH$ |
| C-37 | $-CONH(CH_2)_4O-A$ | i-$C_4H_9OCO-$ | 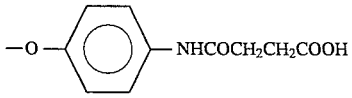 |
| C-38 | $-CONH(CH_2)_3O-A$ | i-$C_4H_9OCO-$ | 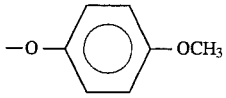 |
| C-39 | 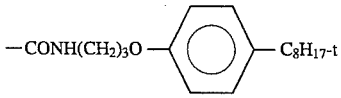 | i-$C_4H_9OCO-$ | $-SCH_2COOH$ |
| C-40 | $-CONH(CH_2)_3OC_{12}H_{25}$-n | i-$C_4H_9OCO-$ | $-SCH_2CH_2COOH$ |
| C-41 | $-CONH(CH_2)_3OC_{12}H_{25}$-n | i-$C_4H_9OCO-$ | $-SCH_2CH_2OH$ |
| C-42 | $-CONH(CH_2)_4O-A$ | $CH_3SO_2-$ | 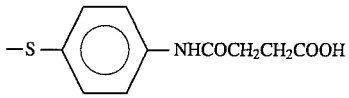 |
| C-43 | $-SO_2NH(CH_2)_3O-A$ | n-$C_4H_9SO_2-$ | $-OCH_2CH_2OH$ |
| C-44 | $-CONHCH_2CH(CH_3)CH_2OC_{12}H_{25}$-n | i-$C_4H_9OCO-$ | $-OCH_2CH_2OH$ |
| C-45 | $-CONH(CH_2CH_2O)C_{12}H_{25}$-n | $(C_2H_5O)_2P(=O)-$ | $-OCH_2CH_2OCH_3$ |
| C-46 | $-CONH(CH_2)_4O-A$ | t-$C_4H_9CO-$ | $-OCH_2COOC_2H_5$ |

Other Couplers

C-47

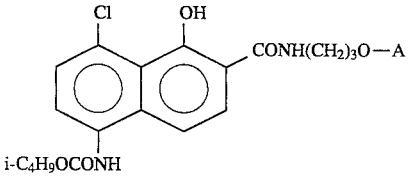

-continued
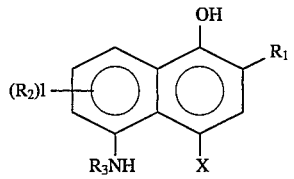
l = 0
| No. | $R_1$ | $R_3$ | X |
|---|---|---|---|
| C-48 | 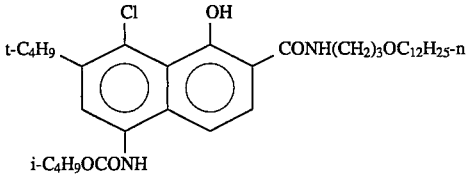 | | |
| C-49 | 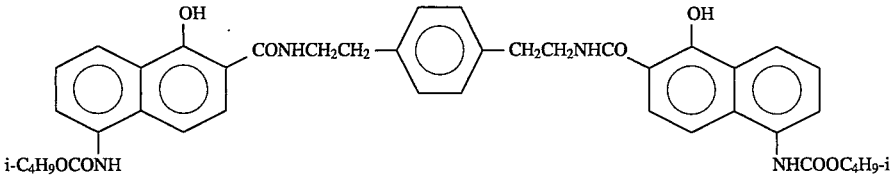 | | |
| C-50 | 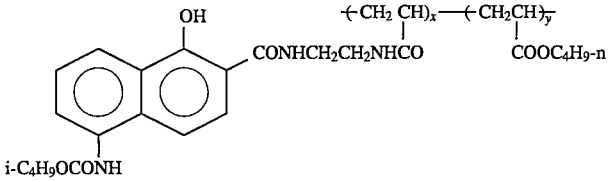 | | |
| C-51 | 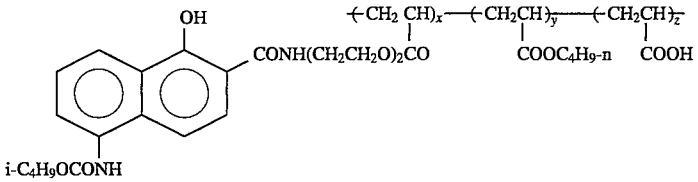 | | |
| C-52 | 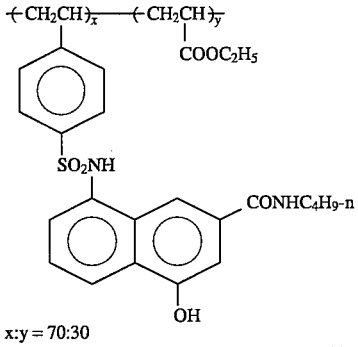 x:y = 70:30<br>Number Average Molecular Weight about 55,000 | | |
In the above formula, A represents a
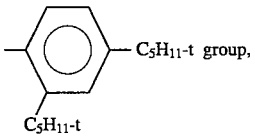
group,
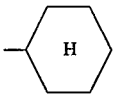
represents a cyclohexyl group,
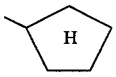

represents a cyclopentyl group, and $C_8H_{17}$-t represents

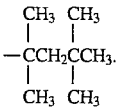

Actual examples of cyan couplers which can be represented by formula [C] other than those aforementioned and/or methods for the preparation of these compounds have been disclosed, for example, in U.S. Pat. No. 4,690,889, JP-A-60-237448, JP-A-61-153640, JP-A-61-145557, JP-A-63-208042, JP-A-64-31159 and West German Patent 3,823,049A.

The cyan couplers which can be represented by formula [C] are used with a small amount of high boiling point organic solvent, and as a result the amount of binder used can be reduced so that it is possible to achieve high photographic speeds and high contrast. Moreover, the processing dependence is slight and the sharpness and the de-silvering properties are improved, which is desirable. From this viewpoint, the amount of high boiling point organic solvent such as that disclosed in JP-A-62-269958, which is to say an amount of not more than 0.3, and preferably not more than 0.1 in weight ratio, with respect to the amount of the cyan coupler can be used.

The total amount of cyan coupler represented by formula [C] which is added is at least 30 mol %, preferably at least 50 mol %, more desirably at least 70 mol %, and most desirably at least 90 mol % of the total amount of cyan coupler.

The use of combinations of two or more cyan couplers which can be represented by formula [C] is desirable, and in those cases where a layer of the same color sensitivity is divided into two or more layers which have different photographic speeds, the use of a two equivalent cyan coupler in the highest speed layer and of a four equivalent cyan coupler in the lowest speed layer is desirable. The use of either type of cyan coupler or of both types of cyan coupler in the other layers which have the same color sensitivity is also desirable.

A photosensitive material of the present invention should have, on a support, at least one blue sensitive silver halide emulsion layer, at least one green sensitive silver halide emulsion layer and at least one red sensitive silver halide emulsion layer, but no particular limitation is imposed upon the number or order of the silver halide emulsion layers and non-photosensitive layers. Typically, a silver halide photographic material has, on a support, at least one photosensitive layer comprised of a plurality of silver halide emulsion layers which have essentially the same color sensitivity but different photographic speeds, the said photosensitive layer being a unit photosensitive layer which is color sensitive to blue light, green light or red light, and in a multi-layer silver halide color photographic material the arrangement of the unit photosensitive layers generally involves their establishment in the order, from the support side, of a red sensitive layer, a green sensitive layer, a blue sensitive layer. However, this order may be reversed, as required, and the layers may be arranged in such a way that a layer which has a different color sensitivity is sandwiched between layers which have the same color sensitivity.

Various non-photosensitive layers, such as intermediate layers, may be established between the above mentioned silver halide photosensitive layers, and as the uppermost and lowermost layers.

The said intermediate layers may contain couplers and DIR compounds such as those disclosed in the specifications of JP-A-61-43748, JP-A-59-113438, JP-A-59-113440, JP-A-61-20037 and JP-A-61-20038, and they may also contain the generally used anti-color mixing compounds.

The plurality of silver halide emulsion layers constituting each unit photosensitive layer is preferably a double layer structure comprised of a high speed emulsion layer and a low speed emulsion layer as disclosed in West German Patent 1,121,470 or British Patent 923,045. Generally, arrangements in which the photographic speed is lower in the layer closer to the support are preferred, and non-photosensitive layers may be established between each of the silver halide emulsion layers. Furthermore, the low speed layers may be arranged on the side furthest away from the support and the high speed layers may be arranged on the side closest to the support as disclosed, for example, in JP-A-57-112751, JP-A-62-200350, JP-A-62-206541 and JP-A-62-206543.

In practical terms, the arrangement may be, from the side furthest from the support as follows: low speed blue sensitive layer (BL)/high speed blue sensitive layer (BH)/high speed green sensitive layer (GH)/low speed green sensitive layer (GL)/high speed red sensitive layer (RH)/low speed red sensitive layer (RL); or BH/BL/GL/GH/RH/RL; or BH/BL/GH/GL/RL/RH.

Furthermore, the layers can be arranged in the order, from the side furthest from the support, of blue sensitive layer/GH/RH/GL/RL as disclosed in JP-B-55-34932. (The term "JP-B" as used herein signifies an "examined Japanese patent publication".) Furthermore, the layers can also be arranged in the order, from the side furthest away from the support, of blue sensitive layer/GL/RL/GH/RH, as disclosed in the specifications of JP-A-56-25738 and JP-A-62-63936.

Furthermore, there are arrangements in which there are three layers which have different speeds with the photosensitivity falling towards the support with the silver halide emulsion layer of the highest photosensitivity at the top, a silver halide emulsion layer which has a lower photosensitivity than the aforementioned layer as an intermediate layer and a silver halide emulsion layer which has a lower photosensitivity than the intermediate layer as a bottom layer, as disclosed in JP-B-49-15495. In the case of structures of this type which have three layers with different photosensitivities, the layers in a layer of the same color sensitivity may be arranged in the order, from the side furthest from the support, of intermediate speed emulsion layer/high speed emulsion layer/low speed emulsion layer, as disclosed in the specification of JP-A-59-202464.

Furthermore, the layers can be arranged in the order high speed emulsion layer/low speed emulsion layer/intermediate speed emulsion layer, or low speed emulsion layer/intermediate speed emulsion layer/high speed emulsion layer for example.

Furthermore, the arrangement may be varied in the ways indicated above in cases where there are four or more layers.

As described above, various layer structures and arrangements can be selected respectively according to the purpose of the photosensitive material.

The preferred silver halides for inclusion in the photographic emulsion layers of a photographic material used in the present invention are silver iodobromides, silver iodochlorides or silver iodochlorobromides which contain not more than about 30 mol % of silver iodide. Most desirably, the silver halide is a silver iodobromide or silver iodochlorobromide which contains from about 2 mol % to about 10 mol % of silver iodide.

The silver halide grains in the photographic emulsion may have a regular crystalline form such as a cubic, octahedral or tetradecahedral form, an irregular crystalline form such as a spherical or plate-like form, a form which has crystal defects such as twinned crystal planes, or a form which is a composite of these forms.

The grain size of the silver halide may be very fine at less that about 0.2 microns, or large with a projected area diameter of up to about 10 microns, and the emulsions may be poly-disperse emulsions or monodisperse emulsions.

Silver halide photographic emulsions which can be used in the present invention can be prepared, for example, using the methods disclosed in *Research Disclosure* (RD) No. 17643 (December, 1978), pages 22–23, "I Emulsion Preparation and Types", *Research Disclosure* No. 18716 (November 1979), page 648, and *Research Disclosure,* No. 307105 (November 1989), pages 863–865, by P. Glafkides in *Chimie et Physique Photographique,* published by Paul Montel, 1967, by G. F. Duffin in *Photographic Emulsion Chemistry,* published by Focal Press, 1966, and by V. L. Zelikmann et al. in *Making and Coating Photographic Emulsions,* published by Focal Press, 1964.

The mono-disperse emulsions disclosed, for example, in U.S. Pat. Nos. 3,574,628 and 3,655,394, and in British Patent 1,413,748, are also desirable.

Furthermore, tabular grains which have an aspect ratio of at least about 3 can also be used in the present invention. Tabular grains can be prepared easily using the methods described, for example, by Gutoff in *Photographic Science and Engineering,* Volume 14, pages 248–257 (1970), and in U.S. Pat. Nos. 4,434,226, 4,414,310, 4,433,048 and 4,439,520, and British Patent 2,112,157.

The crystal structure may be uniform, or the interior and exterior parts of the grains may have different halogen compositions, or the grains may have a layer-like structure and, moreover, silver halides which have different compositions may be joined with an epitaxial junction or they may be joined with compounds other than silver halides, such as silver thiocyanate or lead oxide, for example. Furthermore, mixtures of grains which have various crystalline forms may be used.

The above mentioned emulsions may be of the surface latent image type with which the latent image is formed principally on the surface, the internal latent image type in which the latent image is formed within the grains, or of a type with which the latent image is formed both at the surface and within the grains, but a negative type emulsion is essential. From among the internal latent image types the emulsion may be a core/shell internal latent image type emulsion as disclosed in JP-A-63-264740. A method for the preparation of such a core/shell internal latent image type emulsion has been disclosed in JP-A-59-133542. The thickness of the shell of this emulsion differs according to the development processing for example but is preferably from 3 to 40 nm, and most desirably from 5 to 20 nm.

The silver halide emulsions used have generally been subjected to physical ripening, Chemical ripening and spectral sensitization. Additives which are used in such processes have been disclosed in *Research Disclosure* Nos. 17643, 18716 and 307105, and the locations of these disclosures are summarized in the table provided hereinafter.

Two or more different types of emulsion which differ in terms of at least one of the characteristics of grain size, grain size distribution or halogen composition of the photosensitive silver halide emulsion, the grain form or photographic speed can be used in the form of a mixture in the same layer in a photosensitive material of the present invention.

The use of essentially non-photosensitive hydrophilic colloid layers and/or photosensitive silver halide emulsion layers containing silver halide grains of which the grain surface has been fogged as disclosed in U.S. Pat. No. 4,082,553, silver halide grains of which the grain interior has been fogged as disclosed in U.S. Pat. No. 4,626,498 and JP-A-59-214852 or colloidal silver is desirable. Silver halide grains of which the grain interior or surface has been fogged are silver halide grains which can be developed uniformly (not in the form of the image) irrespective of whether they are in an unexposed part or an exposed part of the photosensitive material. Methods for the preparation of silver halide grains of which the interior or surface of the grains has been fogged have been disclosed in U.S. Pat. No. 4,626,498 and JP-A-59-214852.

The silver halide in which internal nuclei of a core/shell type silver halide grain of which the grain interior has been fogged are formed may have the same halogen composition or a different halogen composition. The silver halide of which the interior or surface of the grains has been fogged may be a silver chloride, a silver chlorobromide, a silver iodobromide or a silver chloroiodobromide. No particular limitation is imposed upon the grain size of these fogged silver halide grains, but an average grain size of from 0.01 to 0.75 μm, and especially of from 0.05 to 0.6 μm, is preferred. Furthermore, no particular limitation is imposed upon the form of the grains and they may be regular grains, and they may be poly-disperse emulsions, but monodisperse emulsions (in which at least 95% in terms of the weight or number of silver halide grains have a grain size within ±40% of the average grain size) are preferred.

The use of non-photosensitive fine grained silver halides is desirable in the present invention. Non-photosensitive fine grained silver halides are fine grained silver halides which are not photosensitive at the time of the imagewise exposure for obtaining the dye image and which undergo essentially no development during development processing, and those which have not been pre-fogged are preferred.

The fine grained silver halide has a silver bromide content from 0 to 100 mol %, containing silver chloride and/or silver iodide as required. Those which have a silver iodide content of from 0.5 to 10 mol % are preferred.

The fine grained silver halide has an average grain size (the average value of the diameters of the circles corresponding to the projected areas) preferably of from 0.01 to 0.5 μm, and most desirably of from 0.02 to 0.2 μm.

The fine grained silver halide can be prepared using the same methods as used in general for the preparation of photosensitive silver halides. In this case, the surface of the silver halide grains does not need to be optically sensitized and neither is there any need for spectral sensitization. However, the preaddition of known stabilizers such as triazole, azaindene, benzothiazolium or mercapto based compounds or zinc compounds before addition to the coating liquid is desirable. Colloidal silver can also be included desirably in the layer which contains these fine grained silver halide grains.

The coated weight of silver in a photosensitive material of the present invention is preferably not more than 6.0 g/m$^2$, and most desirably not more than 4.5 g/m$^2$.

Known photographically useful additives which can be used in the present invention have been disclosed in the three *Research Disclosures* referred to above, and the locations of these disclosures are further indicated in the table below.

| Type of Additive | RD17643 (December 1978) | RD18716 (November 1979) | RD307105 (November 1989) |
|---|---|---|---|
| 1. Chemical Sensitizers | Page 23 | Page 648, right hand column | Page 866 |
| 2. Speed Increasing Agents | | Page 648, right hand column | |
| 3. Spectral Sensitizers, Super-Sensitizers | Pages 23–24 | Page 648 right hand column–page 649 right hand column | Pages 866–868 |
| 4. Bleaching Agents | Page 24 | Page 647, right hand column | Page 868 |
| 5. Anti-foggants, Stabilizers | Pages 24–25 | Page 649, right hand column | Pages 868–870 |
| 6. Light Absorbers, Filter Dyes and Ultraviolet absorbers | Pages 25–26 | Page 649, right hand column–page 650, left hand column | Page 873 |
| 7. Anti-staining Agents | Page 25, right hand column | Page 650, left hand column–right hand column | Page 872 |
| 8. Dye Image Stabilizers | Page 25 | page 650, left hand column | Page 872 |
| 9. Film Hardening Agents | Page 26 | Page 651, left hand column | Pages 874–875 |
| 10. Binders | Page 26 | Page 651, left hand column | Pages 873–874 |
| 11. Plasticizers, Lubricants | Page 27 | Page 650, right hand column | Page 876 |
| 12. Coating promotors Surfactants | Pages 26–27 | Page 650, right hand column | Pages 875–876 |
| 13. Anti-static agents | Page 27 | Page 650, right hand column | Pages 876–877 |
| 14. Matting Agents | | | Pages 878–879 |

Furthermore, the addition of compounds which can react with and fix formaldehyde, as disclosed in U.S. Pat. Nos. 4,411,987 and 4,435,503, to the photosensitive material is desirable for preventing deterioration of photographic performance due to formaldehyde gas.

The inclusion of mercapto compounds such as disclosed in U.S. Pat. Nos. 4,740,454 and 4,788,132, JP-A-62-18539 and JP-A-1-283551 in a photosensitive material of the present invention is also desirable.

The inclusion of compounds which release fogging agents, development accelerators, silver halide solvents or precursors of these materials irrespective of the amount of developed silver produced by development processing (i.e., compounds such as disclosed in JP-A-1-106052) in a photosensitive material of the present invention is also desirable.

The inclusion of the dyes dispersed using the methods disclosed in International Patent laid open WO88/04794 and JP-A-1-502912, and the dyes disclosed in EP 317,308A, U.S. Pat. No. 4,420,555 and JP-A-1-259358 in a photosensitive material of the present invention is desirable.

Various color couplers can be used in the present invention, and actual examples have been disclosed in the patents cited in the aforementioned *Research Disclosure* No. 17643, sections VII-C–G, and No. 307105, sections VII-C–G.

Those disclosed, for example, in U. S. Pat. Nos. 3,933,501, 4,022,620, 4,326,024, 4,401,752 and 4,248,961, JP-B-58-10739, British Patents 1,425,020 and 1,467,760, U.S. Pat. Nos. 3,973,968, 4,314,023 and 4,511,649, and European Patent 249,473A are preferred as yellow couplers.

5-Pyrazolone based compounds and pyrazoloazole based compounds are preferred as magenta couplers, and those disclosed, for example, in U.S. Pat. Nos. 4,310,619 and 4,351,897, European Patent 73,636, U.S. Pat. Nos. 3,061,432 and 3,725,067, *Research Disclosure* No. 24220 (June 1984), JP-A-60-33552, *Research Disclosure* No. 24230 (June 1984), JP-A-60-43659, JP-A-61-72238, JP -A-60-35730, JP-A-55-118034, JP-A-60-185951, U.S. Pat. Nos. 4,500,630, 4,540,654 and 4,556,630, and International Patent WO 88/04795 are especially desirable.

Phenol based and naphthol based couplers can be cited as cyan couplers, and those disclosed, for example, in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Laid Open 3,329,729, European Patents 121,365A and 249,453A, U.S. Pat. Nos. 3,446,622, 4,333,999, 4,775,616, 4,451,559, 4,427,767, 4,690,889, 4,254,212 and 4,296,199, and JP-A-61-42658 are preferred.

Typical examples of polymerized dye forming couplers have been disclosed, for example, in U.S. Pat. Nos. 3,451,820, 4,080,211, 4,367,282, 4,409,320 and 4,576,910, British Patent 2,102,137 and European Patent 341,188A.

The couplers disclosed in U.S. Pat. No. 4,366,237, British Patent 2,125,570, European Patent 96,570 and West German Patent (Laid Open) 3,234,533 are preferred as couplers of which the colored dyes have a suitable degree of diffusibility.

The colored couplers for correcting the unwanted absorptions of colored dyes disclosed, for example, in section VII-G of *Research Disclosure* No. 17643, section VII-G of *Research Disclosure* No. 307105, U.S. Pat. No. 4,163,670, JP-B-57-39413, U.S. Pat. Nos. 4,004,929 and 4,138,258, and British Patent 1,146,368 are preferred. Furthermore, the use of couplers which correct the unwanted absorption of colored dyes by means of fluorescent dyes which are released on coupling as disclosed in U.S. Pat. No. 4,774,181, and couplers which have, as leaving groups, dye precursor groups which can form dyes on reaction with the developing agent as disclosed in U.S. Pat. No. 4,777,120 is also desirable.

The use of couplers which release photographically useful residual groups on coupling is also desirable in the present invention. The DIR couplers which release development inhibitors disclosed in the patents cited in section VII-F of the aforementioned *Research Disclosure* 17643, section VII-F of *Research Disclosure* No. 307105, JP-A-57-151944, JP-A-57-154234, JP-A-60-184248, JP-A-63-37346, JP-A-63-37350 and U.S. Pat. Nos. 4,248,962 and 4,782,012, as well as those represented by general formula (I) of the present invention, are preferred.

The couplers disclosed in British Patents 2,097,140 and 2,131,188, JP-A-59-157638 and JP-A-59-170840 are preferred as couplers which release nucleating agents or development accelerators in the form of the image during development. Furthermore, the compounds which release fogging agents, development accelerators, silver halide solvents etc. by means of a redox reaction with the oxidized form of a developing agent disclosed in JP-A-60-107029, JP-A-60-252340, JP-A-1-44940 and JP-A-1-45687 are also desirable.

Other compounds which can be used in photosensitive materials of the present invention include: the competitive couplers disclosed, for example, in U.S. Pat. No. 4,130,427; the multi-equivalent couplers disclosed, for example, in U.S. Pat. Nos. 4,283,472, 4,338,393 and 4,310,618; the DIR redox compound releasing couplers, DIR coupler releasing couplers, DIR coupler releasing redox compounds or DIR redox releasing redox compounds disclosed, for example, in JP-A-60-185950 and JP-A-62-24252; couplers which release dyes wherein the color is restored after elimination, such as disclosed in European Patents 173,302A and 313, 308A; bleach accelerator releasing couplers disclosed, for example, in *Research Disclosure* No. 11449, ibid, No. 24241, and JP-A-61-201247; ligand releasing couplers disclosed, for example, in U.S. Pat. No. 4,555,477; leuco dye releasing couplers such as disclosed in JP-A-63-75747; and couplers which release fluorescent dyes such as disclosed in U.S. Pat. No. 4,774,181.

The couplers used in the present invention can be introduced into photosensitive materials using a variety of known methods.

Examples of high boiling point solvents which can be used in an oil in water dispersion method have been disclosed, for example, in U.S. Pat. No. 2,322,027.

Actual examples of high boiling point organic solvents which have a boiling point of at least 175° C. at normal pressure which can be used in the oil in water dispersion method include phthalic acid esters (for example, dibutyl phthalate, dicyclohexyl phthalate, di-2-ethylhexyl phthalate, decyl phthalate, bis(2,4-di-tert-amylphenyl)phthalate, bis(2,4-di-tert-amylphenyl)isophthalate and bis(1,1-diethylpropyl)phthalate), phosphoric acid or phosphonic acid esters (for example, triphenyl phosphate, tricresyl phosphate, 2-ethylhexyl diphenyl phosphate, tricyclohexyl phosphate, tri-2-ethylhexyl phosphate, tridodecyl phosphate, tributoxyethyl phosphate, trichloropropyl phosphate and di-2-ethylhexyl phenyl phosphonate), benzoic acid esters (for example, 2-ethylhexyl benzoate, dodecyl benzoate, 2-ethylhexyl p-hydroxybenzoate), amides (for example, N,N-diethyldodecanamide, N,N-diethyllaurylamide and N-tetradecylpyrrolidone), alcohols or phenols (for example, isostearyl alcohol and 2,4-di-tert-amylphenol), aliphatic carboxylic acid esters (for example, bis(2-ethylhexyl)sebacate, dioctyl azelate, glycerol tributyrate, iso-stearyl lactate and trioctyl citrate), aniline derivatives (for example, N,N-dibutyl-2-butoxy-5-tert-octylaniline) and hydrocarbons (for example, paraffins, dodecylbenzene and di-isopropylnaphthalene). Furthermore, organic solvents which have a boiling point above about 30° C., and preferably of at least 50° C., but below about 160° C. can be used as auxiliary solvents, and typical examples of these solvents include ethyl acetate, butyl acetate, ethyl propionate, methyl ethyl ketone, cyclohexanone, 2-ethoxyethyl acetate and dimethylformamide.

The processes and effects of the latex dispersion method and actual examples of latexes for loading purposes have been disclosed, for example, in U.S. Pat. No. 4,199,363, and in West German Patent Applications (OLS) 2,541,274 and 2,541,230.

The addition to the color photosensitive materials of the present invention of various fungicides and biocides such as phenethyl alcohol or 1,2-benzisothiazolin-3-one, n-butyl p-hydroxybenzoate, phenol, 4-chloro-3,5-dimethylphenol, 2-phenoxyethanol and 2-(4-thiazolyl)benzimidazole for example as disclosed in JP-A-63-257747, JP-A-62-,272248 and JP-A-1-80941 is desirable.

The present invention can be applied to a variety of color photosensitive materials. Typical examples include color negative films for general and cinematographic purposes, color reversal films for slides and television purposes, color papers, color positive films and color reversal papers.

Suitable supports which can be used in the present invention have been disclosed, for example, on page 28 of the aforementioned *Research Disclosure* No. 17643, from the right hand column of page 647 to the left hand column of page 648 of *Research Disclosure* No. 18716, and on page 879 of *Research Disclosure* No. 307105

The photosensitive materials of the present invention are such that the total film thickness of all the hydrophilic colloid layers on the side where the emulsion layers are located is preferably not more than 28 μm, more desirably not more than 23 μm, even more desirably not more than 18 μm, and most desirably not more than 16 μm. Furthermore, the film swelling rate $T_{1/2}$ is preferably not more than 30 seconds and most desirably not more than 20 seconds. Here, the film thickness signifies the film thickness measured under conditions of 25° C., 55% relative humidity (2 days) and the film swelling rate $T_{1/2}$ is that measured using the methods well known to those in the industry. For example, measurements can be made using a swellometer of the type described by A. Green in *Photogr. Sci. Eng.*, Volume 19, Number 2, pages 124–129, and $T_{1/2}$ is defined as the time taken to reach half the saturated film thickness, taking 90% of the maximum swelled film thickness reached on processing the material for 3 minutes 15 seconds in a color developer at 30° C. as the saturated film thickness.

The film swelling rate $T_{1/2}$ can be adjusted by adding film hardening agents for the gelatin which is used as a binder, or by changing the ageing conditions after coating. Furthermore, a swelling factor of from 150% to 400% is preferred. The swelling factor can be calculated from the maximum swelled film thickness obtained under the conditions described above using the expression (maximum swelled film thickness minus film thickness)/film thickness.

The establishment of a hydrophilic colloid layer (known as a backing layer) of total dry film thickness from 2 μm to 20 μm on the opposite side from the emulsion layers is desirable in a photosensitive material of the present invention. The inclusion of the aforementioned light absorbing agents, filter dyes, ultraviolet absorbers, anti-static agents, film hardening agents, binders, plasticizers, lubricants, coating promotors and surfactants, for example, in this backing layer is desirable. The swelling factor of the backing layer is preferably from 150% to 500%.

Color photographic materials which are in accordance with the present invention can be developed and processed using the general methods disclosed on pages 28–29 of the aforementioned *Research Disclosure* No. 17643, from the left hand column to the right hand column of page 615 of the aforementioned *Research Disclosure* No. 18716, and on pages 880 to 881 of *Research Disclosure* No. 307105.

The color developers used for the development processing of photosensitive materials of the present invention are preferably aqueous alkaline solutions which contain a primary aromatic amine based color developing agent as the principal component. Aminophenol based compounds are also useful as color developing agents, but the use of p-phenylenediamine based compounds is preferred, and typical examples include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-β-methoxyethylaniline, and the sulfate, hydrochloride and p-toluenesulfonate salts of these compounds. From among these compounds, 3-methyl-4-amino-N-ethyl-N-β-hydroxyethylaniline sulfate is especially desirable. Two or more of these compounds can be used conjointly, according to the intended purpose.

The color developer generally contains pH buffers such as alkali metal carbonates, borates or phosphates, and development inhibitors or anti-foggants such as chloride, bromide, iodide, benzimidazoles, benzothiazoles or mercapto compounds. They may also contain, as required, various preservatives such as hydroxylamine, diethylhydroxylamine, sulfite, hydrazines such as N,N-biscarboxymethylhydrazine, phenylsemicarbazides, triethanolamine and catecholsulfonic acids, organic solvents such as ethylene glycol and diethylene glycol, development accelerators such as benzyl alcohol, polyethylene glycol, quaternary ammonium salts and amines, dye forming couplers, competitive couplers, auxiliary developing agents such as 1-phenyl-3-pyrazolidone, thickeners and various chelating agents as typified by the aminopolycarboxylic acids, aminopolyphosphonic acids, alkylphosphonic acids and phosphonocarboxylic acids, typical examples of which include ethylenediamine tetra-acetic acid, nitrilotriacetic acid, diethylenetriamine penta-acetic acid, cyclohexanediamine tetra-acetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid) and salts of these acids.

Furthermore, color development can be carried out after a normal black and white development in the case of reversal processing. Known black and white developing agents including dihydroxybenzenes such as hydroquinone, 3-pyrazolidones such as 1-phenyl-3-pyrazolidone, and aminophenols such as N-methyl-p-aminophenol, for example, can be used individually, or in combinations, in the black and white developer.

The pH of these color developers and black and white developers is generally from 9 to 12. Furthermore, the replenishment rate for these developers depends on the color photographic material which is being processed but, in general, it is not more than 3 liters per square meter of photosensitive material, and it can be set to not more than 500 ml by reducing the bromide ion concentration in the replenisher. In those cases where the replenishment rate is low it is desirable that evaporation and aerial oxidation of the liquid should be prevented by minimizing the area of contact with the air in the processing tank.

The contact area between the air and the photographic processing bath in a processing tank can be represented by the open factor which is defined below.

$$\text{Open Factor} = \frac{\text{Processing bath and Air Contact Area (cm}^2\text{)}}{\text{Processing Bath Volume (cm}^3\text{)}}$$

The above mentioned open factor is preferably not more than 0.1, and most desirably from 0. 001 to 0.05. Moreover, the establishment of a shielding material such as a floating lid for example on the surface of the photographic processing bath in the processing tank, the method involving the use of a movable lid as disclosed in JP-A-1-82033 and the method involving the slit development processing disclosed in JP-A-63-216050 can be used as means of reducing the open factor. Reduction of the open factor is preferably applied not only to the processes of color development and black and white development but also to all the subsequent processes, such as the bleaching, bleach-fixing, fixing, water washing and stabilizing processes. Furthermore, the replenishment rate can be reduced by using some means of suppressing the accumulation of bromide ion in the development bath.

The color development processing time is generally set between 2 and 5 minutes, but shorter processing times can be devised by increasing the pH or by increasing the concentration of the color developing agent.

The photographic emulsion layer is generally subjected to a bleaching process after color development. The bleaching process may be carried out at the same time as a fixing process (in a bleach-fix process) or it may be carried out separately. Moreover, a bleach-fix process can be carried out after a bleaching process in order to speed up processing. Moreover, processing can be carried out in two connected bleach-fix baths, a fixing process can be carried out before a bleach-fixing process or a bleaching process can be carried out after a bleach-fix process, as required. Compounds of multi-valent metals, such as iron(III) for example, peracids, quinones and nitro compounds can be used as bleaching agents. Typical bleaching agents include organic complex salts of iron(III), for example complex salts with aminopolycarboxylic acids such as ethylenediamine tetraacetic acid, diethylenetriamine penta-acetic acid, cyclohexanediamine tetra-acetic acid, methylimino diacetic acid, 1,3-diaminopropane tetra-acetic acid and glycol ether diamine tetra-acetic acid, or citric acid, tartaric acid or malic acid. From among these materials, the use of polyaminocarboxylic acid iron(III) complex salts, and principally of ethylenediamine tetraacetic acid iron(III) complex salts and 1,3-diaminopropane tetra-acetic acid iron(III) salts, is preferred from the points of view of both rapid processing and the prevention of environmental pollution. Moreover, the aminopolycarboxylic acid iron(III) complex salts are especially useful in both bleach baths and bleach-fix baths. The pH value of the bleach baths and bleach-fix baths in which these aminopolycarboxylic acid iron(III) salts are used is generally from 4.0 to 8, but lower pH values can be used in order to speed up processing.

Bleaching accelerators can be used, as required, in the bleach baths, bleach-fix baths or bleach or bleach-fix prebaths. Actual examples of useful bleach accelerators have been disclosed in the following specifications: Thus, there are the compounds which have a mercapto group or a disulfide group disclosed, for example, in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and *Research Disclosure* No. 17129 (June 1978); the thiazolidine derivatives disclosed in JP-A-50-140129; the thiourea derivatives disclosed in JP-B-45-8506, JP-A-52-20832, JP-A-53-32735 and U.S. Pat. No. 3,706,561, the iodides disclosed in West German Patent 1,127,715 and JP-A-58-16235; the polyoxyethylene compounds disclosed in West German Patents 966,410 and 2,748,430; the polyamine compounds disclosed in JP-B-45-8836; the other compounds disclosed in JP-A-49-40943, JP-A-49-59644, JP-A-53-94927, JP-A-54-35727, JP-A-55-26506 and JP-A-58-163940; and the bromide ion. From among these compounds, those which have a mercapto group or a disulfide group are preferred in view of their large accelerating effect, and the compounds disclosed in U.S. Pat. No. 3,893,858, West German Patent 1,290,812 and JP-A-53-95630 are especially desirable. Moreover, the compounds disclosed in U.S. Pat. No. 4,552,834 are also desirable. These bleaching accelerators may be added to the sensitive materials. These bleaching accelerators are especially effective when bleach-fixing camera color photosensitive materials.

The inclusion of organic acids as well as the compounds indicated above in the bleach baths and bleach-fix baths is desirable for preventing the occurrence of bleach staining. Compounds which have an acid dissociation constant (pKa) of from 2 to 5 are especially desirable for the organic acids, and in practice acetic acid and propionic acid, for example, are preferred.

Thiosulfate, thiocyanate, thioether based compounds, thioureas and large amounts of iodide can be used, for example, as the fixing agent in a fixing bath or bleach-fix bath, but thiosulfate is generally used, and ammonium thiosulfate in particular can be used in the widest range of applications. Furthermore, the conjoint use of thiosulfate and thiocyanate, thioether compounds, thiourea etc. is also desirable. Sulfite, bisulfite, carbonyl/bisulfite addition compounds or the sulfinic acid compounds disclosed in European Patent 294,769A are preferred as preservatives for fixing baths and bleach-fix baths. Moreover, the addition of various aminopolycarboxylic acids and organophosphonic acids to the fixing baths and bleach-fixing baths is desirable for stabilizing these baths.

The addition of compounds of pKa from 6.0 to 9.0, and preferably imidazoles such as imidazole, 1-methylimidazole, 1-ethylimidazole and 2-methylimidazole, in amounts of from 0.1 to 10 mol/liter to the fixing bath or bleach-fixing baths is desirable in the present invention.

A shorter total de-silvering processing time within the range where de-silvering failure does not occur is preferred. The de-silvering time is preferably from 1 to 3 minutes, and most desirably from 1 to 2 minutes. Furthermore, the processing temperature is from 25° C. to 50° C., and preferably from 35° C. to 45° C. The de-silvering rate is improved and the occurrence of staining after processing is effectively prevented within the preferred temperature range.

Agitation as strongly as possible during the de-silvering process is desirable. Actual examples of methods of strong agitation include the methods in which a jet of processing liquid is made to impinge on the emulsion surface of the photosensitive material as disclosed in JP-A-62-183460, the method in which the agitation effect is increased using a rotary device as disclosed in JP-A-62-183461, the method in which the photosensitive material is moved with a wiper blade which is established in the bath in contact with the emulsion surface and the agitation effect is increased by the generation of turbulence at the emulsion surface, and the method in which the circulating flow rate of the processing bath as a whole is increased. These means of increasing agitation are effective in bleach baths, bleach-fix baths and fixing baths. It is thought that increased agitation increases the rate of supply of bleaching agent and fixing agent to the emulsion film and consequently increases the de-silvering rate. Furthermore, the aforementioned means of increasing agitation are more effective in cases where a bleaching accelerator is being used, and they sometimes provide a marked increase in the accelerating effect and eliminate the fixer inhibiting action of the bleaching accelerator.

The automatic processors which are used for photosensitive materials of the present invention preferably have photosensitive material transporting devices as disclosed in JP-A-60-191257, JP-A-60-191258 or JP-A-60-191259. With such a transporting device, such as that disclosed in the aforementioned JP-A-60-191257, the carry-over of processing liquid from one bath to the next is greatly reduced and this is very effective for preventing deterioration in processing bath performance. These effects are especially useful for shortening the processing time in each process and for reducing the replenishment rate of each processing bath.

The silver halide color photographic materials of this invention are generally subjected to a water washing process and/or stabilizing process after the de-silvering process. The amount of wash water used in the washing process can be fixed within a wide range, depending on the application and the nature (depending on the materials such as couplers which have been used for example) of the photosensitive material, the wash water temperature, the number of water washing tanks (the number of water washing stages) and the replenishment system, i.e. whether a counter flow or a sequential flow system is used, and various other conditions. The relationship between the amount of water used and the number of washing tanks in a multi-stage counter-flow system can be obtained using the method outlined on pages 248–253 of the *Journal of the Society of Motion Picture and Television Engineers,* Volume 64 (May 1955).

According to the multistage counterflow system described in the above reference, although the requisite amount of water can be greatly reduced, bacteria still grow due to an increase of the retention time of the water in the tank, and floating masses of bacteria stick to the light-sensitive material. In the present invention, in order to cope with this problem, the method of reducing calcium and magnesium ion concentrations described in JP-A-62-288838 can be used very effectively. Further, it is also effective to use isothiazolone compounds or thiabendazoles (as disclosed in JP-A-57-8542), chlorine type bactericides (e.g., chlorinated sodium isocyanurate, benzotriazole), and bactericides (as described in Hiroshi Horiguchi, *Bokin Bobaizai no Kagaku* (*Chemistry of Bactericidal and Fungicidal Agents*), Sankyo Shuppan (1986); Association of Sanitary Technique (ed.), *Biseibutsu no Mekkin, Sakkin, Bobaigijutsu* (*Bactericidal and Fungicidal Techniques to Microorganisms*), published by Association of Engineering Technology (1982); and Nippon Bactericidal and Fungicidal Association (ed.), *Bokin Bobaizai Jiten* (*Encyclopedia of Bactericidal and Fungicidal Agents*) (1986).

The washing water has a pH value of from 4 to 9, preferably from 5 to 8. The temperature of the water and the washing time can be selected from broad ranges depending on the characteristics and end use of the light-sensitive material, but usually ranges from 15° to 45° C. in temperature and from 20 seconds to 10 minutes in time, preferably from 25° to 40° C. in temperature and from 30 seconds to 5 minutes in time. The light-sensitive material of the present invention may be directly processed with a stabilizer in place of the washing step. For the stabilization, any of the known techniques described in JP-A-59-8543, JP-A-58-14834, and JP-A-60-220345 can be used.

If used, the washing step may be followed by stabilization. For example, a stabilizing bath containing a dye stabilizer and a surface active agent can be used as a final bath for color light-sensitive photographic materials for camera use. Examples of such a dye stabilizer include aldehydes (such as formalin and glutaraldehyde), N-methylol compounds, hexamethylenetetramine, and aldehyde-sulfurous acid adducts.

the stabilizing bath may also contain various chelating agents or bactericids.

The overflow accompanying replenishment of the washing bath and/or stabilizing bath can be reused in other steps such as desilvering.

In processing using an automatic developing machine, if the processing solutions become concentrated due to evaporation, water is preferably supplied to the system to maintain the proper concentration.

Silver halide color light-sensitive material of the present invention may contain a color developing agent for the purpose of simplifying and expediting processing. Such a color developing agent is preferably used in the form of a precursor. Examples of such precursors include indoaniline compounds (as disclosed in U.S. Pat. No. 3,342,597); Shiff's base type compounds (as disclosed in U.S. Pat. No. 3,342, 599, and *Research Disclosure*, Nos. 14850 and 15159); aldol compound (as disclosed in *Research Disclosure*, No. 13924); metal complexes (as disclosed in U.S. Pat. No. 3,719,492); and urethane compounds (as disclosed in JP-A-53-135628).

The silver halide color light-sensitive material of the present invention may optionally comprise various 1-phenyl-3-pyrazolidones for the purpose of accelerating color development. Typical examples of such compounds are disclosed in JP-A-56-64339, JP-A-57-144547, and JP-A-58-115438.

In the present invention the various processing solutions are used at a temperature of from 10° C. to 50° C. The standard temperature range is normally from 33° C. to 38° C. However, a higher temperature range can be used to accelerate processing, thus reducing the processing time. On the contrary, a lower temperature range can be used to improve the picture quality or the stability of the processing solutions. In order to save silver, processing using cobalt intensification or hydrogen peroxide intemsification as disclosed in West German Patent 2,226,770 and U.S. Pat. No. 3,674,499 can be used.

The silver halide photographic material of the present invention can also be used as the heat developable photosensitive materials disclosed, for example, in U.S. Patent 4,500,626, JP-A-60-133449, JP-A-59-218443, JP-A-61-238056 and European Patent 210,660A2.

ILLUSTRATIVE EXAMPLES

The invention is described in detail below by means of illustrative examples, but the invention is not limited by these examples.

EXAMPLE 1

Sample 101, a multi-layer color photosensitive material comprising the layers of the compositions indicated below, was prepared on a cellulose triacetate film support on which an under-layer had been established.

Composition of the Photosensitive Layer

Coated weights are shown in units of grams/m$^2$ as silver in the case of silver halides and colloidal silver, in units of g/m$^2$ in the case of couplers, additives and gelatin, and in units of mol per mol of silver halide in the same layer in the case of the sensitizing dyes. Moreover, the codes used for the additives have the significance indicated below. However, in those cases where a compound has several effects it is listed under just one of these effects.

UV: Ultraviolet absorber, Solv: High boiling point organic solvent, ExF: Dye, ExS: Sensitizing dye, ExC: Cyan coupler, ExM: Magenta coupler, ExY: Yellow coupler, Cpd: Additives.

| First Layer (Anti-halation Layer) | |
|---|---|
| Black colloidal silver | 0.15 |
| Gelatin | 2.33 |
| ExM-6 | 0.11 |
| UV-1 | $3.0 \times 10^{-2}$ |
| UV-2 | $6.0 \times 10^{-2}$ |
| UV-3 | $7.0 \times 10^{-2}$ |
| Solv-1 | 0.16 |
| Solv-2 | 0.10 |
| ExF-1 | $1.0 \times 10^{-2}$ |
| ExF-2 | $4.0 \times 10^{-2}$ |
| ExF-3 | $5.0 \times 10^{-3}$ |
| Cpd-6 | $1.0 \times 10^{-3}$ |
| Second Layer (Low Speed Red Sensitive Emulsion Layer) | |
| Silver iodobromide emulsion (4.0 mol % AgI, uniform AgI type, corresponding sphere diameter 0.4 μm, variation coefficient of the corresponding sphere diameter 30%, plate-like grains, diameter/thickness ratio 3.0) | 0.35 coated weight as silver |
| Silver iodobromide emulsion (6.0 mol % AgI, core/shell ratio 1:2 high internal AgI type, corresponding sphere diameter 0.45 μm, variation coefficient of the corresponding sphere diameter 23%, plate-like grains, diameter/thickness ratio 2.0) | 0.18 coated weight as silver |
| Gelatin | 1.20 |
| ExS-1 | $2.4 \times 10^{-4}$ |
| ExS-2 | $1.4 \times 10^{-4}$ |
| ExS-5 | $2.3 \times 10^{-4}$ |
| ExS-7 | $4.1 \times 10^{-6}$ |
| ExC-1 | 0.17 |
| ExC-2 | $4.0 \times 10^{-2}$ |
| ExC-3 | $2.0 \times 10^{-2}$ |
| HBS-1 | 0.50 |
| Third Layer (Intermediate Speed Red Sensitive Emulsion Layer | |
| Silver iodobromide emulsion (6.0 mol % AgI, core/shell ratio 1:2 high internal AgI type, corresponding sphere diameter 0.65 μm, variation coefficient of the corresponding sphere diameter 23%, plate-like grains, diameter/thickness ratio 2.0) | 0.80 coated weight as silver |
| Gelatin | 2.10 |
| ExS-1 | $2.4 \times 10^{-4}$ |
| ExS-2 | $1.4 \times 10^{-4}$ |
| ExS-5 | $2.4 \times 10^{-4}$ |
| ExS-7 | $4.3 \times 10^{-6}$ |
| ExC-1 | 0.38 |
| ExC-2 | $2.0 \times 10^{-2}$ |
| ExC-3 | 0.040 |
| ExM-7 | $3.0 \times 10^{-2}$ |
| UV-2 | $5.7 \times 10^{-2}$ |
| UV-3 | $5.7 \times 10^{-2}$ |
| HBS-1 | 0.60 |
| Fourth Layer (High Speed Red Sensitive Emulsion Layer) | |
| Silver iodobromide emulsion (9.3 mol % AgI, multi-structure grains of core/shell ratio 3:4:2, AgI content from the inside 24, 0,6 mol · %, corresponding sphere diameter 0.75 μm variation coefficient of the corresponding sphere diameter 23%, plate-like grains, diameter/thickness ratio 2.5) | 1.49 coated weight as silver |
| Gelatin | 1.38 |
| ExS-1 | $2.0 \times 10^{-4}$ |
| ExS-2 | $1.1 \times 10^{-4}$ |
| ExS-5 | $1.9 \times 10^{-4}$ |
| ExS-7 | $1.4 \times 10^{-5}$ |
| ExC-1 | $8.0 \times 10^{-2}$ |
| ExC-4 | $9.0 \times 10^{-2}$ |
| Solv-1 | 0.20 |
| Solv-2 | 0.53 |
| Fifth Layer (Intermediate Layer | |
| Gelatin | 0.62 |
| Cpd-1 | 0.13 |
| Poly(ethyl acrylate) latex | $8.0 \times 10^{-2}$ |
| Solv-1 | $8.0 \times 10^{-2}$ |
| Sixth Layer (Low Speed Green Sensitive Emulsion Layer | |
| Silver iodobromide emulsion | 0.19 |

| | |
|---|---|
| (4.0 mol · % AgI, uniform AgI type, corresponding sphere diameter 0.33 μm, variation coefficient of the corresponding sphere diameter 37%, plate-like grains, diameter/ thickness ratio 2.0) | coated weight as silver |
| Gelatin | 0.44 |
| ExS-3 | $1.5 \times 10^{-4}$ |
| ExS-4 | $4.4 \times 10^{-4}$ |
| ExS-5 | $9.2 \times 10^{-5}$ |
| ExM-5 | 0.17 |
| ExM-7 | $3.0 \times 10^{-2}$ |
| Solv-1 | 0.13 |
| Solv-4 | $1.0 \times 10^{-2}$ |
| Seventh Layer (Intermediate Speed Green Sensitive Emulsion Layer | |
| Silver iodobromide emulsion (4.0 mol % AgI, uniform AgI type, corresponding sphere diameter 0.55 μm, variation coefficient of the corresponding sphere diameter 15%, plate-like grains, diameter/ thickness ratio 4.0) | 0.24 coated weight as silver |
| Gelatin | 0.54 |
| ExS-3 | $2.1 \times 10^{-4}$ |
| ExS-4 | $6.3 \times 10^{-4}$ |
| ExS-5 | $1.3 \times 10^{-5}$ |
| ExM-5 | 0.15 |
| ExM-7 | $4.0 \times 10^{-2}$ |
| ExY-8 | $3.0 \times 10^{-2}$ |
| Solv-1 | 0.13 |
| Solv-4 | $1.0 \times 10^{-2}$ |
| Eighth Layer (High Speed Green Sensitive Emulsion Layer) | |
| Silver iodobromide emulsion (8.8 mol % AgI, multi-structure grains of silver amount ratio 3:4:2, AgI content from the inside 24, 0,3 mol %, corresponding sphere diameter 0.75 μm variation coefficient of the corresponding sphere diameter 23%, plate-like grains, diameter/ thickness ratio 1.6) | 0.49 coated weight as silver |
| Gelatin | 0.61 |
| ExS-4 | $4.3 \times 10^{-4}$ |
| ExS-5 | $8.6 \times 10^{-5}$ |
| ExS-8 | $2.8 \times 10^{-5}$ |
| ExM-5 | $8.0 \times 10^{-2}$ |
| ExM-6 | $3.0 \times 10^{-2}$ |
| ExY-8 | $3.0 \times 10^{-2}$ |
| ExC-1 | $1.0 \times 10^{-2}$ |
| ExC-4 | $1.0 \times 10^{-2}$ |
| Solv-1 | 0.23 |
| Solv-2 | $5.0 \times 10^{-2}$ |
| Solv-4 | $1.0 \times 10^{-2}$ |
| Cpd-8 | $1.0 \times 10^{-2}$ |
| Ninth Layer (Intermediate Layer | |
| Gelatin | 0.56 |
| Cpd-1 | $4.0 \times 10^{-2}$ |
| Poly(ethylene acrylate) latex | $5.0 \times 10^{-2}$ |
| Solv-1 | $3.0 \times 10^{-2}$ |
| UV-4 | $3.0 \times 10^{-2}$ |
| UV-5 | $4.0 \times 10^{-2}$ |
| Tenth Layer (Donor Layer of the Interimage Effect for the Red Sensitive Layer) | |
| Silver iodobromide emulsion (8.0 mol % AgI, high internal AgI type of core/shell ratio 1:2, corresponding sphere diameter 0.65 μm, variation coefficient of the corresponding sphere diameter 25%, plate-like grains, diameter/ thickness ratio 2.0) | 0.67 coated weight as silver |
| Silver iodobromide emulsion (4.0 mol % AgI, uniform AgI type, corresponding sphere diameter 0.4 μm, variation coefficient of the corresponding sphere diameter 30%, plate-like grains, diameter/ thickness ratio 3.0) | 0.20 coated weight as silver |
| Gelatin | 0.87 |
| ExS-3 | $6.7 \times 10^{-4}$ |
| ExM-10 | 0.16 |
| Solv-1 | 0.30 |
| Solv-6 | $3.0 \times 10^{-2}$ |
| Eleventh Layer (Yellow Filter Layer) | |
| Yellow colloidal silver | $9.0 \times 10^{-2}$ |
| Gelatin | 0.84 |
| Cpd-2 | 0.13 |
| Solv-1 | 0.13 |
| Cpd-1 | $8.0 \times 10^{-2}$ |
| Cpd-6 | $2.0 \times 10^{-3}$ |
| H-1 | 0.25 |
| Twelfth Layer (Low Speed Green Sensitive Emulsion Layer | |
| Silver iodobromide emulsion (4.5 mol % AgI, uniform AgI type, corresponding sphere diameter 0.7 μm, variation coefficient of the corresponding sphere diameter 15%, plate-like grains, diameter/ thickness ratio 7.0) | 0.50 coated weight as silver |
| Silver iodobromide emulsion (3.0 mol % AgI, uniform AgI type, corresponding sphere diameter 0.3 μm, variation coefficient of the corresponding sphere diameter 30%, plate-like grains, diameter/ thickness ratio 7.0) | 0.30 coated weight as silver |
| Gelatin | 3.10 |
| ExS-6 | $9.0 \times 10^{-4}$ |
| ExC-1 | 0.14 |
| ExY-9 | 0.17 |
| ExY-11 | 1.60 |
| Solv-1 | 0.54 |
| Thirteenth Layer (Intermediate Layer | |
| Gelatin | 0.40 |
| ExY-12 | 0.19 |
| Solv-1 | 0.19 |
| Fourteenth Layer High Speed Blue Sensitive Emulsion layer | |
| Silver iodobromide emulsion (10.0 mol % AgI, high internal AgI type, corresponding sphere diameter 1.0 μm, variation coefficient of the corresponding sphere diameter 25%, Multiple twinned crystal plate-like grains, diameter/thickness ratio 2.0) | 0.40 coated weight as silver |
| Gelatin | 0.49 |
| ExS-6 | $2.6 \times 10^{-4}$ |
| ExY-9 | $1.0 \times 10^{-2}$ |
| ExY-11 | 0.20 |
| ExC-1 | $1.0 \times 10^{-2}$ |
| Solv-1 | $9.0 \times 10^{-2}$ |
| Fifteenth Layer (First Protective Layer | |
| Fine grained silver iodobromide emulsion (2.0 mol % AgI, uniform AgI type, corresponding sphere diameter 0.07 μm) | 0.12 coated weight as silver |
| Gelatin | 0.63 |
| UV-4 | 0.11 |
| UV-5 | 0.18 |
| Solv-5 | $2.0 \times 10^{-2}$ |
| Cpd-5 | 0.10 |
| Poly(ethyl acrylate) latex | $9.0 \times 10^{-2}$ |
| Sixteenth Layer (Second Protective Layer) | |
| Fine grained silver iodobromide emulsion (2.0 mol % AgI, uniform AgI type, corresponding sphere | 0.36 coated weight as silver |

-continued

| | |
|---|---|
| diameter 0.07 μm) | |
| Gelatin | 0.85 |
| B-1 (diameter 1.5 μm) | $8.0 \times 10^{-2}$ |
| B-2 (diameter 1.5 μm) | $8.0 \times 10^{-2}$ |
| B-3 | $2.0 \times 10^{-2}$ |
| W-4 | $2.0 \times 10^{-2}$ |
| H-1 | 0.18 |

Apart from the above, 1,2-benzisothiazolin-3-one (average 200 ppm with respect to the gelatin), n-butyl p-hydroxybenzoate (1,000 ppm with respect to the gelatin) and 2-phenoxyethanol (10,000 ppm with respect to the gelatin) were added to the sample prepared in this way. Moreover, B-4, B-5, F-1, F-2, F-3, F-4, F-5, F-6, F-7, F-8, F-9, F-10, F-11, F-12, F-13 and iron salts, lead salts, gold salts, platinum salts, iridium salts and rhodium salts were included.

Apart for the components indicated above, the surfactants W-1, W-2 and W-3 were added to each layer as coating aids and emulsification and dispersing agents.

Samples 102–104

Samples 102–104 were prepared by replacing ExC-2 in sample 101 with a 0.4 times molar amount of ExC-13 and compounds (19) and (20) of the present invention.

Samples 105–116

Samples 105–116 were prepared by replacing the ExY-9, ExM-10 and ExY-12 in samples 101–104 with equimolar amounts of other DIR couplers as shown in table 1.

Sample 117

Sample 117 was prepared by replacing the ExC-1 in the second layer of sample 116 with an equimolar amount of the preferred cyan coupler C-7/C-10 (1/1 mol ratio) of the present invention, eliminating the HBS-1 and reducing the gelatin content from 1.20 g/m$^2$ to 0.77 g/m$^2$, by replacing the ExC-1 in the third layer with a 1 mixture of C-7/C-10, eliminating the HBS-1 and reducing the gelatin content from 2.1 g/m$^2$ to 1.45 g/m$^2$, and by replacing the ExC-1 in the fourth layer with an equimolar amount of C-7 and the ExC-4 with an equimolar amount of the preferred coupler C-32 which can be used in the present invention.

Sample 118

Sample 118 was prepared by replacing the 1.60 g/m$^2$ of ExY-9 in the twelfth layer of sample 117 with 1.09 g/m$^2$ of the preferred yellow coupler (Y-3) which can be used in the present invention, reducing the gelatin content from 3.10 g/m$^2$ to 2.15 g/m$^2$, and by replacing the 0.30 g/m$^2$ of ExY-11 in the fourteenth layer to 0.20 g/m$^2$ of (Y-3).

The relative speeds on color processing as described hereinafter of the blue photosensitive layers, the green photosensitive layers and the red photosensitive layers of samples 117 and 118 were the same as those of sample 116. Furthermore, there was virtually no difference between the scratch strengths with a sapphire needle (of diameter 0.05 mm) of these samples, and the film strengths and photographic performances were confirmed as being almost identical.

Furthermore, the samples where subjected to a red image-wise exposure and then to a uniform green exposure such that the magenta density on development as indicated hereinafter of the red unexposed part of sample 101 was 1.0 and the samples were then developed. The value obtained on subtracting the magenta density at the cyan fog density point from the magenta density at the point which gave a cyan density of 2.0 was obtained as the degree of color turbidity.

Furthermore, samples were subjected to a green image-wise exposure and then to a uniform red exposure in such a way that the cyan density on color development as described hereinafter of the green unexposed part of sample 101 was 0.8 and then the samples were developed.

Furthermore, samples were subjected to a white image wise exposure and the relative speeds were obtained from the logarithms of the reciprocals of the exposures required to provide cyan densities of (fog+0.2). Gamma values were obtained as the slope of the straight line joining the point which gave a magenta density of (fog+0.2) and the point which gave a magenta density of (fog+1.2).

Furthermore, the sharpness of these samples was obtained using the normal MTF method. The results obtained are shown in table 1.

Samples 101–118 were cut into strips of width 35 mm and finished as 135 size 36 exposure films which were fitted into cassettes. Pictures of a gray chart of reflectance 18% were then taken under ISO 100 conditions using a single lens reflex camera using each frame and a running processing was carried out using an automatic processor as described hereinafter.

The photographic speed, MTF and degree of color turbidity were measured on development using fresh parent baths and the photographic speed and gamma values were also obtained after running for 10 days with the development of one hundred 36-exposure films per day with each sample.

A cine type automatic processor was used with the development processes and processing bath compositions indicated below.

Processing Operations

| Process | Processing Time | Processing Temp. | Replenishment Rate* | Tank Capacity |
|---|---|---|---|---|
| Color development | 3 min. 15 sec. | 38.0° C. | 23 ml | 15 liters |
| Bleach | 50 seconds | 38.0° C. | 5 ml | 5 liters |
| Bleach-fix | 50 seconds | 38.0° C. | — | 5 liters |
| Fix | 50 seconds | 38.0° C. | 16 ml | 5 liters |
| Water Wash (1) | 30 seconds | 38.0° C. | — | 3 liters |
| Water Wash (2) | 20 seconds | 38.0° C. | 34 ml | 3 liters |
| Stabilization | 20 seconds | 38.0° C. | 20 ml | 3 liters |
| Drying | 1 minute | 55° C. | | |

*Replenishment rate per meter of 35 mm wide material

The water washing process involved a counter- flow system from (2) to (1) and all the overflow from the water washing process was introduced into the fixing bath. Replenishment of the bleach-fix bath was achieved with a connection by means of a pipe between the top of the bleach tank and the bottom of the bleach-fix tank of the automatic processor and a connection by means of a pipe between the top of the fixer tank and the bottom of the bleach-fix tank with all of the overflow produced on replenishing the bleach tank and the fixer tank being introduced into the bleach-fix bath. Moreover, the carry-over of developer into the bleaching process, the carry-over of bleach into the bleach-fix process, the carry-over of bleach-fixer into the fixing process and the carry-over of fixer into the water washing process were 2.5 ml, 2.0 ml, 2.0 ml and 2.0 ml, per meter length of photosensitive material of width 35 mm respectively. Furthermore, in each case the cross-over time was 5 seconds, and this time is included in the processing time of the previous process. Each processing bath was provided with a means such that a jet flow of each processing fluid was made to impinge on the emulsion surface of the sensitive material with the method disclosed in JP-A-62-183460.

The composition of each processing bath is indicated below.

| | Parent Bath (grams) | Replenisher (grams) |
|---|---|---|
| Color Development Bath | | |
| Diethylenetriamine penta-acetic acid | 2.0 | 2.2 |
| 1-Hydroxyethylidene-1,1-diphosphonic acid | 3.3 | 3.3 |
| Sodium sulfite | 3.9 | 5.2 |
| Potassium carbonate | 37.5 | 39.0 |
| Potassium bromide | 1.4 | 0.4 |
| Potassium iodide | 1.3 mg | — |
| Hydroxylamine sulfate | 2.4 | 3.3 |
| 2-Methyl-4-[N-ethyl-N-(β-hydroxyethyl)amino] aniline sulfate | 4.5 | 6.1 |
| Water to make up to | 1.0 liter | 1.0 liter |
| pH | 10.05 | 10.15 |
| Bleach Bath | | |
| 1,3-Propylenediamine tetra-acetic acid, ferric ammonium salt, mono-hydrate | 144.0 | 206.0 |
| Ammonium bromide | 84.0 | 120.0 |
| Ammonium nitrate | 17.5 | 25.0 |
| Hydroxyacetic acid | 63.0 | 90.0 |
| Acetic acid | 33.2 | 47.4 |
| Water to make up to | 1.0 liter | 1.0 liter |
| pH (adjusted with aqueous ammonia) | 3.20 | 2.80 |
| Bleach-Fixer Parent Bath | | |
| A mixture (15:85) of the bleach parent bath indicated above and the fixer parent bath indicated below. | | |
| Fixer Bath | | |
| Ammonium sulfite | 19.0 | 57.0 |
| Aqueous ammonium thiosulfate solution (700 g/l) | 280 ml | 840 ml |
| Imidazole | 28.5 | 85.5 |
| Ethylene diamine tetra-acetic acid | 12.5 | 37.5 |
| Water to make up to | 1.0 liter | 1.0 liter |
| pH (Adjusted with aqueous ammonia and acetic acid) | 7.40 | 7.45 |

Town water was passed through a mixed bed type column which had be packed with an H-type strongly acidic cation exchange resin ("Amberlite IR-120B", made by the Rohm and Haas Co.) and an OH-type strongly basic anion exchange resin ("Amberlite IRA-400", made by the same company) and treated in such a way that the calcium and magnesium ion concentrations were not more than 3 mg/ml, after which 20 mg/l of sodium isocyanurate dichloride and 150 mg/l of sodium sulfate were added. The pH of this solution was within the range from 6.5 to 7.5.

| Stabilizing Bath Parent Bath = Replenisher | (Units: Grams) |
|---|---|
| Formalin (37%) | 2.0 ml |
| Polyoxyethylene p-monononylphenyl ether (average degree of polymerization 10) | 0.3 |

It is clear from table 1 that the samples of the present invention had excellent sharpness as represented by the MTF and excellent color reproduction as represented by the degree of color turbidity, and that there was little change in photographic performance on carrying out continuous processing. The effect was especially pronounced in those cases where preferred cyan couplers and yellow couplers which can be used in the present invention were used.

TABLE 1

| Sample | DIR Coupler | | | Development Inhibitor, Releasing Compound | Before Continuous Processing: MTF Cyan image, 25 cycles/mm | Degree of Color Turbidity | Relative Speed | Gamma | After Continuous Processing: Change in Relative Speed | Change in Gamma |
|---|---|---|---|---|---|---|---|---|---|---|
| 101 (Comparative Example) | ExY-9 | ExM-10 | ExY-12 | ExC-2 | 57 | 0.03 | 0.00 | 0.60 | +0.02 | +0.04 |
| 102 (Comparative Example) | ExY-9 | ExM-10 | ExY-12 | ExC-13 | 58 | 0.01 | −0.01 | 0.59 | +0.02 | +0.04 |
| 103 (Comparative Example) | ExY-9 | ExM-10 | ExY-12 | (19) | 59 | −0.01 | −0.01 | 0.60 | +0.04 | +0.07 |
| 104 (Comparative Example) | ExY-9 | ExM-10 | ExY-12 | (20) | 59 | −0.01 | −0.01 | 0.60 | +0.04 | +0.07 |
| 105 (Comparative Example) | ExY-14 | ExM-10 | ExY-15 | ExC-2 | 57 | 0.03 | 0.00 | 0.60 | +0.02 | +0.04 |
| 106 (Comparative Example) | ExY-14 | ExM-10 | ExY-15 | ExC-13 | 58 | 0.01 | −0.01 | 0.59 | +0.03 | +0.05 |
| 107 (Comparative Example) | ExY-14 | ExM-10 | ExY-15 | (19) | 59 | −0.01 | −0.01 | 0.60 | +0.04 | +0.07 |
| 108 (Comparative Example) | ExY-14 | ExM-10 | ExY-15 | (20) | 59 | −0.01 | −0.01 | 0.60 | +0.04 | +0.07 |
| 109 | D-14 | D-22 | D-1 | ExC-2 | 63 | 0.00 | 0.01 | 0.60 | −0.03 | −0.03 |

TABLE 1-continued

| Sample | DIR Coupler | | | Development Inhibitor, Releasing Compound | Before Continuous Processing: MTF Cyan image, 25 cycles/mm | Before Continuous Processing: Degree of Color Turbidity | Before Continuous Processing: Relative Speed | Before Continuous Processing: Gamma | After Continuous Processing: Change in Relative Speed | After Continuous Processing: Change in Gamma |
|---|---|---|---|---|---|---|---|---|---|---|
| (Comparative Example) 110 | D-14 | D-22 | D-1 | ExC-13 | 64 | −0.02 | 0.00 | 0.59 | −0.02 | −0.03 |
| (Comparative Example) 111 | D-14 | D-22 | D-1 | (19) | 68 | −0.08 | 0.00 | 0.60 | 0.00 | −0.01 |
| (This Invention) 112 | D-14 | D-22 | D-1 | (20) | 68 | −0.08 | 0.00 | 0.60 | +0.01 | 0.00 |
| (This Invention) 113 | D-15 | D-24 | D-6 | ExC-2 | 63 | 0.00 | 0.01 | 0.60 | −0.02 | −0.02 |
| (Comparative Example) 114 | D-15 | D-24 | D-6 | ExC-13 | 64 | −0.01 | 0.00 | 0.59 | −0.02 | −0.02 |
| (Comparative Example) 115 | D-15 | D-24 | D-6 | (19) | 67 | −0.07 | 0.00 | 0.60 | 0.00 | 0.00 |
| (This Invention) 116 | D-15 | D-24 | D-6 | (20) | 68 | −0.08 | 0.00 | 0.60 | +0.01 | +0.01 |
| (This Invention) 117 | D-15 | D-24 | D-6 | (20) | 70 | −0.10 | 0.00 | 0.60 | 0.00 | 0.00 |
| (This Invention) 118 | D-15 | D-24 | D-6 | (20) | 72 | −0.10 | 0.01 | 0.61 | 0.00 | 0.00 |
| (This Invention) | | | | | | | | | | |

EXAMPLE 2

Sample 201 was prepared by replacing the D-15 of the present invention in sample 118 with a three times molar amount of comparative coupler ExY-16, replacing the D-6 with an equimolar amount of ExY-16 and replacing the D-24 with an equimolar amount of ExM-10.

Samples 202–212 were prepared by changing the DIR compounds in sample 201 as shown in table 2.

These samples were exposed and then, after being left to stand for 14 days at 40° C., 80% relative humidity, their photographic properties were evaluated using the parent baths before the running test of example 1. The evaluation was carried out in the same way as in example 1.

It is clear from table 2 that the samples of the present invention had excellent sharpness and color reproduction, that the change in photographic performance was slight even on storage under severe conditions after exposure and prior to development, and that they had excellent continuous processing suitability.

TABLE 2

| Sample | Development: Inhibitor Releasing Compound: 14th and 12th Layers | 10th Layer | 13th Layer | 2nd and 3rd Layers | Before Continuous Processing: MTF Value, Cyan image, 25 cylces/mm | Degree of Color Turbidity | Relative Speed | Gamma | Change After 14 Days at 40° C., 80% RH: Relative Speed | Gamma | Change After Continuous Processing: Relative Speed | Gamma |
|---|---|---|---|---|---|---|---|---|---|---|---|---|
| 201 (Comparative Example) | ExY-16 | ExM-10 | ExY-16 | (20) | 65 | −0.04 | 0.00 | 0.61 | −0.01 | −0.01 | +0.05 | +0.06 |
| 202 (Comparative Example) | ExY-16 | ExM-10 | ExY-17 | (20) | 65 | −0.03 | +0.01 | 0.61 | −0.07 | −0.02 | +0.04 | +0.05 |
| 203 (This Invention) | D-1 | D-38 | D-14 | (20) | 72 | −0.10 | −0.01 | 0.62 | −0.01 | −0.01 | +0.01 | +0.01 |
| 204 (This In- | D-6 | D-38 | D-14 | (20) | 72 | −0.09 | 0.00 | 0.61 | 0.00 | −0.01 | 0.00 | +0.01 |

TABLE 2-continued

| | Development | | | | Before Continuous Processing | | | | Change After | | Change After | |
|---|---|---|---|---|---|---|---|---|---|---|---|---|
| | Inhibitor Releasing Compound | | | | | Degree | | | 14 Days at | | Continuous | |
| | 14th and | | | 2nd and | MTF Value, | of | Rela- | | 40° C., 80% RH | | Processing | |
| Sample | 12th Layers | 10th Layer | 13th Layer | 3rd Layers | Cyan image, 25 cylces/mm | Color Turbidity | tive Speed | Gamma | Relative Speed | Gamma | Relative Speed | Gamma |
| vention) | | | | | | | | | | | | |
| 205 (This Invention) | D-8 | D-38 | D-14 | (20) | 72 | −0.09 | 0.00 | 0.61 | 0.00 | 0.00 | 0.00 | +0.01 |
| 206 (This Invention) | D-9 | D-38 | D-14 | (20) | 71 | −0.09 | 0.00 | 0.61 | −0.01 | −0.01 | +0.01 | +0.01 |
| 207 (This Invention) | D-17 | D-38 | D-14 | (20) | 72 | −0.09 | −0.01 | 0.62 | −0.01 | 0.00 | +0.01 | 0.00 |
| 208 (This Invention) | D-1 | D-22 | D-14 | (20) | 72 | −0.10 | −0.01 | 0.62 | 0.00 | −0.01 | +0.01 | +0.01 |
| 209 (This Invention) | D-1 | D-23 | D-14 | (20) | 71 | −0.09 | 0.00 | 0.61 | −0.01 | −0.01 | 0.01 | +0.01 |
| 210 (This Invention) | D-1 | D-24 | D-14 | (20) | 72 | −0.10 | −0.01 | 0.61 | −0.01 | −0.01 | +0.01 | +0.01 |
| 211 (This Invention) | D-1 | D-24 | (22) | (20) | 73 | −0.08 | 0.01 | 0.62 | +0.01 | 0.00 | −0.01 | −0.01 |
| 212 (This Invention) | D-1 | D-24 | (23) | (20) | 73 | −0.08 | 0.01 | 0.62 | +0.01 | 0.00 | −0.01 | 0.00 |

EXAMPLE 3

On replacing the ExC-2 in sample 311 of JP-A-2-28637 with an equimolar amount of a DIR coupler (D-28) of the present invention, replacing the ExY-2 with a 0.7 time molar amount of the coupler (D-19) of the present invention and replacing the ExM-2 with a 0.7 time molar amount of compound (12) of the present invention and carrying out an evaluation in the same way as in example 2, good performance was obtained in respect of sharpness, color reproduction and continuous processability.

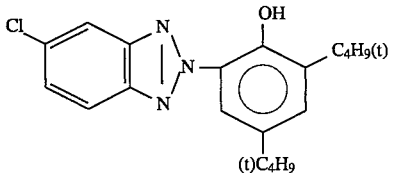

UV-1

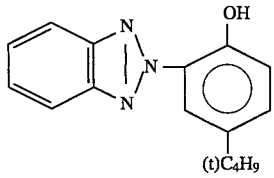

UV-2

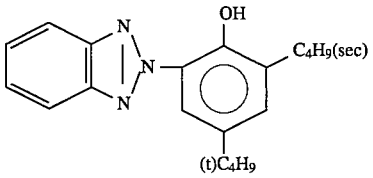

UV-3

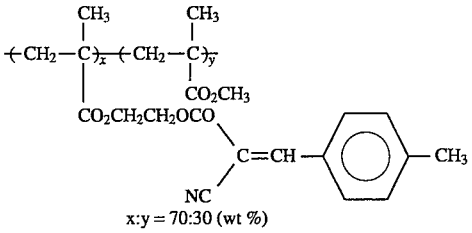

UV-4

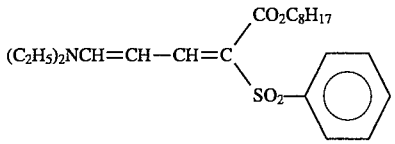

UV-5

Tricresyl Phosphate

Solv-1

Dibutyl Phthalate

Solv-2

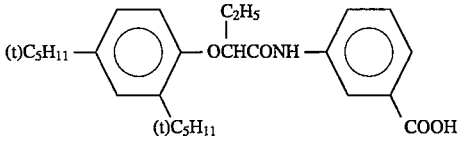

Solv-4

-continued
Trihexyl Phosphate
Solv-5
Solv-6
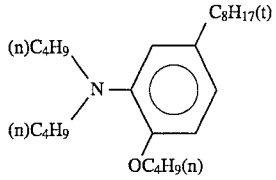
ExF-1
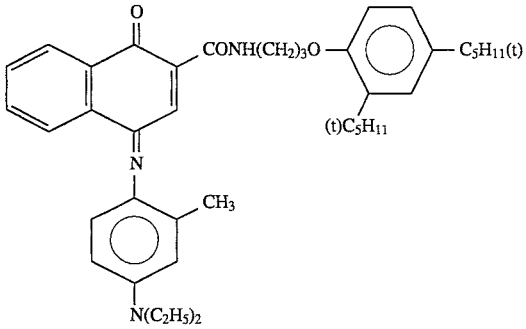
ExF-2
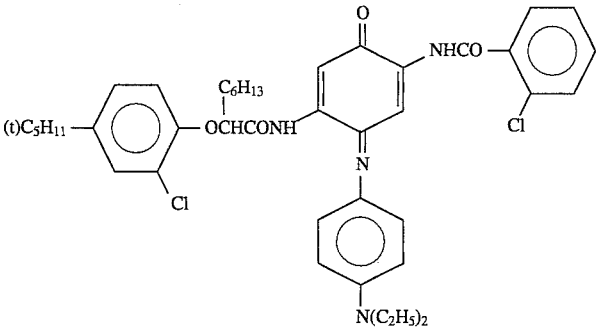
ExF-3
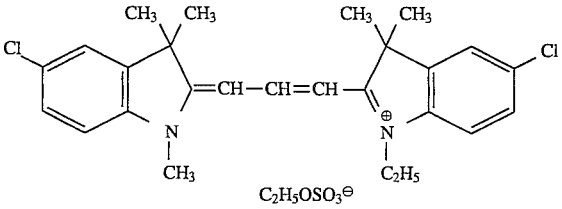
ExC-1
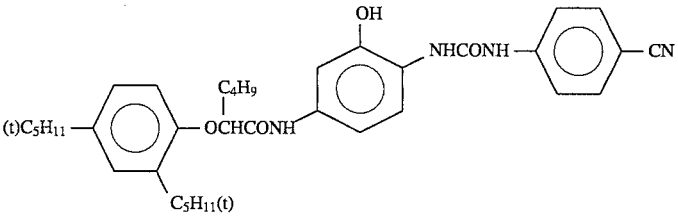
((13) of JP-A-61-255342)
ExC-2
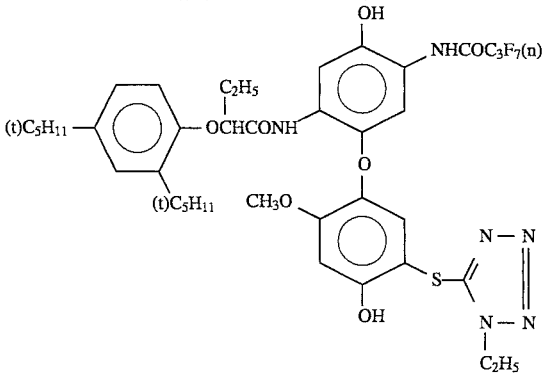

-continued
ExC-3
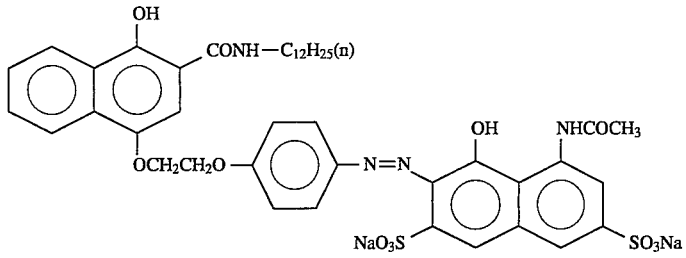
ExC-4
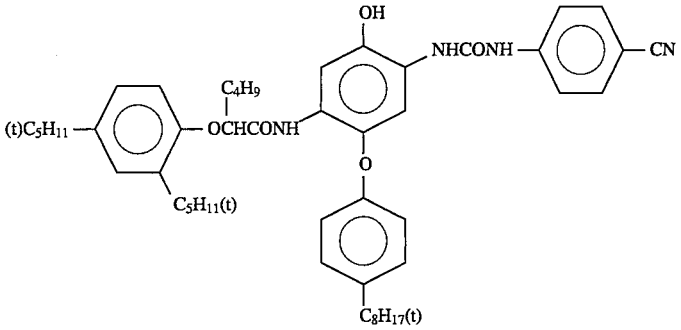
ExM-5
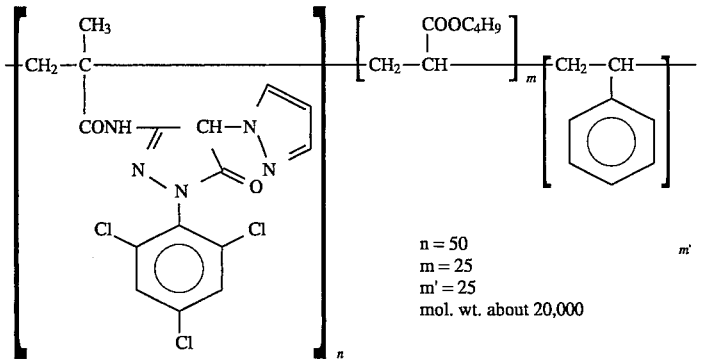
ExM-6
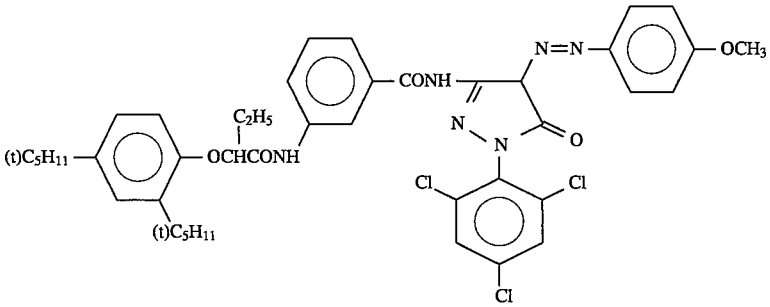
ExM-7
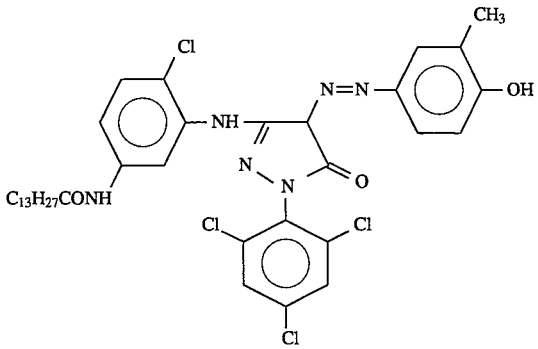
((107) of JP-A-61-255342, (D-28) of JP-A-1-259359) ExM-10

-continued
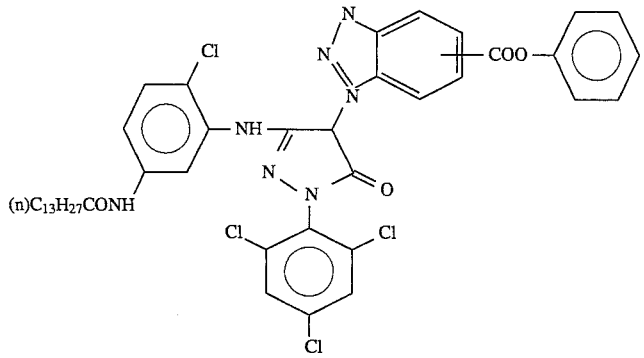
((107) of JP-A-61-255342 and (D-41) of JP-A-1-28637) EXY-8
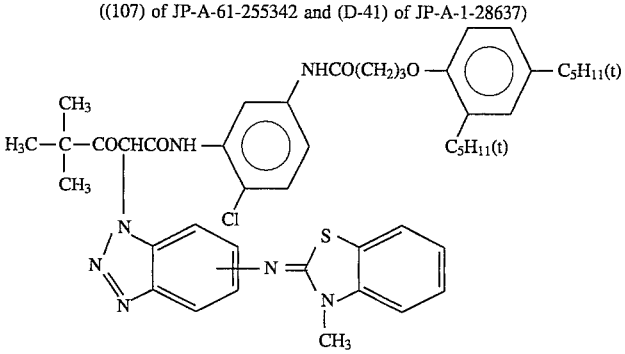
((D-14) of JP-A-1-259359, (D-14) of JP-A-1-269935, (D-14) of JP-A-2-28637, (49) of U.S. Pat. No. 4,477,563) ExY-9
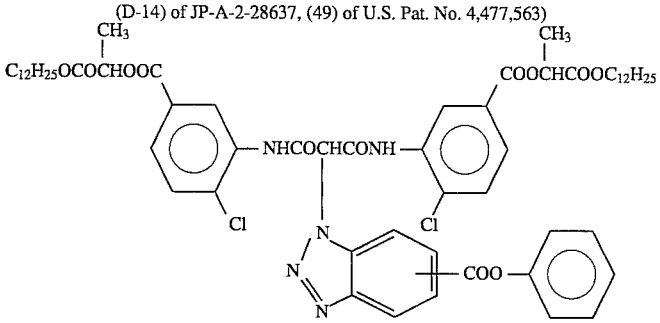
ExY-11
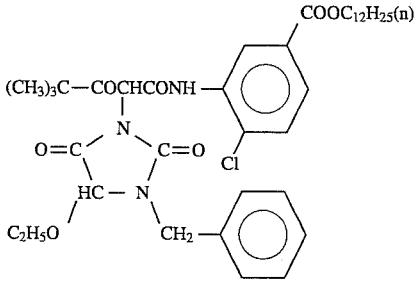
((D-12) of JP-A-1-269935, (D-12) of JP-A-1-259359, (D-12) of JP-A-2-28637) ExY-12
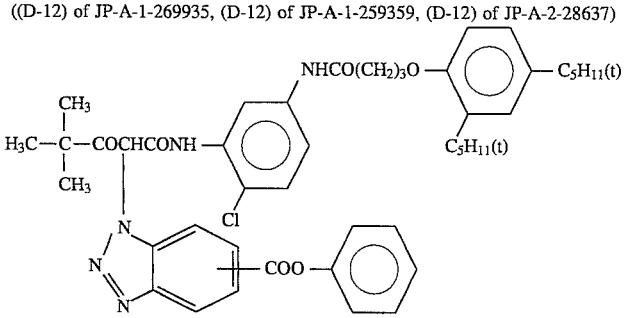

-continued
ExC-13
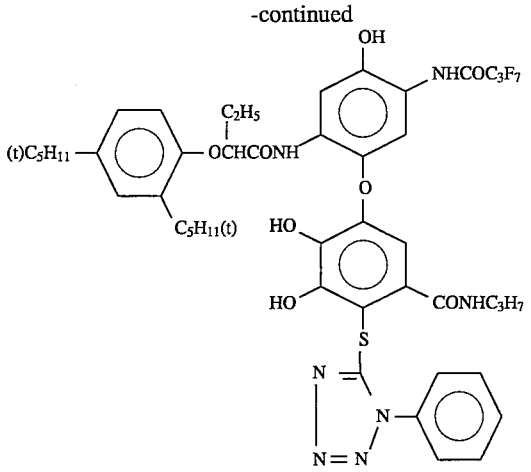
((102) of JP-A-61-255342)
ExY-14
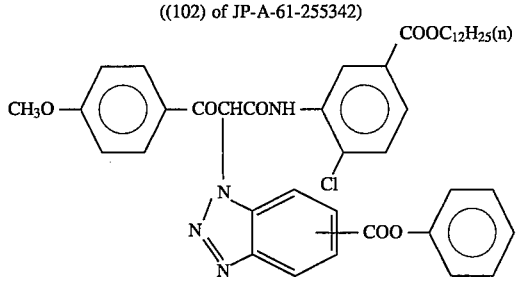
((126) of JP-A-61-255342)
ExY-15
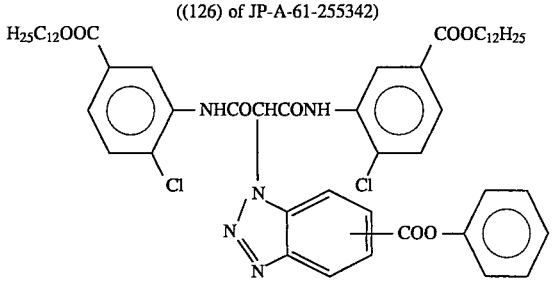
(Compound (27) of U.S. Pat. No. 4,782,012)
ExY-16
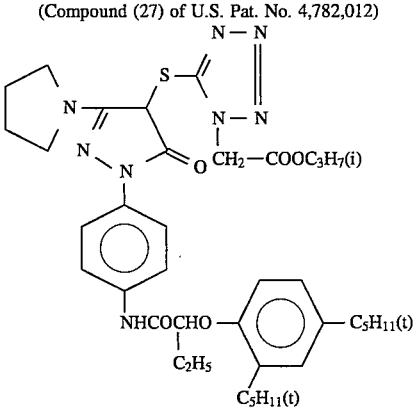
(Compound (9) of JP-A-1-280755)
ExY-17

-continued
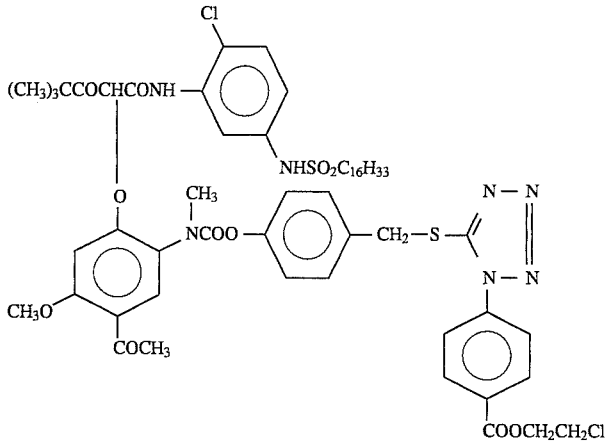
Cpd-1
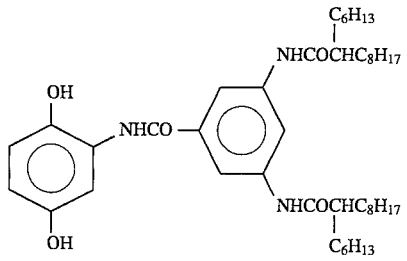
Cpd-2
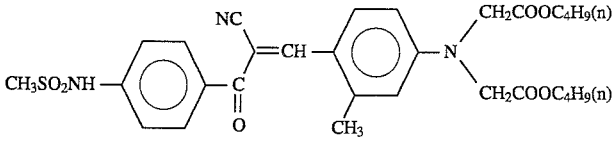
Cpd-5
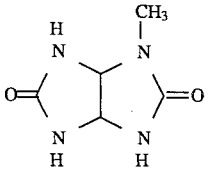
Cpd-6
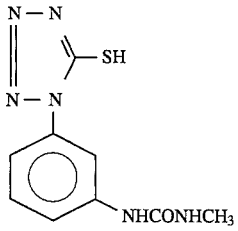
Cpd-8
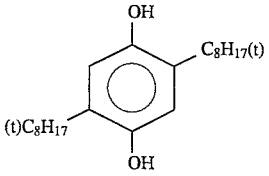
H-1
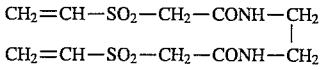
W-1
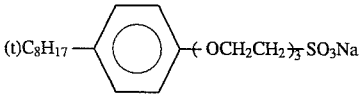
W-2
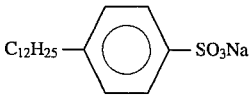
W-3
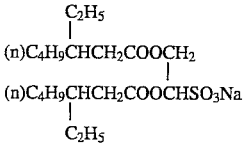
W-4
$C_8F_{17}SO_2N(C_3H_7)CH_2COOK$ -continued
ExS-1
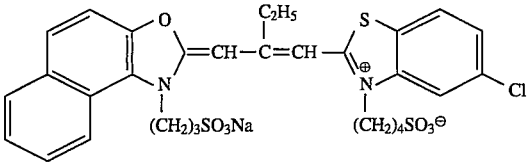
ExS-2
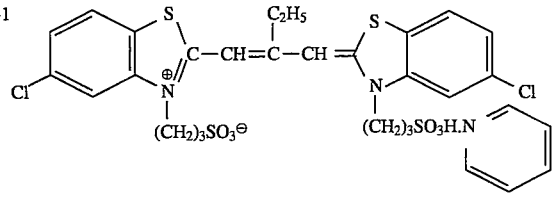
ExS-3
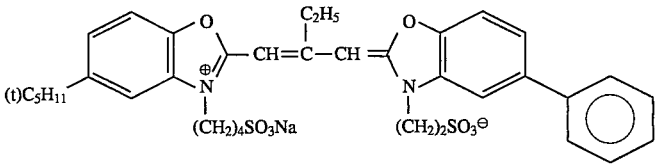
ExS-4
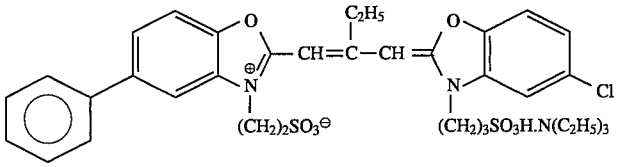
ExS-5
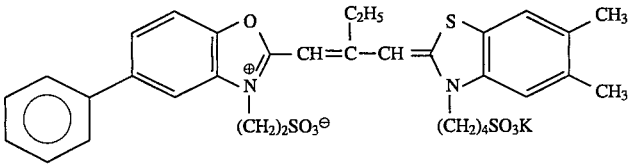
ExS-6
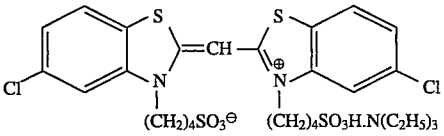
ExS-7
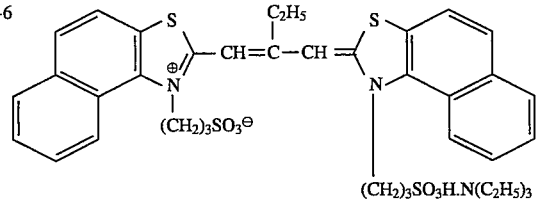
ExS-8
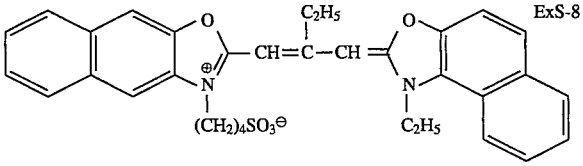
F-1
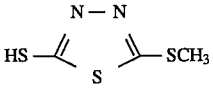
F-2
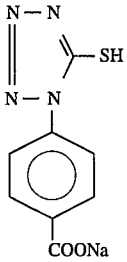
F-3
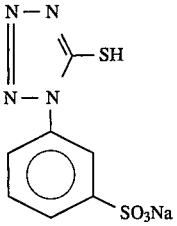
F-4
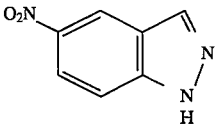
F-5
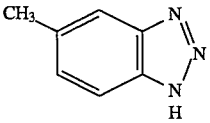
F-6
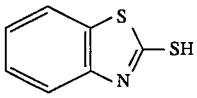
F-7
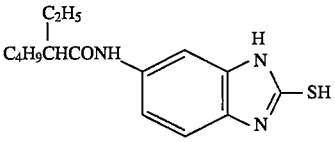

-continued

F-8

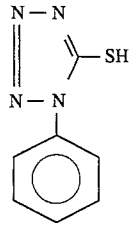

F-9

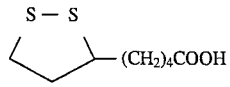

F-10

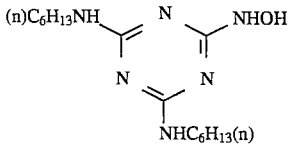

F-11

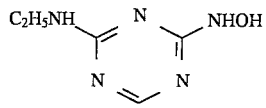

F-12

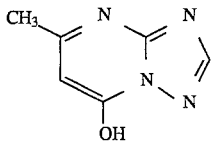

F-13

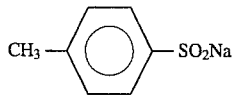

B-1

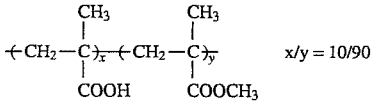

x/y = 10/90

B-2

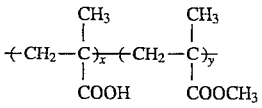

x/y = 40/60

B-3

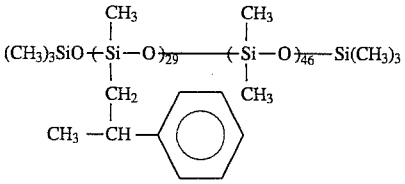

B-4

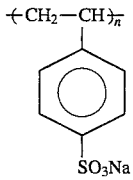

B-5

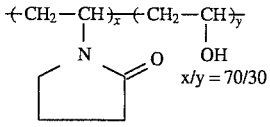

x/y = 70/30

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one photosensitive emulsion layer comprising a DIR coupler that is represented by Formula (I) below and a compound that is represented by Formula (R-I) below;

Formula (I)

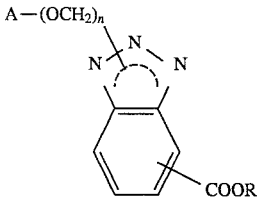

wherein,

A represents a coupler residual group, n represents an integer of 0 or 1, provided that (i) when A represents a phenol type or naphthol type coupler residual group then n is 1 and (ii) when A represents some other coupler residual group then n is 0, and R represents an alkyl group that has from 1 to 4 carbon atoms or a pyridyl group, and wherein the DIR coupler of Formula (I) is present in the emulsion layer in an amount of $3\times10^{-7}$ to $1\times10^{-3}$ mol/m$^2$;

$$A\text{-}(L_1)_v\text{-}B\text{-}(L_2)_w\text{-INH-HYD} \qquad \text{Formula (R-I)}$$

wherein,

A represents a group that reacts with the oxidized form of a developing agent and cleaves $(L_1)_v$-B-$(L_2)_w$-INH-HYD, $L_1$ represents a group that cleaves the bond with B after cleavage of the bond with A, B is a group that reduces the oxidized form of a developing agent or undergoes a coupling reaction with the oxidized form of a developing agent, produces essentially colorless compounds, cleaves $(L_2)_w$-INH-HYD, and is selected from the group consisting of:

(B-21)

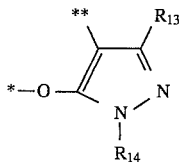

(B-22)

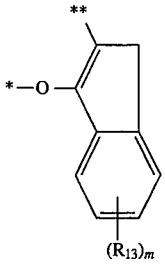

(B-23)

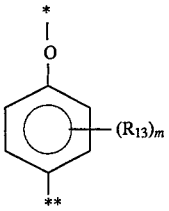

(B-1)

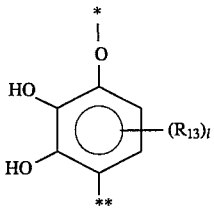

(B-2)

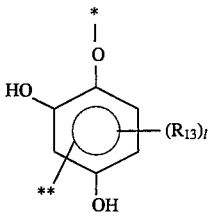

(B-3)

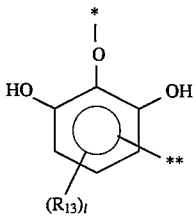

(B-4)

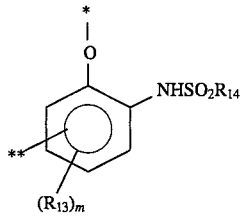

(B-5)

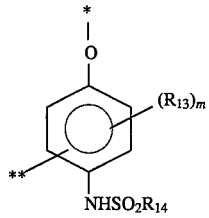

(B-6)

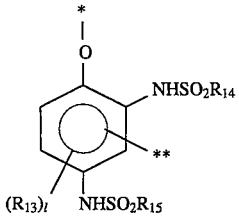

(B-7)

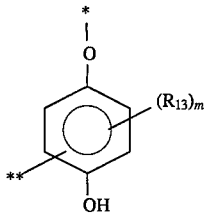

(B-8)

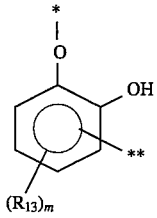

(B-9)

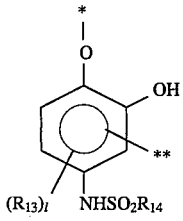

(B-10)

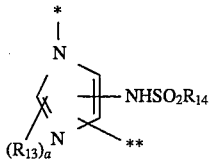

wherein,

* denotes the position which is bonded to A-$(L_1)_v$, ** denotes the position which is bonded to $(L_2)_w$-INH-HYD, $R_{13}$ is a substitutent group, $R_{14}$ and $R_{15}$ are the same or different and are selected from the group consisting of an aliphatic group, an aromatic group and a heterocyclic group, l represents an integer of from 0 to 2, m represents an integer of from 0 to 3, and the letter "a" represents an integer of 0 or 1, $L_2$ represents a group that cleaves INH-HYD after cleavage of the bond with B, INH represents a group that has a development inhibiting capacity, HYD represents an alkoxycarbonyl group or a group that contains an alkoxycarbonyl group, v and w each represent an integer having a value of from 0 to 2, and when they each represent 2, the two $L_1$ and the two $L_2$ groups may be the same or different, and wherein the DIR coupler of Formula (R-I) is present in the emulsion layer in an amount of $1\times10^{-6}$ to $1\times10^{-3}$ mol/$m^2$.

2. The silver halide color photographic material as claimed in claim 1, wherein the coupler residual group A in Formula (I) is:

a yellow coupler residual group of an open chain ketomethylene type; a magenta coupler residual group of a 5-pyrazolone type, a pyrazoloimidazole type or pyrazolotriazole type; a cyan coupler residual group of a phenol type or a naphthol type; a non-color forming coupler residual group of an indanone type or an acetophenone type; or a coupler residual group of a heterocyclic type.

3. The silver halide color photographic material as claimed in claim 1, wherein the coupler residual group A in Formula (I) is selected from the group consisting of:

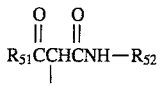

Formula (Cp-1)

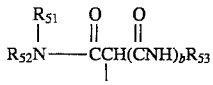

Formula (Cp-2)

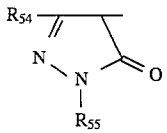

Formula (Cp-3)

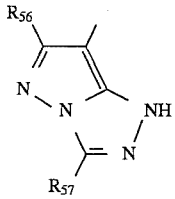

Formula (Cp-4)

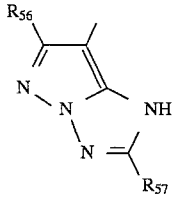

Formula (Cp-5)

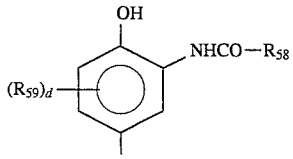

Formula (Cp-6)

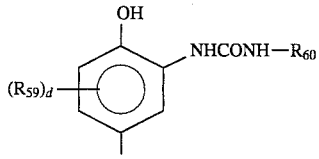

Formula (Cp-7)

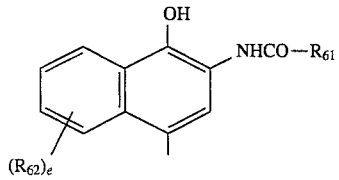

Formula (Cp-8)

-continued

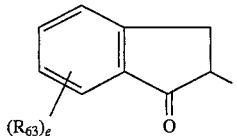

Formula (Cp-9)

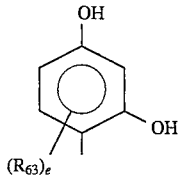

Formula (Cp-10)

wherein:

$R_{41}$ is an aliphatic group, an aromatic group or a heterocyclic group, $R_{42}$ is an aromatic group or a heterocyclic group; and $R_{43}$, $R_{44}$ and $R_{45}$, same or different, are hydrogen atoms, aliphatic groups, aromatic groups or heterocyclic groups;

$R_{51}$ is a group of the same significance as $R_{41}$; b is 0 or 1; $R_{52}$ and $R_{53}$, same or different, each is a group of the same significance as $R_{42}$; $R_{54}$ is a group of the same significance as $R_{41}$, or is an $R_{41}CON(R_{43})$— group, an $R_{41}N(R_{43})$— group, an $R_{41}SO_2N(R_{43})$— group, an $R_{41}S$— group, an $R_{43}O$— group, an $R_{45}N(R_{43})CON(R_{44})$— group or an N≡C— group; $R_{55}$ is a group of the same significance as $R_{41}$; $R_{56}$ and $R_{57}$, same or different, each is a group of the same significance as $R_{43}$, or is an $R_{41}S$— group, an $R_{43}O$— group, an $R_{41}CON(R_{43})$— group or an $R_{41}SO_2N(R_{43})$— group;

$R_{58}$ is a group of the same significance as $R_{41}$;

$R_{59}$ is a group of the same significance as $R_{41}$, or is an $R_{41}CON(R_{43})$— group, an $R_{41}OCON(R_{43})$— group, an $R_{41}SO_2N(R_{43})$— group, an $R_{43}N(R_{44})CON(R_{45})$— group, an $R_{41}O$— group, an $R_{41}S$— group, a halogen atom or an $R_{41}N(R_{43})$— group, d is an integer from 0 to 3 and when d is 2 or 3 the plural $R_{59}$ substituent groups may be the same or different, or may be divalent groups which join together to form a ring structure selected from

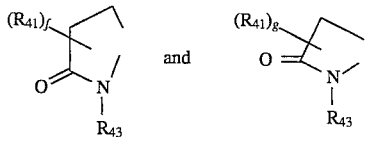

wherein f is an integer from 0 to 4 and g is an integer of value from 0 to 2;

$R_{60}$ is a group of the same significance as $R_{41}$; $R_{61}$ is a group of the same significance as $R_{41}$; $R_{62}$ is a group of the same significance as $R_{41}$, or is an $R_{41}OCONH$— group, an $R_{41}SO_2NH$— group, an $R_{43}N(R_{44})CON(R_{45})$— group, an $R_{43}N(R_{44})SO_2N(R_{45})$— group, an $R_{43}O$— group, an $R_{41}S$— group, a halogen atom or an $R_{41}N(R_{43})$— group; and $R_{63}$ is a group of the same significance as $R_{41}$, or is an $R_{43}N(R_{44})CON(R_{45})$— group, an $R_{43}N(R_{44})CO$— group, an $R_{41}SO_2N(R_{44})$— group, an $R_{43}N(R_{44})SO_2$— group, an $R_{41}SO_2$— group, an $R_{43}OCO$— group, an $R_{43}O—SO_2$— group, a halogen atom, a nitro group, a cyano group or an $R_{43}CO$— group; e is an integer of value from 0 to 4; or optionally $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$ and $R_{63}$, same or different, may be a nondiffusible group wherein the total number of carbon atoms therein is from 9 to 40; or optionally when A in Formula (I) is a bis, telomeric or polymeric type coupler residual group then $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$ and $R_{63}$, same or different, may be a divalent group which links repeating units of the coupler together.

4. The silver halide color photographic material as claimed in claim 3, wherein:

the aliphatic groups, same or different, are selected from saturated or unsaturated, chain like or cyclic, linear chain or branched, substituted or unsubstituted aliphatic hydrocarbyl groups which have from 1 to 32 carbon atoms;

the aromatic groups, same or different, are selected from substituted or unsubstituted naphthyl groups and substituted or unsubstituted phenyl groups having from 6 to 20 carbon atoms; and the heterocyclic groups, same or different, are selected from 3 to 8 member substituted or unsubstituted heterocyclic groups, which have from 1 to 20 carbon atoms and wherein the hetero atoms in the heterocyclic ring are nitrogen, oxygen or sulfur atoms.

5. The silver halide color photographic material as claimed in claim 1, wherein R is:

a straight or branched chain alkyl group having 1 to 4 carbon atoms;

a straight or branched chain alkyl group having 1 to 4 carbon atoms, which is substituted by one or more groups selected from an alkoxycarbonyl group having from 2 to 6 carbon atoms, a carbamoyl group having from 0 to 6 carbon atoms, a halogen atom, a nitro group, a cyan group, an alkoxy group having from 1 to 4 carbon atoms, a sulfamoyl group having from 0 to 6 carbon atoms, an aryloxy group having from 6 to 10 carbon atoms, an acyl group having from 2 to 6 carbon atoms, a sulfonyl group having from 1 to 6 carbon atoms, a 3 to 6-membered heterocyclic group having from 1 to 5 carbon atoms with the hetero atoms thereof selected from nitrogen, oxygen and sulfur atoms, or a phosphoryl group having from 2 to 5 carbon atoms;

a 2-pyridyl, 3-pyridyl or 4-pyridyl group; or a 2-pyridyl, 3-pyridyl or 4-pyridyl group substituted by one or more aliphatic groups having from 1 to 6 carbon atoms.

6. The silver halide color photographic material as claimed in claim 1, wherein A in Formula (R-I) is a coupler residual group for use in color photography or a coupler residual group which can undergo oxidation or reduction.

7. The silver halide color photographic material as claimed in claim 1, wherein A in Formula (R-I) is:

a yellow coupler residual group of an open chain ketomethylene type; a magenta coupler residual group of a 5-pyrazolone type, a pyrazoloimidazole type or a pyrazolotriazole type; a cyan coupler residual group of a phenol type or a naphthol type; a non-color forming coupler residual group of an indanone type or an acetophenone type; or a coupler residual group of the heterocyclic type.

8. The silver halide color photographic material as claimed in claim 1, wherein A in Formula (R-I) is a coupler residual group selected from the group consisting of:

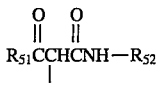
Formula (Cp-1)

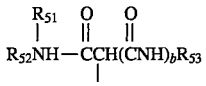
Formula (Cp-2)

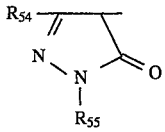
Formula (Cp-3)

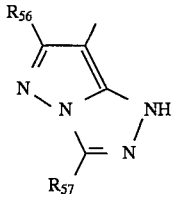
Formula (Cp-4)

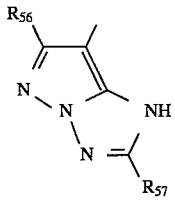
Formula (Cp-5)

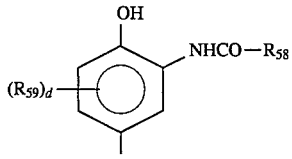
Formula (Cp-6)

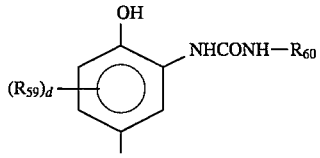
Formula (Cp-7)

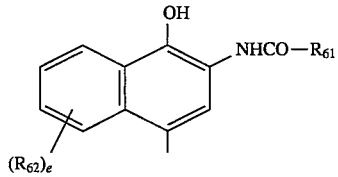
Formula (Cp-8)

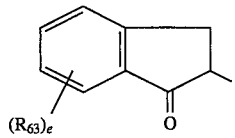
Formula (Cp-9)

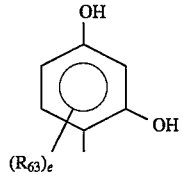
Formula (Cp-10)

wherein:

$R_{41}$ is an aliphatic group, an aromatic group or a heterocyclic group, $R_{42}$ is an aromatic group or a heterocyclic group; and $R_{43}$, $R_{44}$ and $R_{45}$, same or different, are hydrogen atoms, aliphatic groups, aromatic groups or heterocyclic groups;

$R_{51}$ is a group of the same significance as $R_{41}$; b is 0 or 1; $R_{52}$ and $R_{53}$, same or different, each is a group of the same significance as $R_{42}$; $R_{54}$ is a group of the same significance as $R_{41}$, or is an $R_{41}CON(R_{43})$— group, an $R_{41}N(R_{43})$— group, an $R_{41}SO_2N(R_{43})$— group, an $R_{41}S$— group, an $R_{43}O$— group, an $R_{45}N(R_{43})CON(R_{44})$— group or an N≡C— group; $R_{55}$ is a group of the same significance as $R_{41}$; $R_{56}$ and $R_{57}$, same or different, each is a group of the same significance as $R_{43}$, or is an $R_{41}S$— group, an $R_{43}O$— group, an $R_{41}CON(R_{43})$— group or an $R_{41}SO_2N(R_{43})$— group;

$R_{58}$ is a group of the same significance as $R_{41}$;

$R_{59}$ is a group of the same significance as $R_{41}$, or is an $R_{41}CON(R_{43})$— group, an $R_{41}OCON(R_{43})$— group, an $R_{41}SO_2N(R_{43})$— group, an $R_{43}N(R_{44})CON(R_{45})$— group, an $R_{41}O$— group, an $R_{41}S$— group, a halogen atom or an $R_{41}N(R_{43})$— group, d is an integer from 0 to 3 and when d is 2 or 3 the plural $R_{59}$ substituent groups may be the same or different, or may be divalent groups which join together to form a ring structure selected from

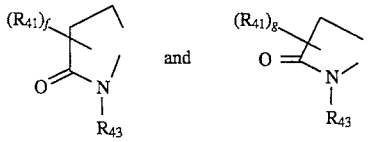

wherein f is an integer from 0 to 4 and g is an integer of value from 0 to 2;

$R_{60}$ is a group of the same significance as $R_{41}$; $R_{61}$ is a group of the same significance as $R_{41}$; $R_{62}$ is a group of the same significance as $R_{41}$, or is an $R_{41}OCONH$— group, an $R_{41}SO_2NH$— group, an $R_{43}N(R_{44})CON(R_{45})$— group, an $R_{43}N(R_{44})SO_2N(R_{45})$— group, an $R_{43}O$— group, an $R_{41}S$— group, a halogen atom or an $R_{41}N(R_{43})$— group; and $R_{63}$ is a group of the same significance as $R_{41}$, or is an $R_{43}N(R_{44})CON(R_{45})$— group, an $R_{43}N(R_{44})CO$— group, an $R_{41}SO_2N(R_{44})$— group, an $R_{43}N(R_{44})SO_2$— group, an $R_{41}SO_2$— group, an $R_{43}OCO$— group, an $R_{43}O$—$SO_2$— group, a halogen atom, a nitro group, a cyano group or an $R_{43}CO$— group; e is an integer of value from 0 to 4; or optionally $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$ and $R_{63}$, same or different, may be a nondiffusible group wherein the total number of carbon atoms therein is from 8 to 40.

9. The silver halide color photographic material as claimed in claim 8, wherein the aliphatic groups, same or different, are selected from saturated or unsaturated, chain like or cyclic, linear chain or branched, substituted or unsubstituted aliphatic hydrocarbyl groups which have from 1 to 32 carbon atoms;

the aromatic groups, same or different, are selected from substituted or unsubstituted naphthyl groups and substituted or unsubstituted phenyl groups having from 6 to 20 carbon atoms; and the heterocyclic groups, same or different, are selected from 3 to 8 member substituted or unsubstituted heterocyclic groups, which have from 1 to 20 carbon atoms and wherein the hetero atoms in the heterocyclic ring are nitrogen, oxygen or sulfur atoms.

10. The silver halide color photographic material as claimed in claim 1, when the A group in Formula (R-I) is a residual group which can undergo oxidation or reduction, Formula (R-I) is represented by the following formula R-II, $$A_1\text{-}P\text{—}(X{=}Y)_n\text{—}Q\text{-}A_2 \qquad \text{Formula [R-II]}$$

wherein:

n is 1 to 3;

P and Q, same or different, are an oxygen atom or a substituted or unsubstituted imino group;

X and Y, individually the same or different, are substituted or unsubstituted methine groups or nitrogen atoms, with the proviso that one of n individual X and n individual Y is substituted by $\text{-}(L_1)_v\text{-B-}(L_2)_w\text{-INH-HYD}$;

$A_1$ and $A_2$, same or different, each are a hydrogen atom or a group which can be cleaved with an alkali; or optionally any two of P, X, Y, Q, $A_1$ and $A_2$ may be divalent and join to form a ring structure, with the proviso that one of the n individual X and n individual Y is substituted by $\text{-}(L_1)_v\text{-B-}(L_2)_w\text{-INH-HYD}$.

11. The silver halide color photographic material as claimed in claim 10, wherein P and Q in Formula R-II each is a group represented by formula $$\text{—}\overset{|}{N}SO_2\text{—G} \quad \text{or} \quad \text{—}\overset{|}{N}CO\text{—G},$$

wherein G is:

a linear chain, branch chain or cyclic, saturated or unsaturated, substituted or unsubstituted, aliphatic group having from 1 to 32 carbon atoms;

a substituted or unsubstituted aromatic group having from 6 to 10 carbon atoms;

a 4 to 7 member heterocyclic group having from 1 to 6 carbon atoms, wherein the hetero atoms thereof are nitrogen, oxygen or sulfur; or a group of the formula —O—G', wherein G' is:

a linear chain, branch chain or cyclic, saturated or unsaturated, substituted or unsubstituted, aliphatic group having 1 to 32 carbon atoms.

12. The silver halide color photographic material as claimed in claim 1, wherein $L_1$ and $L_2$ in Formula R-I are the same or different, and are selected from:

a moiety which may be cleaved in a hemi-acetyl cleavage reaction, a moiety which may be cleaved in an intramolecular nucleophilic substitution reaction, a moiety which may be cleaned with an electron transfer reaction in a conjugated system, a moiety which may be cleaved in an ester hydrolysis reaction, and a moiety which may be cleaved in an iminoketal reaction.

13. The silver halide color photographic material as claimed in claim 1, wherein the INH group present in Formula (R-I) is selected from the group consisting of:

(INH-1)

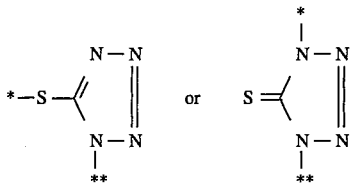

(INH-2)

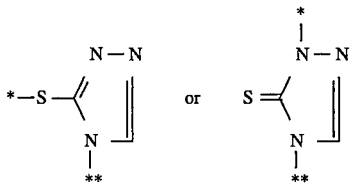

(INH-3)

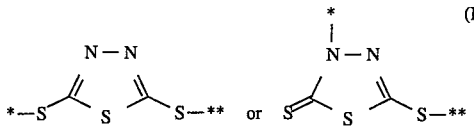

(INH-4)

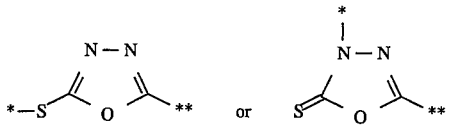

(INH-5)

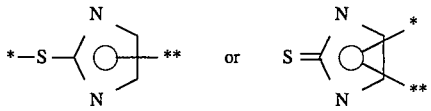

(INH-6)

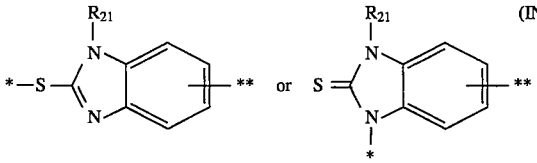

(INH-7)

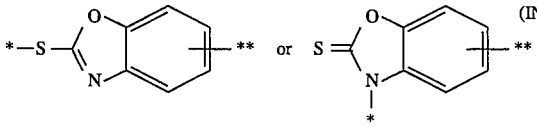

(INH-8)

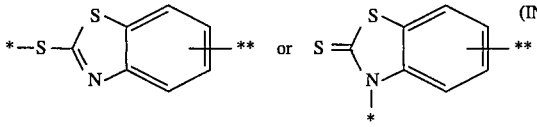

(INH-9)

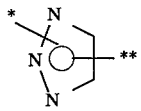

(INH-10)

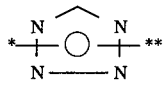

(INH-11)

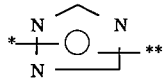

(INH-12)

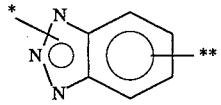

wherein, $R_{21}$ is a hydrogen atom or a substituted or unsubstituted hydrocarbyl group, * represents the position to which the group A-$(L_1)_v$-B-$(L_2)_w$- in formula (R-I) is bonded and ** represents the position to which the group HYD in formula (R-I) is bonded.

14. The silver halide color photographic material as claimed in claim 1, wherein HYD group in the Formula (R-I) is further represented by the formula (HYD-I), $$-(L_3)_{ry}-CO_2R_{22} \qquad \text{Formula [HYD-I]}$$

wherein:

$L_3$ is a group selected from a substituted or unsubstituted alkyl group or a substituted or unsubstituted aryl group;

ry is 0 or 1; and $R_{22}$ is an alkyl group having 1 to 20 carbon atoms.

15. The silver halide color photographic material as claimed in claim 1, which further comprises at least one red sensitive silver halide emulsion layer which contains a cyan coupler, at least one green sensitive silver halide emulsion layer which contains a magenta coupler and at least one blue sensitive silver halide emulsion layer which contains a yellow coupler, and wherein the cyan coupler is a coupler represented by general formula indicated below;

Formula [C]

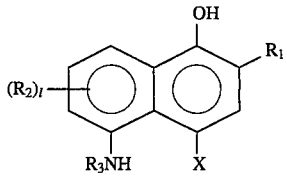

wherein $R_1$ represents $-CONR_4R_5$, $-SO_2NR_4R_5$, $-NHCOR_4$, $-NHCOOR_6$, $-NHSO_2R_6$, $-NHCONR_4R_5$ or $-NHSO_2NR_4R_5$, $R_2$ represents a group which can be substituted on a naphthalene ring, l represents an integer of value from 0 to 3 and when l represents 2 or more, the $R_2$ groups may be the same or different, or they may join together to form a ring structure, $R_3$ represents a substituent group, and X represents a hydrogen atom or a group which can be eliminated by a coupling reaction with the oxidized form of a primary aromatic amine developing agent, or $R_2$ and $R_3$, or $R_3$ and X, may join together to form a ring structure, or dimers or larger oligomers joined together via a group $R_1$, $R_2$, $R_3$ or X which is a divalent group or a group of valency greater than two;

$R_4$ and $R_5$, same or different, each represents a hydrogen atom, an alkyl group, an aryl group or a heterocyclic group, $R_6$ represents an alkyl group, an aryl group or a heterocyclic group.

16. The silver halide color photographic material as claimed in claim 1, which further comprises at least one red sensitive silver halide emulsion layer which contains a cyan coupler, at least one green sensitive silver halide emulsion layer which contains a magenta coupler and at least one blue sensitive silver halide emulsion layer which contains a yellow coupler, wherein said yellow coupler is represented by general formula below;

Formula [A]

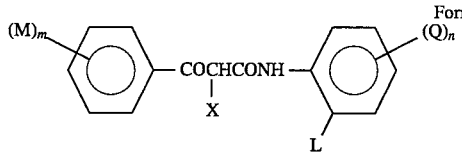

wherein M and Q represent groups (including atoms) which can be substituted on a benzene ring, L represents a hydrogen atom, a halogen atom or an aliphatic oxy group, m represents an integer of value from 0 to 5 and when m is 2 or more the $(M)_m$ groups may be the same or different, n represents an integer of value from 0 to 4 and when n is 2 or more the $(Q)_n$ groups may be the same or different, and X represents a group which can be eliminated by a coupling reaction with the oxidized form of a primary aromatic amine developing agent, or M, Q, L or X may be divalent, trivalent or tetravalent linking groups so that dimers, trimers or tetramers of the yellow couplers represented by general formula [A] can be formed.

17. The silver halide color photographic material as claimed in claim 16, wherein X in general formula [A] is a group represented by the following formula [B]:

—O—R' Formula [B]

wherein, R' is an aromatic group which has from 2 to 30 carbon atoms, a heterocyclic group which has from 1 to 28 carbon atoms, an acyl group which has from 2 to 28 carbon atoms, an aliphatic sulfonyl group which has from 1 to 24 carbon atoms or an aromatic sulfonyl group which has from 6 to 24 carbon atoms.

18. The silver halide color photographic material as claimed in claim 16, wherein X in general formula [A] is a group represented by the following formula [B]:

—S—R" Formula [C]

wherein, R" represents an aliphatic group which has from 1 to 30 carbon atoms, an aromatic group which has from 6 to 30 carbon atoms or a heterocyclic group which has from 1 to 28 carbon atoms.

19. The silver halide color photographic material as claimed in claim 16, wherein X in general formula [A] is a group represented by the following formula [B]:

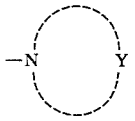

wherein, Y represents a group of non-metal atoms which is required, along with Q, to form a five to seven membered single ring or a condensed ring heterocyclic ring.

20. A silver halide color photographic material comprising a support having thereon at least one photosensitive emulsion layer comprising a DIR coupler that is represented by Formula (I) below and a compound that is represented by Formula (R-I) below;

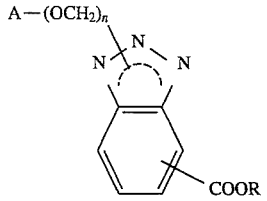

Formula (I)

wherein,

A represents a coupler residual group, n represents an integer of 0 or 1, provided that (i) when A represents a phenol type or naphthol type coupler residual group then n is 1 and (ii) when A represents some other coupler residual group then n is 0, and R represents an alkyl group that has from 1 to 4 carbon atoms or a pyridyl group, and wherein the DIR coupler of Formula (I) is present in the emulsion layer in an amount of $3\times10^{-7}$ to $1\times10^{-3}$ mol/m$^2$;

$A\text{-}(L_1)_v\text{-}B\text{-}(L_2)_w\text{-INH-HYD}$ Formula (R-I)

wherein,

A represents a group that reacts with the oxidized form of a developing agent and cleaves $(L_1)_v$-B-$(L_2)_w$-INH-HYD, $L_1$ represents a group that cleaves the bond with B after cleavage of the bond with A, B is a group that reduces the oxidized form of a developing agent or undergoes a coupling reaction with the oxidized form of a developing agent, produces essentially colorless compounds, cleaves $(L_2)_w$-INH-HYD, and is encompassed by Formula (R-V), $L_2$ represents a group that cleaves INH-HYD after cleavage of the bond with B, INH represents a group that has a development inhibiting capacity, HYD represents an alkoxycarbonyl group or a group that contains an alkoxycarbonyl group, v and w each represent an integer having a value of from 0 to 2, and when they each represent 2, the two $L_1$ and the two $L_2$ groups may be the same or different;

$*\text{—P'—(X'=Y')}_{n'}\text{—Q'-A}_2'$ Formula (R-V)

wherein, n' is 1 to 3,

P' and Q', are the same or different and are an oxygen atom or a substituted or unsubstituted imino group, X' and Y', are each individually the same or different and are substituted or unsubstituted methine groups or nitrogen atoms, provided that one of n' individual X's and n' individual Y's is substituted by the -$(L_2)_w$-INH-HYD group; and $A_2$ is a hydrogen atom or a group that can be cleaved with an alkali, or optionally any two of P', X', Y', Q' and $A_2$' may be divalent and join to form a ring structure, provided that one of the n' individual X's and n' individual Y's is substituted by the -$(L_2)_w$-INH-HYD group; and wherein the DIR coupler of Formula (R-I) is present in the emulsion layer in an amount of $1\times10^{-6}$ to $1\times10^{-3}$ mol/m$^2$.

21. The silver halide color photographic material as claimed in claim 20, wherein Q' in Formula R-V is a group represented by formula $$-\overset{|}{N}SO_2-G \quad \text{or} \quad -\overset{|}{N}CO-G,$$

wherein G is:

a linear chain, branch chain or cyclic, saturated or unsaturated, substituted or unsubstituted, aliphatic group having from 1 to 32 carbon atoms;

a substituted or unsubstituted aromatic group having from 6 to 10 carbon atoms, or a 4 to 7 member heterocyclic group having from 1 to 6 carbon atoms, wherein the hetero atoms thereof are nitrogen, oxygen or sulfur; or a group of the formula —O—G', wherein G' is:

a linear chain, branch chain or cyclic, saturated or unsaturated, substituted or unsubstituted, aliphatic group having 1 to 32 carbon atoms;

a substituted or unsubstituted aromatic group having from 6 to 10 carbon atoms, or a 4 to 7 member heterocyclic group having from 1 to 6 carbon atoms, wherein the hetero atoms thereof are nitrogen, oxygen or sulfur.

* * * * *